US008987570B2

(12) United States Patent
Osuga et al.

(10) Patent No.: US 8,987,570 B2
(45) Date of Patent: Mar. 24, 2015

(54) KEYBOARD DEVICE FOR ELECTRONIC MUSICAL INSTRUMENT

(71) Applicant: Yamaha Corporation, Hamamatsu-shi, Shizuoka-ken (JP)

(72) Inventors: Ichiro Osuga, Hamamatsu (JP); Kenichi Nishida, Hamamatsu (JP); Shunsuke Ichiki, Hamamatsu (JP); Hiroshi Harimoto, Hamamatsu (JP); Shin Yamamoto, Hamamatsu (JP)

(73) Assignee: Yamaha Corporation (JP)

( * ) Notice: Subject to any disclaimer, the term of this patent is extended or adjusted under 35 U.S.C. 154(b) by 101 days.

(21) Appl. No.: 13/927,169

(22) Filed: Jun. 26, 2013

(65) Prior Publication Data

US 2014/0000437 A1 Jan. 2, 2014

(30) Foreign Application Priority Data

Jul. 2, 2012 (JP) ..... 2012-148155
Jul. 2, 2012 (JP) ..... 2012-148156
Aug. 31, 2012 (JP) ..... 2012-190796

(51) Int. Cl.
*G10C 3/12* (2006.01)
*G10H 1/34* (2006.01)

(52) U.S. Cl.
CPC . *G10H 1/34* (2013.01); *G10H 1/346* (2013.01)
USPC ..... 84/433

(58) Field of Classification Search
CPC ..... G10H 1/34; G10H 1/346
USPC ..... 84/433, 423 R, 439, 430, 434–438
See application file for complete search history.

(56) References Cited

FOREIGN PATENT DOCUMENTS

JP 3074794 B2 8/2000

*Primary Examiner* — Jianchun Qin
(74) *Attorney, Agent, or Firm* — Rossi, Kimms & McDowell LLP

(57) ABSTRACT

A keyboard device includes plural white keys, plural black keys, and plural hammers respectively engaged with the plural white and black keys. Vertical length of a drive portion for a first key and a second key are set the same, the first and second keys both being white keys, or both being black keys. Longitudinal position of hammer support portion of a first hammer engaged with the first key and longitudinal position of a hammer support portion of a second hammer engaged with the second key are set the same. Vertical positions of hammer support portions of the first and second hammers are respectively set according to a distance from a front end of an operation portion of the first key and a key support portion and a distance from a front end of an operation portion of the second key and a key support portion.

28 Claims, 33 Drawing Sheets

KEYBOARD DEVICE FOR ELECTRONIC MUSICAL INSTRUMENT

BACKGROUND OF THE INVENTION

1. Field of the Invention

The present invention relates to a keyboard device for an electronic musical instrument such as an electronic organ, an electronic piano, and the like.

2. Description of the Related Art

There has conventionally been known a keyboard device for an electronic musical instrument described in Japanese Patent No. 3074794. In this keyboard device described above, a key touch feeling (reaction force against a key depression/release operation) on a front end of a key, to which a higher pitch is assigned, is set lighter in order to generate a key touch feeling similar to a key touch feeling of an acoustic piano. This keyboard device has plural hammers, each of which rocks through an engagement with the corresponding key so as to apply reaction force against the depression/release operation of the corresponding key. The plural hammers are common components. In this keyboard device, the length from the pivot point of the key, formed on a back end, to the front end of the key becomes gradually longer toward the keys on the high-pitched side from the keys on the low-pitched side. In addition, the position of the pivot point of each hammer is gradually shifted backward from the low-pitched side toward the high-pitched side, by which the distance from the pivot point of the key to the engagement position between the hammer and the key is set to be the same for all keys.

The conventional keyboard device described above has an upper-limit stopper for restricting the upward displacement of the key, the upper-limit stopper being provided posterior to the front end of the key (the end close to a performer). An engagement portion extending downward from the lower surface of the key is brought into contact with the upper-limit stopper. The key tilts such that the back end of the key becomes lower than the front end of the key during the key release state. Therefore, if the length of the engagement portion in the vertical direction is the same for plural keys, the height of the portion, which is just above the contact point of the upper-limit stopper on the top surface of each of the plural keys, becomes the same during the key release state. The shorter the key is, the larger the tilt angle of the key during the key release state becomes. Therefore, the position of the front end of the shorter key out of the plural keys is higher. As described above, the appearance is not considered in the conventional keyboard device.

The conventional keyboard device described above also has a lower-limit stopper for restricting the downward displacement of the key, the lower-limit stopper being provided posterior to the front end of the key. The lower surface of the engagement portion is brought into contact with the lower-limit stopper. Therefore, the rocking range of the front end of the shorter key, out of the plural keys, is larger. A hammer is engaged with the corresponding key at a portion posterior to the engagement portion. The pivot point of the hammer of the shorter key is closer to the engagement portion. Therefore, the contact position of the hammer with the shorter key in the key release state is higher. Accordingly, the rocking range of the hammer, engaged with the shorter key, with the key is larger. In the conventional keyboard device described above, the hammer can rock apart from the hammer. However, as described above, since the rocking range of the hammer with the rocking movement of the key is different depending upon the key with which the hammer is to be engaged, the timing of detaching the hammer from the key (or the depth of the key depression) is different according to the length of the key. The difference in the timing of detaching the hammer from the key is considered to give influence to the key touch feeling. However, the conventional keyboard device does not consider this point.

The present invention is accomplished to solve the problem involved with the appearance of the keyboard device, out of the problems of the conventional keyboard device. Specifically, the present invention aims to provide a keyboard device for an electronic musical instrument having an appearance similar to an appearance of a keyboard device for an acoustic piano. For easy understanding of the present invention, a numeral of a corresponding portion in an embodiment is written in a parenthesis in the description below of each constituent of the present invention. However, each constituent of the present invention should not be construed as being limited to the corresponding portion indicated by the numeral in the embodiment.

In order to attain the foregoing object, the present invention provides a keyboard device for an electronic musical instrument, the keyboard device including: plural white keys and black keys (111*w*, 111*b*) that are supported by a key support portion (Kw1, 113*w*1, Kb1, 113*b*1) in order that front ends thereof rock in a vertical direction by a key depression/release operation by a performer, each white key having an edge line extending in a longitudinal direction on a crossing portion of a side face and a top face, and each black key having an edge line extending in the longitudinal direction on a crossing portion of a lower side face and an upper side face tilting inward with respect to the lower side face, wherein each of plural white keys and each of black keys include an operation portion that is depressed and released by the performer, and a drive portion (111*w*1, 111*b*1) extending downward, and a length from the front end of the operation portion to the key support portion is different among the plural white keys and black keys; plural hammers (116*w*, 116*b*), each of which is engaged with the drive portion of each of the plural white keys and the drive portion of each of the plural black keys, and each of which is supported by a hammer support portion (Hw1, 118*w*1, Hb1, 118*b*1) in order to rock with the rocking movement of each of the plural white keys and black keys; and a restricting member (120, 121) that restricts the rocking movement of the plural hammers in order to restrict the rocking range of the plural white keys and the plural black keys, wherein a vertical length of the drive portion of a first key and a vertical length of the drive portion of a second key are set to be the same, the first key and the second key being both the white keys or both the black keys out of the plural white keys and the plural black keys, and the vertical position of the hammer support portion of the first hammer engaged with the first key and the vertical position of the hammer support portion of the second hammer engaged with the second key are respectively set to a position according to the distance from the front end of the operation portion of the first key to the key support portion and the distance from the front end of the operation portion of the second key to the key support portion, in order that the vertical positions of the front ends of the operation portions of the first key and the second key become the same in a state in which the first key and the second key are released. In a state in which stopping force of stopping the hammer by the restricting member is transmitted through the engagement portion between the key and the hammer, it is regarded that the rocking movement of the key is substantially restricted by the restricting member of the hammer. The state in which the key is released means the state where the upward displacement of the front end of the operation portion of the key is restricted.

In this case, it is preferable that the drive portion of the first key and the drive portion of the second key are respectively provided posterior to the front end of the operation portion of the first key and the front end of the operation of the second key, the distance from the front end of the operation portion of the first key to the key support portion is longer than the distance from the front end of the operation portion of the second key to the key support portion, and the hammer support portion of the first hammer is located to be higher than the hammer support portion of the second hammer.

In this case, it is preferable that the drive portion of the first key and the drive portion of the second key are respectively provided anterior to the front end of the operation portion of the first key and the front end of the operation of the second key, the distance from the front end of the operation portion of the first key to the key support portion is longer than the distance from the front end of the operation portion of the second key to the key support portion, and the hammer support portion of the first hammer is located to be lower than the hammer support portion of the second hammer.

In this case, it is preferable that the length from the front end of the operation portion to the back end of the plural white keys becomes shorter toward the high-pitched side from the low-pitched side, and the length from the front end of the operation portion to the back end of the plural black keys becomes shorter toward the high-pitched side from the low-pitched side.

In this case, it is preferable that the first key and the second key are adjacent white keys, and the edge line of the black key between the first key and the second key is located between the top face of the first key and the top face of the second key, in a state in which the first key, the second key, and the black key are released.

In this case, it is preferable that the first key and the second key are adjacent white keys, and the edge line of the black key between the first key and the second key is located below the top face of the first key and the top face of the second key, in a state in which the first key, the second key, and the black key are depressed, and the rocking movements of the first key, the second key, and the black key are restricted. The state in which the rocking movement is restricted means the state where the same load is applied to the front end of the white key and to the front end of the black key, and the rocking movement of the key is restricted, for example. The present invention also includes the case where a part of the edge line of the black key on the front end is located below the top face of the first key and the top face of the second key.

According to the present invention, the vertical position of the hammer support portion is set according to the length of the key. With this structure, the vertical position of the engagement point where the key and the hammer are engaged with each other in the key release state is made different, whereby the height of the front end of the first key and the height of the front end of the second key in the key release state can be adjusted to be the same. Accordingly, the keyboard device according to the present invention has an appearance similar to an appearance of an acoustic piano in the key release state.

Another aspect of the present invention is a keyboard device for an electronic musical instrument, the keyboard device including: plural white keys and black keys (211*w*, 211*b*) that are supported by a key support portion (Kw2, 213*w*1, Kb2, 213*b*1) in order that front ends thereof rock in a vertical direction by a key depression/release operation by a performer, each white key having an edge line extending in a longitudinal direction on a crossing portion of a side face and a top face, and each black key having an edge line extending in the longitudinal direction on a crossing portion of a lower side face and an upper side face tilting inward with respect to the lower side face, wherein each of plural white keys and each of black keys include an operation portion that is depressed and released by the performer, and a drive portion (211*w*1, 211*b*1) extending downward, and a length from the front end of the operation portion to the key support portion is different among the plural white keys and black keys; plural hammers (216*w*, 216*b*), each of which includes an engagement portion engaged with the drive portion of each of the plural white keys and the drive portion of each of the plural black keys, and each of which is supported by a hammer support portion (Hw2, 218*w*1, Hb2, 218*b*1) in order to rock with the rocking movement of each of the plural white keys and black keys; and a restricting member (220, 221, 221A) that restricts the rocking movement of the plural hammers in order to restrict the rocking range of the plural white keys and the plural black keys, wherein a vertical length of the drive portion of a first key and a vertical length of the drive portion of a second key are set to be the same, the first key and the second key being both the white keys or being both the black keys out of the plural white keys and the plural black keys, the longitudinal position and the vertical position of the hammer support portion of the first hammer engaged with the first key and the longitudinal position and the vertical position of the hammer support portion of the second hammer engaged with the second key are set to be the same, and a vertical position of an engagement point of the first key and the first hammer and a vertical position of an engagement point of the second key and the second hammer are respectively set to a position according to the distance from the front end of the operation portion of the first key to the key support portion and the distance from the front end of the operation portion of the second key to the key support portion, in order that the vertical positions of the front ends of the operation portions of the first key and the second key become the same in a state in which the first key and the second key are released. In a state in which stopping force of stopping the hammer by the restricting member is transmitted through the engagement portion between the key and the hammer, it is regarded that the rocking movement of the key is substantially restricted by the restricting member of the hammer. The state in which the key is released means the state where the upward displacement of the front end of the operation portion of the key is restricted.

In this case, it is preferable that the restricting member includes an upper-limit stopper (221, 221A) restricting an upward rocking movement of the front ends of the first key and the second key, and a position of a contact point between the first hammer and the upper-limit stopper and a position of a contact point between the second hammer and the upper-limit stopper are respectively set to a position according to the distance from the front end of the operation portion of the first key to the key support portion and the distance from the front end of the operation portion of the second key to the key support portion, in order that a rocking angle of the first hammer and a rocking angle of the second hammer in the key release state of the first key and the second key are respectively set to an angle according to the distance from the front end of the operation portion of the first key to the key support portion and the distance from the front end of the operation portion of the second key to the key support portion.

In this case, it is preferable that the first hammer and the second hammer respectively include a contact portion (216*w*3, 216*b*3) to the upper-limit stopper, the contact portion has a contact surface extending in the longitudinal direction, the contact surface tilts with respect to a mounting surface (FR2) of the upper-limit stopper in the key release state of the first key and the second key, and the longitudinal position of the upper-limit stopper with respect to the contact portion of the first hammer and the longitudinal position of the upper-limit stopper with respect to the contact portion of the second hammer are respectively set to a position according to the distance from the front end of the operation portion of the first key to the key support portion and the distance from the front end of the operation portion of the second key to the key support portion, in order that the vertical position of the contact point between the first hammer and the upper-limit stopper and the vertical position of the contact point between the second hammer and the upper-limit stopper are set to be the same, and that the longitudinal position of the contact point between the first hammer and the upper-limit stopper and the longitudinal position of the contact point between the second hammer and the upper-limit stopper are respectively set to a position according to the distance from the front end of the operation portion of the first key to the key support portion and the distance from the front end of the operation portion of the second key to the key support portion.

In this case, it is preferable that the drive portion of each of the plural white keys is provided posterior to the front end of the operation portion of each of the plural white keys, the drive portion of each of the plural black keys is provided anterior to the front end of the operation portion of each of the plural black keys, and a tilting direction of the contact surface of the hammer engaged with the white key and a tilting direction of the contact surface of the hammer engaged with the black key are reverse to each other.

In this case, it is preferable that the thickness of the upper-limit stopper (221A) that is in contact with the first hammer and the second hammer is set to be a thickness according to the distance from the front end of the operation portion of the first key to the key support portion and the distance from the front end of the operation portion of the second key to the key support portion, in order that the vertical position of the contact point between the first hammer and the upper-limit stopper and the vertical position of the contact point between the second hammer and the upper-limit stopper are respectively set to a position according to the distance from the front end of the operation portion of the first key to the key support portion and the distance from the front end of the operation portion of the second key to the key support portion.

In this case, it is preferable that the engagement portion of the first hammer and the engagement portion of the second hammer respectively have a base member (Fw21, Fw22, Fb21, Fb22) and a spacer (SP) mounted to the base member, and the thickness of the spacer is set according to the distance from the front end of the operation portion of the first key to the key support portion and the distance from the front end of the operation portion of the second key to the key support portion.

In this case, it is preferable that the first hammer and the second hammer are bent in the vertical direction on the middle part in the longitudinal direction by a bending process, and a bending amount of the first hammer and the second hammer by the bending process is set according to the distance from the front end of the operation portion of the first key to the key support portion and the distance from the front end of the operation portion of the second key to the key support portion.

In this case, it is preferable that the length from the front end of the operation portion to the back end of the plural white keys becomes shorter toward the high-pitched side from the low-pitched side, and the length from the front end of the operation portion to the back end of the plural black keys becomes shorter toward the high-pitched side from the low-pitched side.

In this case, it is preferable that the first key and the second key are adjacent white keys, and the edge line of the black key between the first key and the second key is located between the top face of the first key and the top face of the second key, in a state in which the first key, the second key, and the black key are released.

In this case, it is preferable that the first key and the second key are adjacent white keys, and the edge line of the black key between the first key and the second key is located below the top face of the first key and the top face of the second key, in a state in which the first key, the second key, and the black key are depressed, and the rocking movements of the first key, the second key, and the black key are restricted. The state in which the rocking movement is restricted means the state where the same load is applied to the front end of the white key and to the front end of the black key, and the rocking movement of the key is restricted, for example. The present invention also includes the case where a part of the edge line of the black key on the front end is located below the top face of the first key and the top face of the second key.

According to the present invention, the vertical position of the engagement point where the key and the hammer are engaged with each other in the key release state is made different by the structure in which the rocking angle of the hammer in the key release state is made different, the thickness of the spacer mounted to the base member is made different, and the bending amount of the hammer in the bending process is made different, whereby the height of the front end of the first key and the height of the front end of the second key in the key release state can be adjusted to be the same. Accordingly, the keyboard device according to the present invention has an appearance similar to an appearance of an acoustic piano in the key release state.

Another aspect of the present invention is a keyboard device for an electronic musical instrument, the keyboard device including: plural white keys and black keys (311*w*, 311*b*) that are supported by a key support portion (Kw3, 313*w*1, Kb3, 313*b*1) in order that front ends thereof rock in a vertical direction by a key depression/release operation by a performer, each white key having an edge line extending in a longitudinal direction on a crossing portion of a side face and a top face, and each black key having an edge line extending in the longitudinal direction on a crossing portion of a lower side face and an upper side face tilting inward with respect to the lower side face, wherein each of plural white keys and each of black keys include an operation portion that is depressed and released by the performer, and a drive portion (311*w*1, 311*b*1) extending downward, and a length from the front end of the operation portion to the key support portion is different among the plural white keys and black keys; plural hammers (316*w*, 316*b*), each of which is engaged with the drive portion of each of the plural white keys and the drive portion of each of the plural black keys, and each of which is supported by a hammer support portion (Hw3, 318*w*1, Hb3, 318*b*1) in order to rock with the rocking movement of each of the plural white keys and black keys; and a restricting member (320, 321) that restricts the rocking movement of the plural hammers in order to restrict the rocking range of the plural white keys and the plural black keys, wherein vertical positions of engagement portions between the plural white keys as well as the plural black keys and the plural hammers are set to be the same in a state in which the plural white keys and the plural black keys are released, and in a state in which a first key and a second key out of the plural white keys and the plural black keys are released, the first key and the second key being both the white keys or being both the black keys, the vertical size of the first key and the vertical size of the second key are respectively set according to the distance from the front end of the operation portion of the first key to the key support portion and the distance from the front end of the operation portion of the second key to the key support portion in order that the vertical positions of the front ends of the operation portions of the first key and the second key become the same. In a state in which stopping force of stopping the hammer by the restricting member is transmitted through the engagement portion between the key and the hammer, it is regarded that the rocking movement of the key is substantially restricted by the restricting member of the hammer. The state in which the key is released means the state where the upward displacement of the front end of the operation portion of the key is restricted.

In this case, it is preferable that the first key and the second key are configured by combining plural components (Uw, Mw, Lw, Ub, Mb, Lb) in the vertical direction, and the vertical size of one or more components out of the plural components forming the first key and the second key is set according to the distance from the front end of the operation portion of the first key to the key support portion and the distance from the front end of the operation portion of the second key to the key support portion.

In this case, it is preferable that the plural components forming the first key and the second key include a shock absorbing member (SA) mounted on a lower end of the drive portion, and the thickness of the shock absorbing member is set according to the distance from the front end of the operation portion of the first key to the key support portion and the distance from the front end of the operation portion of the second key to the key support portion.

In this case, it is preferable that the length from the front end of the operation portion to the back end of the plural white keys becomes shorter toward the high-pitched side from the low-pitched side, and the length from the front end of the operation portion to the back end of the plural black keys becomes shorter toward the high-pitched side from the low-pitched side.

In this case, it is preferable that the first key and the second key are adjacent white keys, and the edge line of the black key between the first key and the second key is located between the top face of the first key and the top face of the second key, in a state in which the first key, the second key, and the black key are released.

In this case, it is preferable that the first key and the second key are adjacent white keys, and the edge line of the black key between the first key and the second key is located below the top face of the first key and the top face of the second key, in a state in which the first key, the second key, and the black key are depressed, and the rocking movements of the first key, the second key, and the black key are restricted. The state in which the rocking movement is restricted means the state where the same load is applied to the front end of the white key and to the front end of the black key, and the rocking movement of the key is restricted, for example. The present invention also includes the case where a part of the edge line of the black key on the front end is located below the top face of the first key and the top face of the second key.

According to the present invention, the vertical size of the first key and the vertical size of the second key are set according to the longitudinal length of the first key and the longitudinal length of the second key in order that the height of the front end of the first key and the height of the front end of the second key in the key release state are adjusted to be the same. Accordingly, the keyboard device according to the present invention has an appearance similar to an appearance of an acoustic piano in the key release state.

Still another aspect of the present invention is that the distance between a plane including the edge line of the first key and the key support portion of the first key is set to be the same as the distance between a plane including the edge line of the second key and the key support portion of the second key. In this case, it is preferable that the vertical positions of the key support portions of the first key and the second key are set to be the same. With this structure, the parts other than the parts involved with the length of the key can be made common as much as possible. This structure also simplifies the design of the support member (frame) supporting the key. This structure also facilitates the processing of the support member, whereby precision can be enhanced.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

A first embodiment of the present invention will be described below with reference to the drawings. In the description below, a side close to a performer is defined as a "front side", while a side far from the performer is defined as a "rear side". A high-pitched side is defined as a "right side", while a low-pitched side is defined as a "left side".

Figure 1:
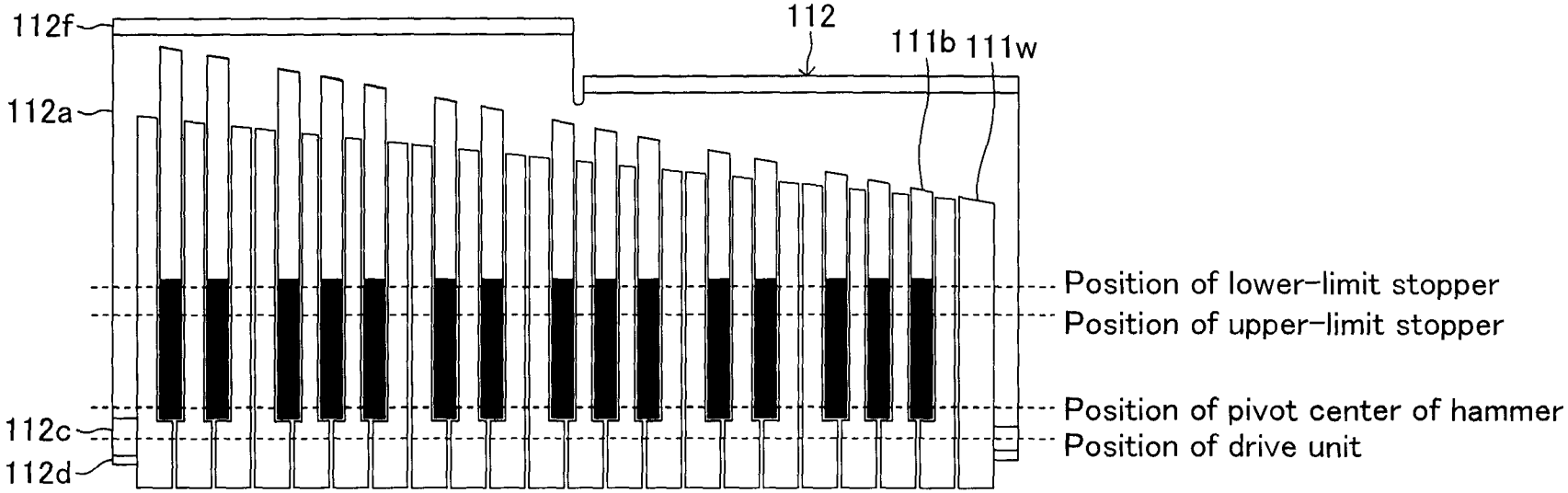
FIG. 1 is a plan view illustrating a keyboard device according to a first embodiment of the present invention.
Figure 2:
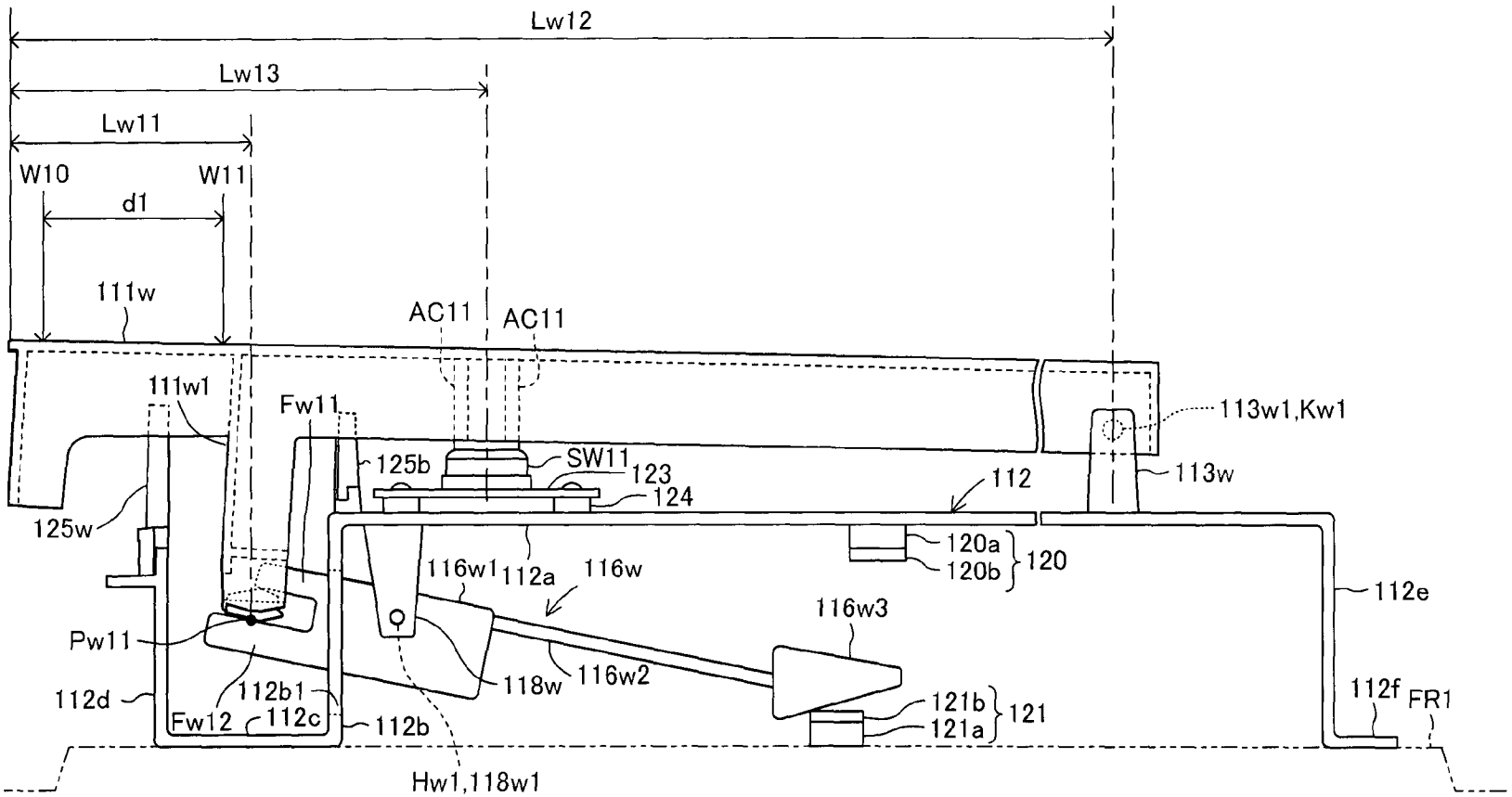
FIG. 2 is a right side view illustrating a configuration of a white key on a low-pitched side in the keyboard device illustrated in FIG. 1.
Figure 3:
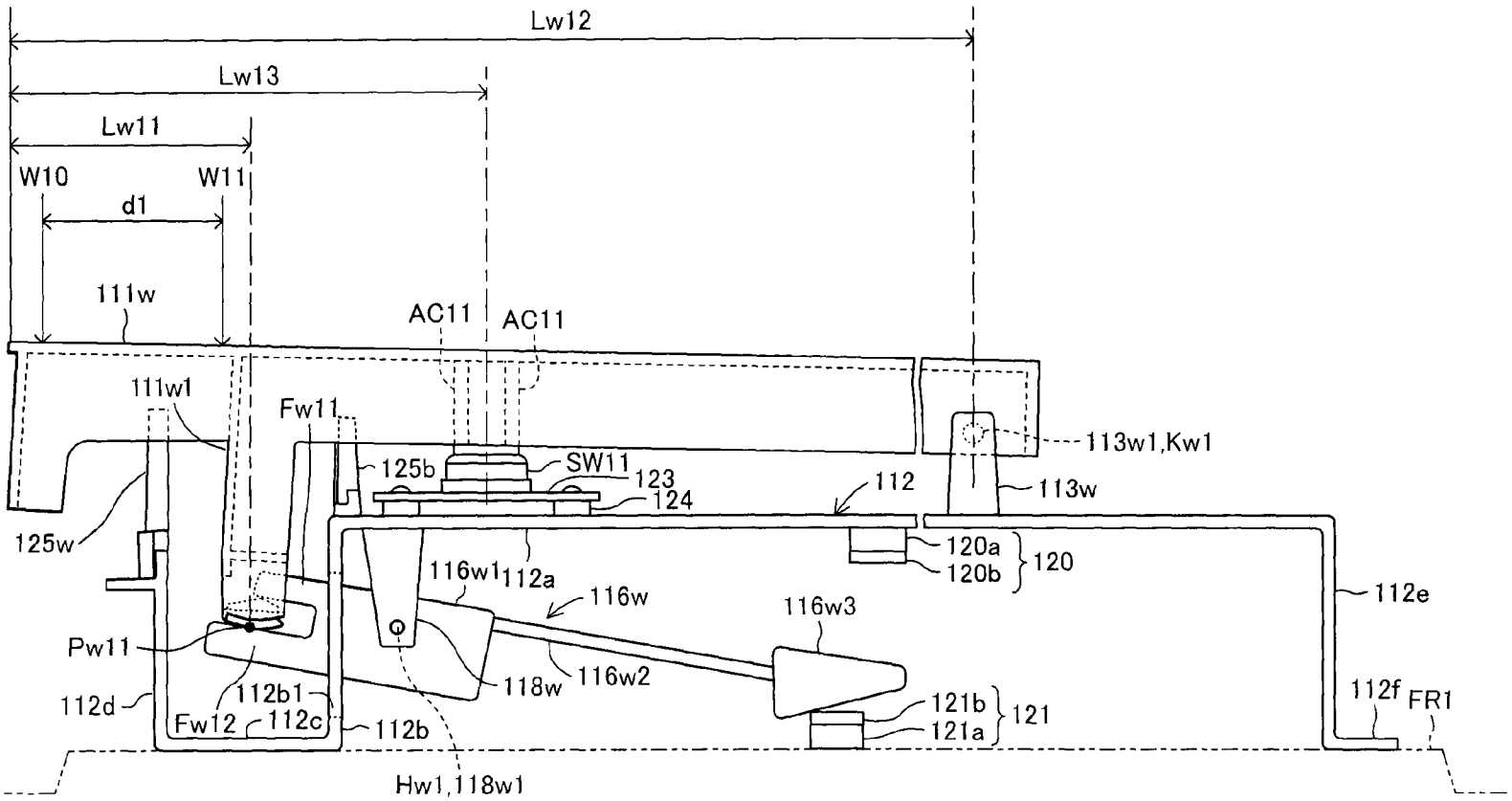
FIG. 3 is a right side view illustrating a configuration of a white key on a high-pitched side in the keyboard device illustrated in FIG. 1.
Figure 4:
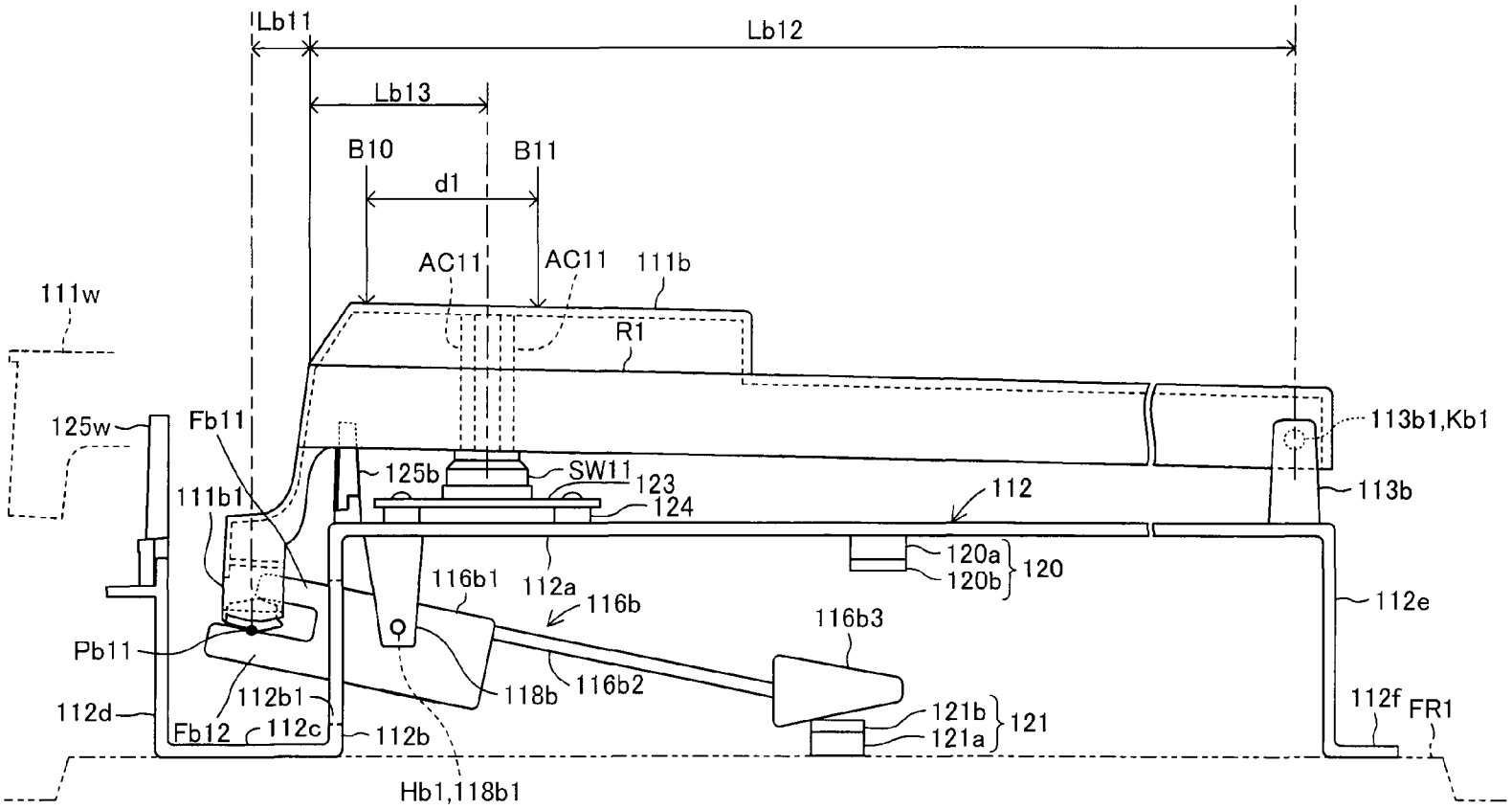
FIG. 4 is a right side view illustrating a configuration of a black key on a low-pitched side in the keyboard device illustrated in FIG. 1.
Figure 5:
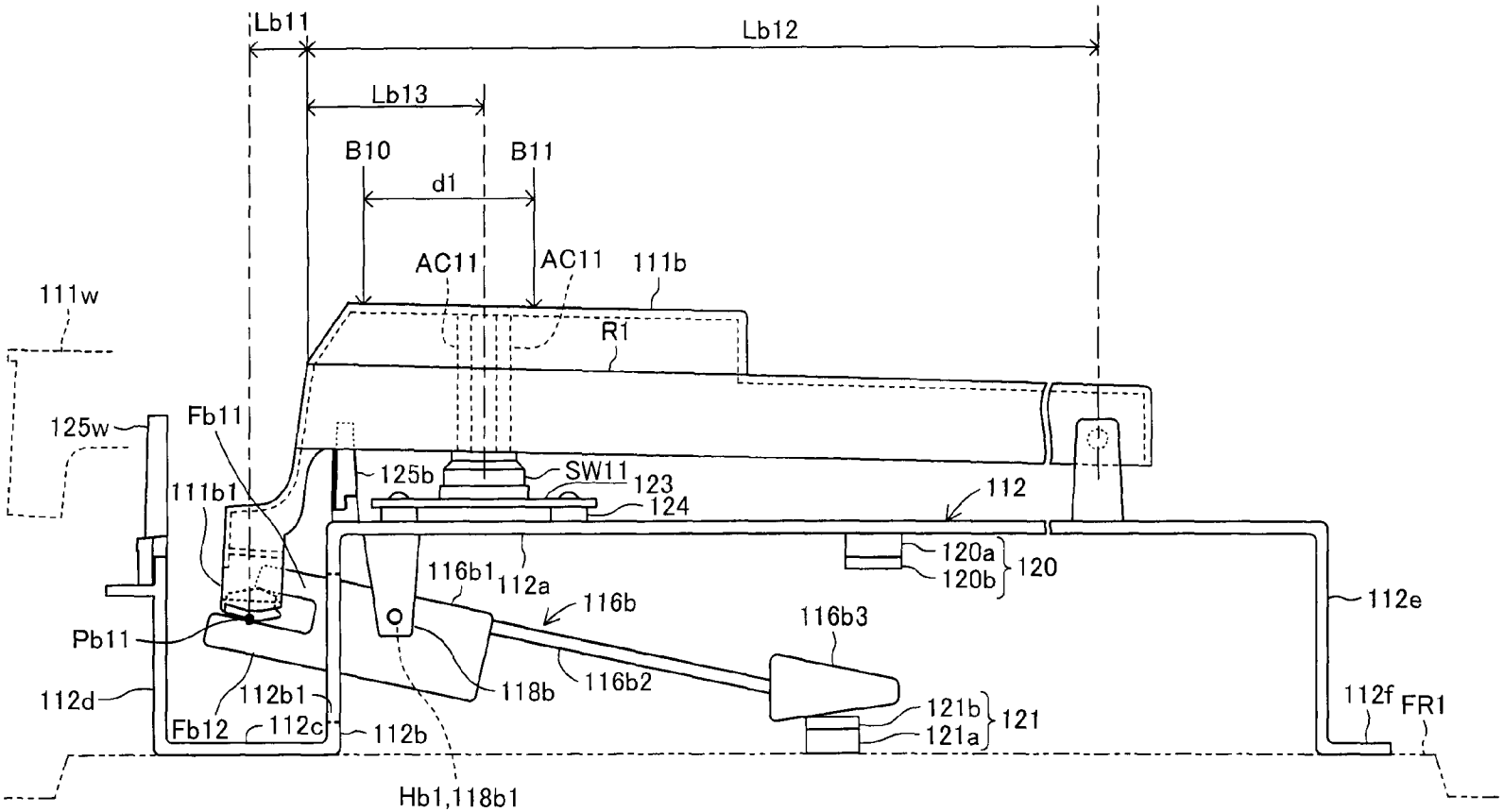
FIG. 5 is a right side view illustrating a configuration of a black key on a high-pitched side in the keyboard device illustrated in FIG. 1.

A keyboard device includes plural white keys 111*w* and plural black keys 111*b* as illustrated in FIG. 1. A different pitch is assigned to each of plural white keys 111*w* and each of plural black keys 111*b*. In the present embodiment, one of "C3", "D3", . . . "C6" is assigned to the white keys 111*w*, while one of "C#3", "D#3", "B#5" is assigned to the black keys 111*b*. The white keys 111*w* and black keys 111*b* are integrally formed to have a long shape by a synthetic resin. The white keys 111*w* are configured such that the length thereof is gradually shorter toward the white key 111*w* on the high-pitched side from the white key 111*w* on the low-pitched side. The black keys 111*b* are configured such that the length thereof is gradually shorter toward the black key 111*b* on the high-pitched side from the black key 111*b* on the low-pitched side. The back end of the black key 111*b* is located posterior to the back end of the adjacent white key 111*w*.

The white keys 111*w*, each having a different assigned pitch, have different length in the longitudinal direction, but the other structures are the same. The black keys 111*b*, each having a different assigned pitch, have different length in the longitudinal direction, but the other structures are the same. Each of the white keys 111*w* has a width in the vertical direction smaller than that of the black key 111*b*, and has a width in the lateral direction larger than that of the black key 111*b*, as illustrated in FIGS. 2 to 5. The white key 111*w* and the black key 111*b* have a hollow shape including a thin top wall extending in the longitudinal direction, and thin sidewalls extending downward from left and right ends of the top wall respectively, with no bottom.

Through-holes Kw1 and Kb1 that are opposite to each other are formed on the rear part of the sidewall of the white key 111*w* and the black key 111*b*. The distance from the through-holes Kw1 and Kb1 to the back end of each key is the same for all keys. The white key 111*w* and the black key 111*b* are supported by a key support portion 113*w* and a key support portion 113*b* of a later-described key frame 112 with the through-holes Kw1 and Kb1. In the key release state, the white key 111*w* and the black key 111*b* tilt such that the back end becomes lower than the front end. The back end of the white key 111*w* goes into a casing of the electronic musical instrument, when the keyboard device is assembled to the electronic musical instrument. The portion of the white key anterior to the portion going into the casing is referred to as an apparent portion of the white key 111*w*. An edge line is formed on the portion where the side face and the top face of the white key 111*w* cross each other. The black key 111*b* has a portion projecting upward from the top face of the white key 111*w* in a state in which the black key 111*b* is not depressed, and the adjacent white keys 111*w* are not depressed. The projecting portion is referred to as an apparent portion of the black key 111*b*. The portion lower than the apparent portion of the black key 111*b* is referred to as a body. A performer depresses or releases the apparent portions of the white key 111*w* and the black key 111*b*. Specifically, the apparent portion corresponds to an operation portion in the present invention. The width of the apparent portion of the black key 111*b* in the lateral direction becomes narrower toward the top end, and the width of the body in the lateral direction is the same. Specifically, the side face of the apparent portion tilts inward with respect to the side face of the body. An edge line R1 is formed on the boundary between the apparent portion of the black key 111*b* and the body (see FIGS. 4 and 5).

The key frame 112 has a top plate 112*a* extending in the longitudinal direction and lateral direction. The position of the front end of the top plate 112*a* at the low-pitched side and the position of the front end at the high-pitched side are the same, but the back end at the low-pitched side is located posterior to the back end at the high-pitched side. The key frame 112 also has a front plate 112*b* vertically extending downward from the front end of the top plate 112*a*, a bottom plate 112*c* horizontally extending from the lower end of the front plate 112*b*, and a front plate 112*d* vertically extending upward from the front end of the bottom plate 112*c*. The key frame 112 also includes a rear plate 112*e* vertically extending downward from the back end of the top plate 112*a*, and a bottom plate 112*f* horizontally extending rearward from the lower end of the rear plate 112*e*. The height of the lower surface of the bottom plate 112*c* and the height of the lower surface of the bottom plate 112*f* are the same. The keyboard device is supported by a frame FR1 of an electronic musical instrument by the structure in which the lower surface of the bottom plate 112*c* and the lower surface of the bottom plate 112*f* are brought into contact with the frame FR1 of the electronic musical instrument and fixed thereto. The above-described key support portion 113*w* and the key support portion 113*b* are formed to project upward from the upper surface of the top plate 112*a*. The key support portion 113*b* is located posterior to the adjacent key support portion 113*w*. The key support portion 113*w* and the key support portion 113*b* respectively include two opposing plates, and a projection 113*w*1 and projection 113*b*1 that project inward. The projections 113*w*1 and 113*b*1 are fitted to the through-holes Kw1 and Kb1 respectively. Therefore, the white key 111*w* and the black key 111*b* are supported to be rotatable about the projections 113*w*1 and 113*b*1, and their front ends can rock in the vertical direction with the center axes of the through-holes Kw1 and Kb1 and the projections 113*w*1 and the projections 113*b*1 being defined as a pivot center. The position of the projection 113*w*1 and the position of the projection 113*b*1 in the vertical direction are the same for all key support portions. Specifically, the height of the pivot center is the same for all keys. The distance between the top face of the apparent portion of the white key 111*w* (i.e., the plane including the right and left edge lines of the white key 111*w*) and its pivot center in the vertical direction is the same for all white keys 111*w*. The distance between the top face of the operation portion of the black key 111*b* (i.e., the plane including the right and left edge lines of the black key 111*b*) and its pivot center in the vertical direction is the same for all black keys 111*b*.

A drive portion 111*w*1 extends downward from the middle portion of the apparent portion of the white key 111*w*. The drive portion 111*w*1 has a hollow shape including a thin front wall extending in the vertical direction, and thin sidewalls extending rearward from left and right ends of the front wall, with no rear wall. The lower end of the drive portion 111*w*1 is closed by a lower end wall. The length of the drive portion 111*w*1 in the vertical direction is the same for all white keys 111*w*. On the other hand, the black key 111*b* also has a drive portion 111*b*1 same as the drive portion 111*w*1 of the white key 111*w*. The drive portion 111*b*1 has a connection portion that extends downward from the front end of the apparent portion of the black key 111*b* and that is slightly curved to the front, and a vertical portion projecting downward from the leading end of the connection portion. The configuration of the vertical portion is the same for the drive portion 111*w*1. The length of the drive portion 111*b*1 in the vertical direction is the same for all black keys 111*b*.

A distance Lw11 from the front end of the white key 111*w* to the drive portion 111*w*1 in the longitudinal direction is within 30% of a distance Lw12 from the front end of the white key 111*w* with the highest pitch (i.e., the shortest key of the plural white keys 111*w*) to the through-hole Kw1. The distance Lw11 is the same for all white keys 111*w*. A distance Lb11 from the front end of the apparent portion of the black key 111*b* to the drive portion 111*b*1 in the longitudinal direction is within 30% of a distance Lb12 from the front end of the apparent portion of the black key 111*b* with the highest pitch (e.g., the shortest key of the plural black keys 111*b*) to the through-hole Kb1. The distance Lb11 is the same for all black keys 111*b*. The position of the drive portion 111*w*1 and the position of the drive portion 111*b*1 in the longitudinal direction in the key-released state of the white key 111*w* and the black key 111*b* are the same. Specifically, the drive portions 111*w*1 and the drive portions 111*b*1 are located anterior to the front end of the apparent portion of the black keys 111*b*, and the drive portions 111*w*1 and the drive portions 111*b*1 are arranged in the lateral direction.

The lower ends of the drive portion 111*w*1 and the drive portion 111*b*1 are respectively engaged with front ends of hammers 116*w* and 116*b* in the opening formed between the front plate 112*b* and the front plate 112*d*. As described in detail later, the hammer 116*w* and the hammer 116*b* rock with the rocking movement of the corresponding white key 111*w* and the black key 111*b* with which the respective hammers 116*w* and 116*b* are engaged.

The hammer 116*w* includes a base 116*w*1 made of synthetic resin, a connection rod 116*w*2 made of metal, and a mass member 116*w*3. Like the hammer 116*w*, the hammer 116*b* includes a base 116*b*1, a connection rod 116*b*2, and a mass member 116*b*3. The base 116*w*1 and the base 116*b*1 are plate-like members, and formed with through-holes Hw1 and Hb1, respectively, from the right side face to the left side face. A hammer support portion 118*w* and a hammer support portion 118*b* are formed to project downward from the lower surface of the top plate 112*a*. The hammer support portions 118*w* and 118*b* are formed to have two opposing plates, and respectively have projections 118*w*1 and 118*b*1 projecting inward. The projections 118*w*1 and 118*b*1 are respectively fitted to the through-holes Hw1 and Hb1. With this structure, the bases 116*w*1 and 116*b*1 are supported to be rotatable about the projections 118*w*1 and 118*b*1. Specifically, the hammer 116*w* and the hammer 116*b* are supported such that the front ends and the back ends can be rocked in the vertical direction. The positions of the hammer support portion 118*w* and the hammer support portion 118*b* in the longitudinal direction and in the vertical direction are the same for all hammer support portions 118*w* and 118*b*. The positions of the projections 118*w*1 and 118*b*1 in the longitudinal direction are the same for all hammer support portions 118*w* and hammer support portions 118*b*. The projection 118*w*1 of the hammer support portion 118*w* of the hammer 116*w* for the white key 111*w* to which the higher pitch is assigned is located on a lower position. The projection 118*b*1 of the hammer support portion 118*b* of the hammer 116*b* for the black key 111*b* to which the higher pitch is assigned is located on a higher position.

The base 116*w*1 includes a pair of leg portion Fw11 and leg portion Fw12 on its front end. The upper leg portion Fw11 is formed to be shorter than the lower leg portion Fw12. Like the base 116*w*1, the base 116*b*1 includes a pair of leg portion Fb11 and leg portion Fb12 on its front end. An elongated slit-like opening 112*b*1 extending in the vertical direction is formed on the front plate 112*b* for each of the hammers 116*w* and 116*b*. The front end of each hammer 116*w* and the front end of each hammer 116*b* project forward of the front plate 112*b* through the opening 112*b*1. The wall of the lower end of the drive portion 111w1 enters between the leg portions Fw11 and Fw12, while the wall of the lower end of the drive portion 111b1 enters between the leg portions Fb11 and Fb12. Specifically, the leg portions Fw11 and Fb11 enter between the walls of the lower ends of the drive portions 111w1 and 111b1 and intermediate walls that form gaps with the walls of the lower ends in the drive portions 111w1 and 111b1. Shock absorbing members such as rubber, urethane, or felt are fitted and fixed on the wall of the lower end of each of the drive portions 111w1 and 111b1. The shock absorbing members attenuates shock caused by the collision between the lower end of the drive portion 111w1 and the upper surface of the leg portion Fw12, the collision between the lower end of the drive portion 111b1 and the upper surface of the leg portion Fb12, the collision between the lower end of the drive portion 111w1 and the lower surface of the leg portion Fw11, and the collision between the lower end of the drive portion 111b1 and the lower surface of the leg portion Fb11.

The front end of the connection rod 116w2 and the front end of the connection rod 116b2 are assembled to the back end of the base 116w1 and the back end of the base 116b1, respectively. The connection rods 116w2 and 116b2 extend rearward. The position of the back end of the connection rod 116w2 and the position of the back end of the connection rod 116b2 in the longitudinal direction are the same. The mass member 116w3 and the mass member 116b3, described later, are assembled to the back end of the connection rod 116w2 and the back end of the connection rod 116b2, respectively.

The mass member 116w3 and the mass member 116b3 are formed to have a plate-like shape. The mass member 116w3 and the mass member 116b3 are long in the longitudinal direction. The mass member 116w3 and the mass member 116b3 are assembled to the connection rods 116w2 and 116b2 in such a manner that the thickness thereof is along the lateral direction. In the key release state, the lower surface of the mass member 116w3 tilts with respect to the top surface of the frame FR1, and the back side of the lower surface of the mass member 116w3 is located to be higher than the front side. In the key release state, the lower surface of the mass member 116b3 tilts with respect to the top surface of the frame FR1, and the back side of the lower surface of the mass member 116b3 is located to be higher than the front side. In the key depression state, the top surfaces of the mass member 116w3 and the mass member 116b3 are parallel to the lower surface of the top plate 112a of the key frame 112. The appearance of the mass member 116w3 is the same for all hammers 116w. The appearance of the mass member 116b3 is also the same for all hammers 116b.

As described above, the position of the pivot point of the key is different depending upon the assigned pitch. Therefore, the distance from the pivot center of the white key 111w to an engagement portion Pw11 where the leg portion Fw12 and the drive portion 111w1 are engaged with each other (brought into contact with each other) is different depending upon the assigned pitch. The distance from the pivot center of the black key 111b to an engagement portion Pb11 where the leg portion Fb12 and the drive portion 111b1 are engaged with each other (brought into contact with each other) is also different depending upon the assigned pitch. A key depression/release operation position W10 of the white key 111w that is the front end of the position of the white key 111w with the potentiality of being depressed or released is located anterior to the engagement portion Pw11, while a key depression/release operation position B10 of the black key 111b that is the front end of the position of the black key 111b with the potentiality of being depressed or released is located posterior to the engagement portion Pb11. Therefore, if the masses of the mass members for all hammers are equal, a key touch feeling is heavier on the middle-pitched part than on the low-pitched part, and the key touch feeling is heavier on the high-pitched part than on the middle-pitched part, on the key depression/release operation positions W10 and B10, because of the principle of leverage.

Figure 6:
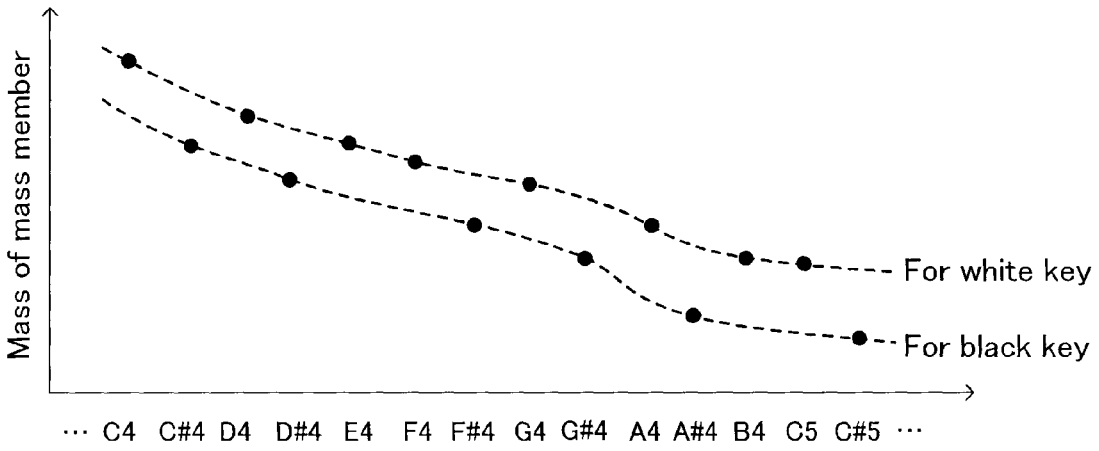
FIG. 6 is a graph of a characteristic curve illustrating a relationship between a pitch and a mass of a mass member.
Figure 7:
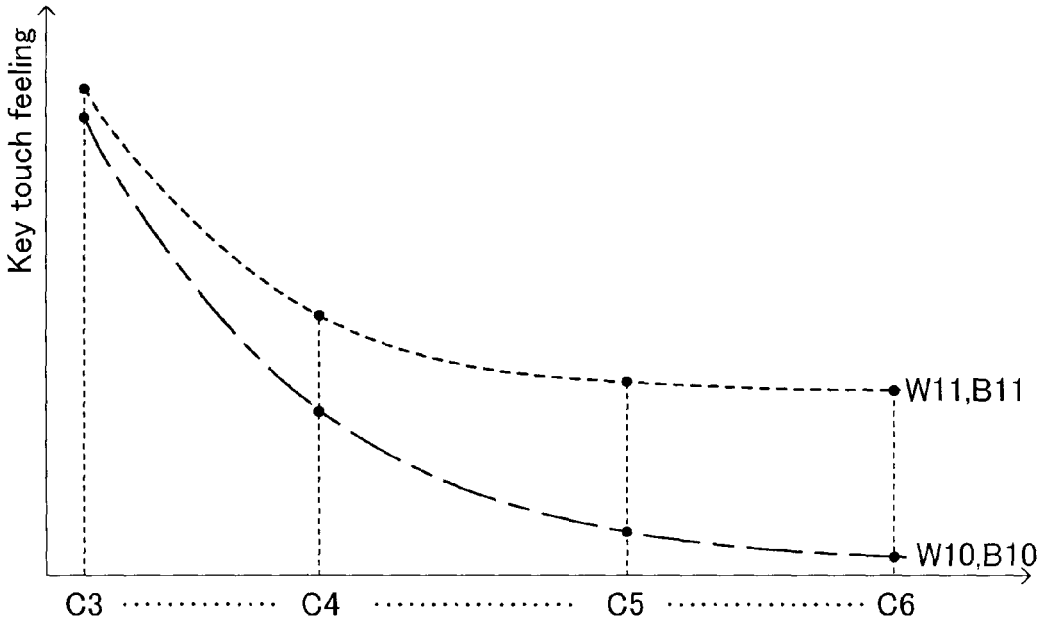
FIG. 7 is a graph of a characteristic curve illustrating a relationship between a pitch and a key touch.

In addition, in this case, the key touch feeling of the white keys 111w and the black keys 111b in each range is not equal. Specifically, the key touch feeling of the black key 111b is heavier than the key touch feeling of the adjacent two white keys 111w. In view of this, the mass of the mass member 116w3 and the mass of the mass member 116b3 are adjusted for each key as illustrated in FIG. 6. Specifically, as illustrated in a characteristic curve indicating the masses of the mass members 116w3 and 116b3 in the order of pitches, the masses of the mass members 116w3 and 116b3 are adjusted such that the characteristic curve of the mass member 116w3 and the characteristic curve of the mass member 116b3 are parallel downward-sloping curves, wherein the characteristic curve of the mass member 116b3 is located below the characteristic curve of the mass member 116w3. Thus, as illustrated by a chain line in FIG. 7, the key touch feeling on the key depression/release operation positions W10 and B10 becomes gradually lighter toward the high-pitched side from the low-pitched side. Therefore, as illustrated by a broken line in FIG. 7, the key touch feeling on key depression/release operation positions W11 and B11 located posterior to the key depression/release operation positions W10 and B10 by a distance d1 also becomes gradually lighter toward the high-pitched side from the low-pitched side. Since the length of the key to which a higher pitch is assigned is shorter, the difference between the key touch feeling on the key depression/release operation positions W10 and B10 and the key touch feeling on the key depression/release operation positions W11 and B11 becomes larger toward the high-pitched side from the low-pitched side. Specifically, the difference in the key touch feeling caused by the longitudinal difference of the key depression/release operation position is small on the low-pitched side, moderate in the middle-pitched side, and large on the high-pitched side.

When the white key 111w and the black key 111b are released, the front ends of the hammers 116w and 116b displace upward due to their own weight of the hammers 116w and 116b. In this case, the drive portion 111w1 and the drive portion 111b1 are biased upward by the leg portion Fw12 and the leg portion Fb12 respectively, whereby the front ends of the white key 111w and the black key 111b displace upward. On the other hand, when the white key 111w and the black key 111b are depressed, the lower surfaces of the drive portion 111w1 and the drive portion 111b1 press the upper surfaces of the leg portion Fw12 and the leg portion Fb12 respectively, whereby the front ends of the hammer 116w and the hammer 116b respectively displace downward.

A lower-limit stopper 120 is provided to the key frame 112. During the key depression, the lower-limit stopper 120 is brought into contact with the upper surfaces of the mass member 116w3 and the mass member 116b3 of the hammer 116w and the hammer 116b so as to restrict the upward displacement of the back ends of the hammer 116w and the hammer 116b, thereby restricting the downward displacement of the front ends of the white key 111w and the black key 111b. The lower-limit stopper 120 includes a stopper rail 120a and a buffer member 120b. The stopper rail 120a protrudes downward from the lower surface at the middle of the top plate 112a, and extends parallel to the arrangement direction of the keys. The projection amount of the stopper rail 120a from the lower surface of the top plate 112a on the contact portion between the stopper rail 120*a* and each hammer is constant in the lateral direction. The buffer member 120*b* is fixed to the lower end surface of the stopper rail 120*a*. The buffer member 120*b* is a long member made of a shock-absorbing member such as rubber or felt. The sectional shape of the buffer member 120*b* is uniform from one end to the other end.

An upper-limit stopper 121 is provided to the middle portion of the frame FR1. During the key release, the upper-limit stopper 121 is brought into contact with the lower surfaces of the mass member 116*w*1 and the mass member 116*b*1 of the hammer 116*w* and the hammer 116*b* so as to restrict the downward displacement of the back ends of the hammer 116*w* and the hammer 116*b*, thereby restricting the upward displacement of the front ends of the white key 111*w* and the black key 111*b*. Like the lower-limit stopper 120, the upper-limit stopper 121 includes a stopper rail 121*a* and a buffer member 121*b*. Specifically, the stopper rail 121*a* also extends parallel to the arrangement direction of the keys, and the projection amount thereof from the frame FR1 is constant in the lateral direction. The buffer member 121*b* is fixed on the upper surface of the stopper rail 121*a*. Like the buffer member 120*b*, the sectional shape of the buffer member 121*b* is uniform from one end to the other end. The stopper rail 120*a* and the stopper rail 121*a* may continuously extend in the lateral direction, or may discontinuously extend. The stopper rail 120*a* and the stopper rail 121*a* may be formed integral with the top plate 112*a* and the frame FR1 respectively, or may be formed as separate components and assembled to the top plate 112*a* and the frame FR1 respectively.

As described above, the projection 118*w*1 of the hammer support portion 118*w* of the hammer 116*w* for the white key 111*w* to which a higher pitch is assigned is located on a lower position. Therefore, during the key release, the engagement portion Pw11 between the hammer 116*w* and the drive portion 111*w*1 on the high-pitched side is located to be lower than the engagement portion Pw11 between the hammer 116*w* and the drive portion 111*w* on the low-pitched side.

Figure 8:
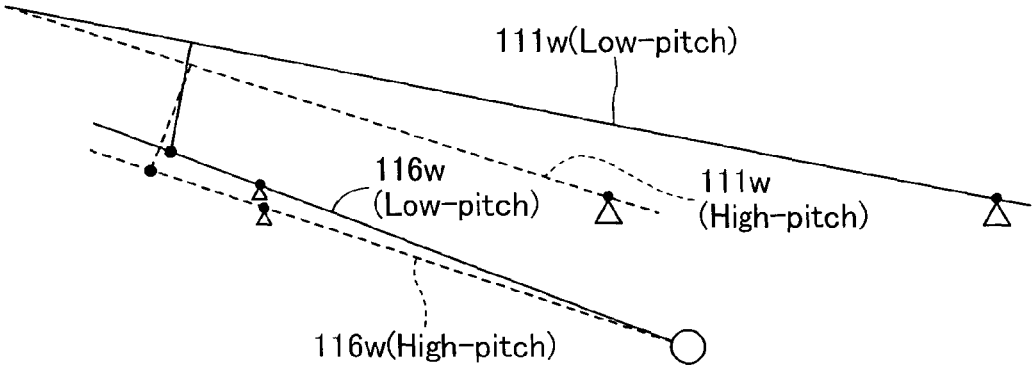
FIG. 8 is a schematic view illustrating a difference in the configuration between the white key on the low-pitched side and the white key on the high-pitched side in FIG. 1.

As described above, the white key 111*w* tilts such that the back end is lower than the front end during the key release. The length of the drive portion 111*w*1 in the vertical direction is the same for all white keys 111*w*. The height of the pivot center is the same for all white keys 111*w*. Accordingly, if the position of the engagement portion Pw11 in the vertical direction is the same during the key release, the front end of the white key 111*w* having the shorter length in the longitudinal direction might become high. In view of this, in the present embodiment, the projection 118*w*1 of the hammer support portion 118*w* of the hammer 116*w* for the white key 111*w* to which a higher pitch is assigned is located on a lower position. With this structure, the engagement portion Pw11 of the white key 111*w* on the high-pitched side is located to be lower than the engagement portion Pw11 of the white key 111*w* on the low-pitched side, whereby the height of the front ends of all white keys 111*w* is adjusted to be the same (see FIG. 8). Specifically, the position of the projection 118*w*1 in the vertical direction is set according to the length of the white key 111*w* in order to adjust the height of the front ends of all white keys 111*w* during the key release to be the same.

As described above, the projection 118*b*1 of the hammer support portion 118*b* of the hammer 116*b* for the black key 111*b* to which a higher pitch is assigned is located on a higher position. Therefore, during the key release, the engagement portion Pb11 between the hammer 116*b* and the drive portion 111*b*1 on the high-pitched side is located to be higher than the engagement portion Pb11 between the hammer 116*b* and the drive portion 111*b* on the low-pitched side.

Figure 9:
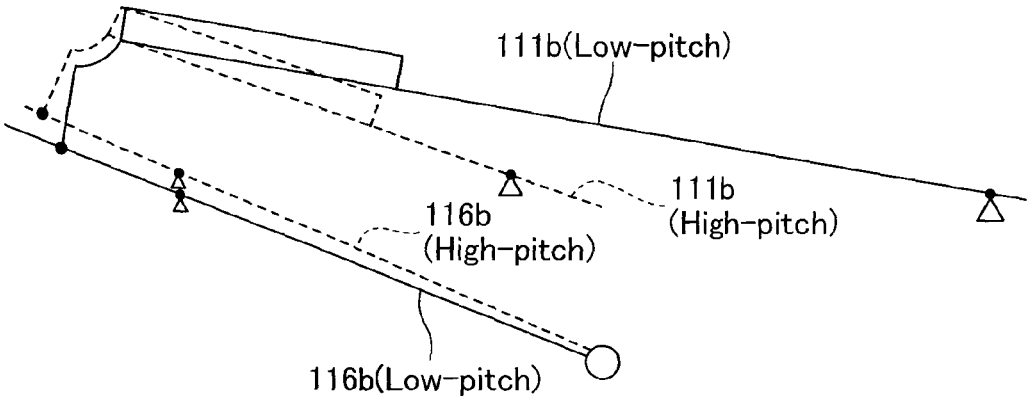
FIG. 9 is a schematic view illustrating a difference in the configuration between the black key on the low-pitched side and the black key on the high-pitched side in FIG. 1.

As described above, the black key 111*b* tilts such that the back end is lower than the front end during the key release. The length of the drive portion 111*b*1 in the vertical direction is the same for all black keys 111*b*. The height of the pivot center is the same for all black keys 111*b*. Accordingly, if the position of the engagement portion Pb11 in the vertical direction is the same during the key release, the front end of the black key 111*b* having the shorter length in the longitudinal direction might become low. In view of this, in the present embodiment, the projection 118*b*1 of the hammer support portion 118*b* of the hammer 116*b* for the black key 111*b* to which a higher pitch is assigned is located on a higher position. With this structure, the engagement portion Pb11 of the black key 111*b* on the high-pitched side is located to be higher than the engagement portion Pb11 of the black key 111*b* on the low-pitched side, whereby the height of the front ends of all black keys 111*b* is adjusted to be the same (see FIG. 9). Specifically, the position of the projection 118*b*1 in the vertical direction is set according to the length of the black key 111*b* in order to adjust the height of the front ends of all black keys 111*b* during the key release to be the same.

In a state in which two adjacent white keys 111*w* and the black key 111*b* between the two adjacent white keys 111*w* are released, the rocking angle of each hammer is set such that the edge line R1 of the black key 111*b* is located below the top face of one on the low-pitched side of the two white keys 111*w*, and above the top face of one on the high-pitched side of the two white keys 111*w*.

The rocking angle of each hammer is set such that, in the state in which the white key 111*w* and the black key 111*b* adjacent to the white key 111*w* are depressed respectively by the same depression force, and their rocking movement is restricted, the edge line R1 of the black key 111*b* is located below the top face of the white key 111*w*. The buffer member 120*b* and the buffer member 121*b* have elasticity. Therefore, when the key is depressed more after the hammer is brought into the buffer member during the key depression, the buffer member is elastically deformed, so that the front end of the key slightly displaces downward.

A switch drive portion AC11 is provided on the lower surface of each of the white key 111*w* and the black key 111*b* on the middle part. The switch drive portion AC11 is a plate-like member extending in the vertical direction in each of the white key 111*w* and the black key 111*b*, and the lower end surface of the switch drive portion AC11 is brought into contact with the upper surface of a switch SW11. The switch SW11 is provided for each key. The switch SW11 is pressed by the corresponding key to detect whether the corresponding key is depressed or released. Specifically, when the switch SW11 is depressed by the key, a rubber main body is deformed to make two contacts, which are formed on a circuit board 123, short-circuit, thereby being turned ON. The circuit board 123 extends in the lateral direction. Through-holes penetrating from the upper surface to the lower surface are formed on the circuit board 123. The through-holes correspond to a bosses 124 formed integral with the upper surface of the top plate 112*a*. When screws are threaded to the bosses 124 through the through-holes, the circuit board 123 is fixed to the key frame 112. The main bodies of the plural switches SW11, each corresponding to each key, are arranged on the upper surface of the circuit board 123 in the lateral direction. The position of the switch SW11 for the white key 111*w* and the position of the switch SW11 for the black key 111*b* in the longitudinal direction are the same. A distance Lw13 from the front end of the white key 111*w* to the switch SW11 in the longitudinal direction is within 30% of the distance Lw12 from the front end of the white key 111*w* with the highest pitch to the through-hole Kw1, and a distance Lb13 from the front end of the apparent portion of the black key 111*b* to the switch SW11 is within 30% of the distance Lb12 from the front end of the apparent portion of the black key 111*b* with the highest pitch to the through-hole Kb1. The switch SW11 for the white key 111*w* and the switch SW11 for the black key 111*b* may be arranged side by side in the lateral direction, and the positions of both switches in the longitudinal direction may be shifted.

A key guide 125*w* for guiding the rocking movement of the white key 111*w* is formed to project upward from the top end surface of the front plate 112*d*. The key guide 125*w* is inserted into the white key 111*w* from below, and during the key depression and key release, the side face of the key guide 125*w* and the inside face of the sidewall of the white key 111*w* are in sliding contact with each other. This structure can prevent a slight displacement of the white key 111*w* in the lateral direction during the key depression and key release.

A key guide 125*b* for guiding the rocking movement of the black key 111*b* is formed to project upward from the upper surface of the top plate 112*a* at the front end. The key guide 125*b* is inserted into the black key 111*b* from below, and during the key depression and key release, the side face of the key guide 125*b* and the inside face of the sidewall of the black key 111*b* are in sliding contact with each other. This structure can prevent a slight displacement of the black key 111*b* in the lateral direction during the key depression and key release.

In the keyboard device having the configuration described above, the height of the front ends of the keys during the key release is adjusted to be the same, whereby the appearance of the key board device can be made similar to the appearance of the keyboard device for an acoustic piano during the key release. In addition, the keyboard device according to the present embodiment has high productivity, compared to the keyboard device for an acoustic piano in which the height of the front ends of the keys is adjusted to be the same by adjusting the number or the thickness of spacer, which is sandwiched between the key support portion and the frame.

The distance from the top face of the apparent portion of the white key 111*w* to the pivot center is the same for all white keys 111*w*, and the distance from the top face of the body of the black key 111*b* to the pivot center is the same for all black keys 111*b*. Accordingly, when the through-holes Kw1 and Kb1 are formed in a different process after a process of molding the outer shape of the white key 111*w* and the black key 111*b*, the different process can commonly be carried out for all keys to enhance productivity of the keys. The positions of the projections 113*w*1 and 113*b*1 of the key support portions 113*w* and 113*b* in the vertical direction are set to be the same for all key support portions 113*w* and 113*b*, resulting in that the frame 112 that supports the keys is easily designed. In addition, the frame 112 is easily processed, and the precision can be enhanced.

In the embodiment described above, the white key 111*w* and the black key 111*b* are supported by the key support portions 113*w* and 113*b* of the key frame 112 by fitting the projections 113*w*1 and 113*b*1 to the through-holes Kw1 and Kb1 respectively so that the front ends of the white key 111*w* and the black key 111*b* can rock in the vertical direction. However, the white key 111*w* and the black key 111*b* can be mounted on the key frame 112 by using various supporting mechanisms, if the white key 111*w* and the black key 111*b* are supported by the key frame 112 so that the front ends of the white key 111*w* and the black key 111*b* can rock in vertical direction. For example, the rear ends of plural keys (the white key 111*w* and/or the black key 111*b*) may be are supported by the key frame 112 through elastic deformation members so that the front ends of the plural keys can rock in vertical direction. Concretely, the rear ends of the plural keys are connected to a fixing member fixed to the key frame 112 through thin and elastic connection members, wherein the fixing member is extended in the lateral direction, the connection members are extended horizontally or vertically, and the plural keys, the connection members and the fixing member are formed integrally. In this case, for example, the connection members for the white keys 111*w* are extended horizontally, and the connection members for the black keys 111*b* are extended vertically.

Subsequently, a second embodiment of the present invention will be described below with reference to the drawings. In the description below, a side close to a performer is defined as a "front side", while a side far from the performer is defined as a "rear side". A high-pitched side is defined as a "right side", while a low-pitched side is defined as a "left side".

Figure 10:
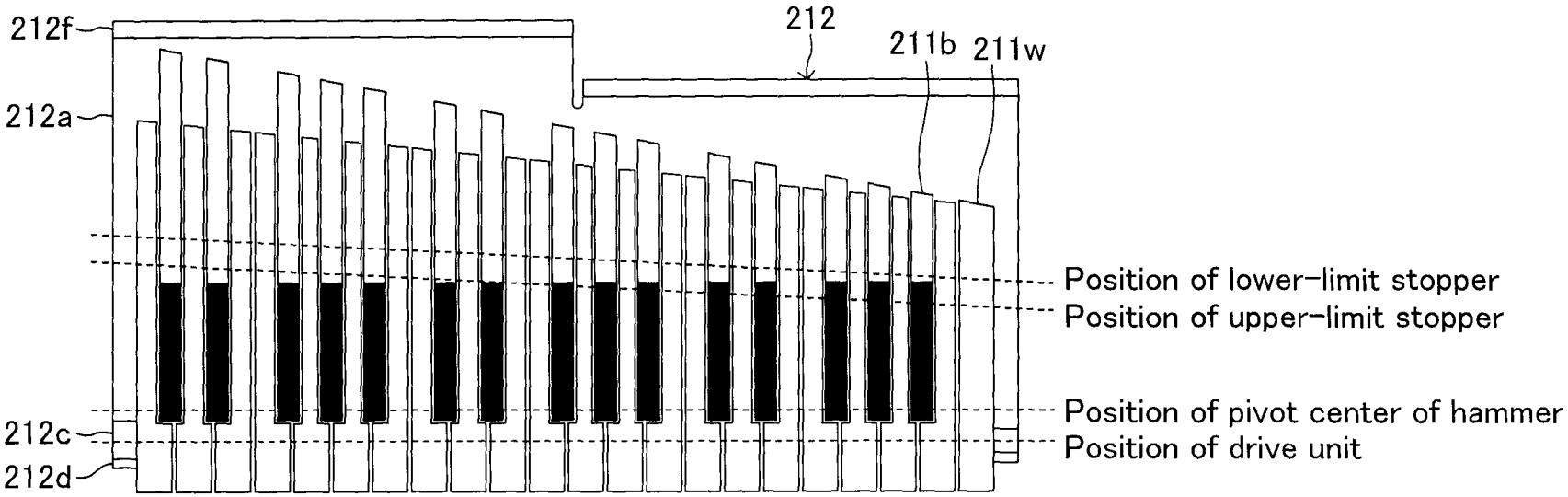
FIG. 10 is a plan view illustrating a keyboard device according to a second embodiment of the present invention.
Figure 11:
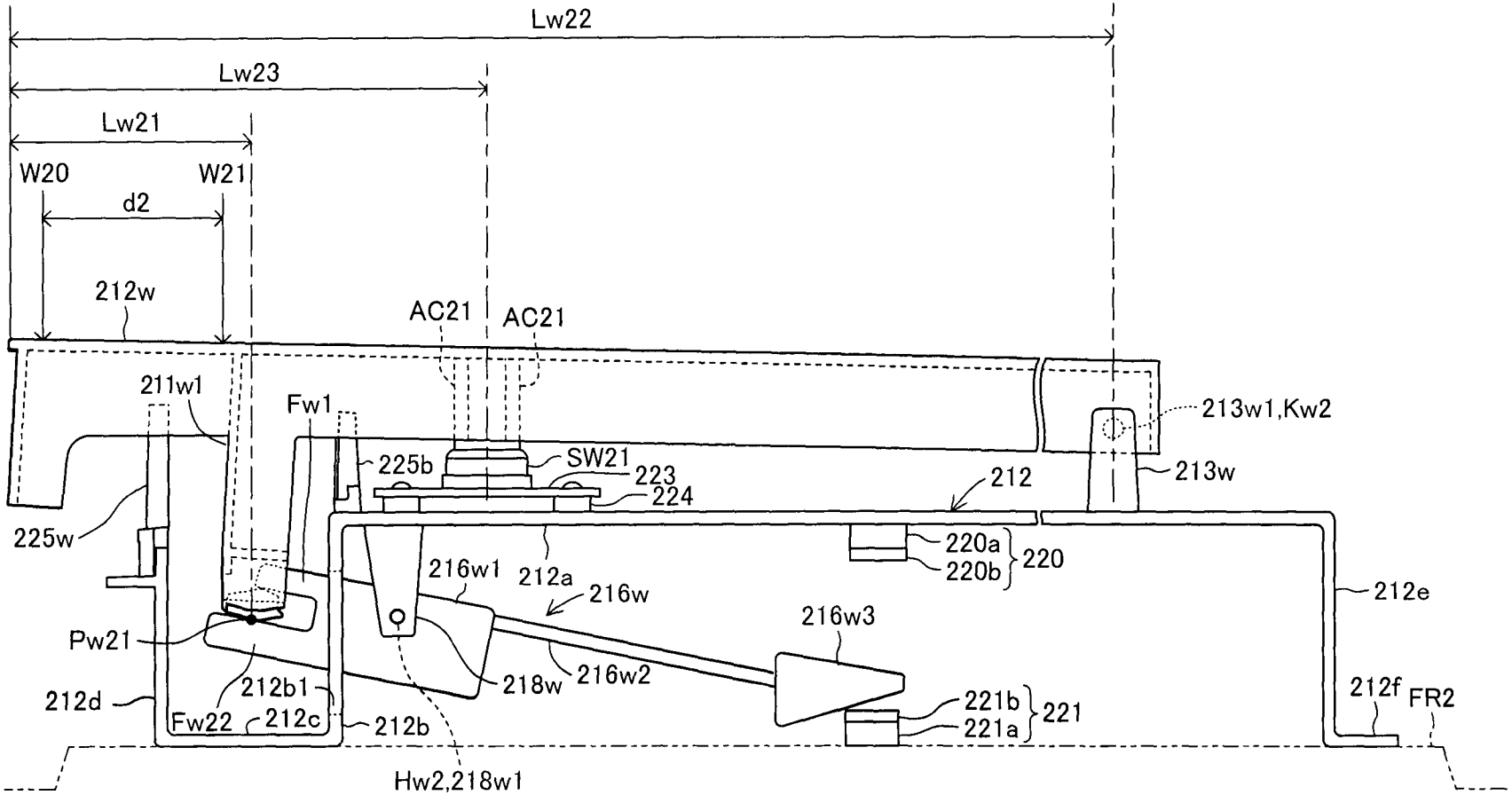
FIG. 11 is a right side view illustrating a configuration of a white key on a low-pitched side in the keyboard device illustrated in FIG. 10.

A keyboard device includes plural white keys 211*w* and plural black keys 211*b* as illustrated in FIG. 10. A different pitch is assigned to each of plural white keys 211*w* and each of plural black keys 211*b*. In the present embodiment, one of "C3", "D3", . . . "C6" is assigned to the white keys 211*w*, while one of "C#3", "D#3", "B#5" is assigned to the black keys 211*b*. The white keys 211*w* and black keys 211*b* are integrally formed to have a long shape by a synthetic resin. The white keys 211*w* are configured such that the length thereof is gradually shorter toward the white key 211*w* on the high-pitched side from the white key 211*w* on the low-pitched side. The black keys 211*b* are configured such that the length thereof is gradually shorter toward the black key 211*b* on the high-pitched side from the black key 211*b* on the low-pitched side. The back end of the black key 211*b* is located posterior to the back end of the adjacent white key 211*w*.

The white keys 211*w*, each having a different assigned pitch, have different length in the longitudinal direction, but the other structures are the same. The black keys 211*b*, each having a different assigned pitch, have different length in the longitudinal direction, but the other structures are the same. Each of the white keys 211*w* has a width in the vertical direction smaller than that of the black key 211*b*, and has a width in the lateral direction larger than that of the black key 211*b*, as illustrated in FIGS. 11 to 14. The white key 211*w* and the black key 211*b* have a hollow shape including a thin top wall extending in the longitudinal direction, and thin sidewalls extending downward from left and right ends of the top wall respectively, with no bottom.

Through-holes Kw2 and Kb2 that are opposite to each other are formed on the rear part of the sidewall of the white key 211*w* and the black key 211*b*. The distance from the through-holes Kw2 and Kb2 to the back end of each key is the same for all keys. The white key 211*w* and the black key 211*b* are supported by a key support portion 213*w* and a key support portion 213*b* of a later-described key frame 212 with the through-holes Kw2 and Kb2. In the key release state, the white key 211*w* and the black key 211 tilt such that the back end becomes lower than the front end. The back end of the white key 211*w* goes into a casing of the electronic musical instrument, when the keyboard device is assembled to the electronic musical instrument. The portion of the white key anterior to the portion going into the casing is referred to as an apparent portion of the white key 211*w*. An edge line is formed on the portion where the side face and the top face of the white key 211*w* cross each other. The black key 211*b* has a portion projecting upward from the top face of the white key 211*w* in a state in which the black key 211*b* is not depressed, and the adjacent white keys 211*w* are not depressed. The projecting portion is referred to as an apparent portion of the black key 211*b*. The portion lower than the apparent portion of the black key 211*b* is referred to as a body. A performer depresses or releases the apparent portions of the white key 211*w* and the black key 211*b*. Specifically, the apparent portion corresponds to an operation portion in the present invention. The width of the apparent portion of the black key 211*b* in the lateral direction becomes narrower toward the top end, and the width of the body in the lateral direction is the same. Specifically, the side face of the apparent portion tilts inward with respect to the side face of the body. An edge line R2 is formed on the boundary between the apparent portion of the black key 211*b* and the body (see FIGS. 13 and 14).

The key frame 212 has a top plate 212*a* extending in the longitudinal direction and lateral direction. The position of the front end of the top plate 212*a* at the low-pitched side and the position of the front end at the high-pitched side are the same, but the back end at the low-pitched side is located posterior to the back end at the high-pitched side. The key frame 212 also has a front plate 212*b* vertically extending downward from the front end of the top plate 212*a*, a bottom plate 212*c* horizontally extending from the lower end of the front plate 212*b*, and a front plate 212*d* vertically extending upward from the front end of the bottom plate 212*c*. The key frame 212 also includes a rear plate 212*e* vertically extending downward from the back end of the top plate 212*a*, and a bottom plate 212*f* horizontally extending rearward from the lower end of the rear plate 212*e*. The height of the lower surface of the bottom plate 212*c* and the height of the lower surface of the bottom plate 212*f* are the same. The keyboard device is supported by a frame FR2 of an electronic musical instrument by the structure in which the lower surface of the bottom plate 212*c* and the lower surface of the bottom plate 212*f* are brought into contact with the frame FR2 of the electronic musical instrument and fixed thereto. The above-described key support portion 213*w* and the key support portion 213*b* are formed to project upward from the upper surface of the top plate 212*a*. The key support portion 213*b* is located posterior to the adjacent key support portion 213*w*. The key support portion 213*w* and the key support portion 213*b* respectively include two opposing plates, and a projection 213*w*1 and projection 213*b*1 that project inward. The projections 213*w*1 and 213*b*1 are fitted to the through-holes Kw2 and Kb2 respectively. Therefore, the white key 211*w* and the black key 211*b* are supported to be rotatable about the projections 213*w*1 and 213*b*1, and their front ends can rock in the vertical direction with the center axes of the through-holes Kw2 and Kb2 and the projections 213*w*1 and the projections 213*b*1 being defined as a pivot center. The position of the projection 213*w*1 and the position of the projection 213*b*1 in the vertical direction are the same for all key support portions. Specifically, the height of the pivot center is the same for all keys. The distance between the top face of the apparent portion of the white key 211*w* (i.e., the plane including the right and left edge lines of the white key 211*w*) and its pivot center in the vertical direction is the same for all white keys 211*w*. The distance between the top face of the operation portion of the black key 211*b* (i.e., the plane including the right and left edge lines of the black key 211*b*) and its pivot center in the vertical direction is the same for all black keys 211*b*.

A drive portion 211*w*1 extends downward from the middle portion of the apparent portion of the white key 211*w*. The drive portion 211*w*1 has a hollow shape including a thin front wall extending in the vertical direction, and thin sidewalls extending rearward from left and right ends of the front wall, with no rear wall. The lower end of the drive portion 211*w*1 is closed by a lower end wall. The length of the drive portion 211*w*1 in the vertical direction is the same for all white keys 211*w*. On the other hand, the black key 211*b* also has a drive portion 211*b*1 same as the drive portion 211*w*1 of the white key 211*w*. The drive portion 211*b*1 has a connection portion that extends downward from the front end of the apparent portion of the black key 211*b* and that is slightly curved to the front, and a vertical portion projecting downward from the leading end of the connection portion. The configuration of the vertical portion is the same for the drive portion 211*w*1. The length of the drive portion 211*b*1 in the vertical direction is the same for all black keys 211*b*.

A distance Lw21 from the front end of the white key 211*w* to the drive portion 211*w*1 in the longitudinal direction is within 30% of a distance Lw22 from the front end of the white key 211*w* with the highest pitch (i.e., the shortest key of the plural white keys 211*w*) to the through-hole Kw2. The distance Lw21 is the same for all white keys 211*w*. A distance Lb21 from the front end of the apparent portion of the black key 211*b* to the drive portion 211*b*1 in the longitudinal direction is within 30% of a distance Lb22 from the front end of the apparent portion of the black key 211*b* with the highest pitch (e.g., the shortest key of the plural black keys 211*b*) to the through-hole Kb2. The distance Lb21 is the same for all black keys 211*b*. The position of the drive portion 211*w*1 and the position of the drive portion 211*b*1 in the longitudinal direction in the key-released state of the white key 211*w* and the black key 211*b* are the same. Specifically, the drive portions 211*w*1 and the drive portions 211*b*1 are located anterior to the front end of the apparent portion of the black keys 211*b*, and the drive portions 211*w*1 and the drive portions 211*b*1 are arranged in the lateral direction.

The lower ends of the drive portion 211*w*1 and the drive portion 211*b*1 are respectively engaged with front ends of hammers 216*w* and 216*b* in the opening formed between the front plate 212*b* and the front plate 212*d*. As described in detail later, the hammer 216*w* and the hammer 216*b* rock with the rocking movement of the corresponding white key 211*w* and the black key 211*b* with which the respective hammers 216*w* and 216*b* are engaged.

The hammer 216*w* includes a base 216*w*1 made of synthetic resin, a connection rod 216*w*2 made of metal, and a mass member 216*w*3. Like the hammer 216*w*, the hammer 216*b* includes a base 216*b*1, a connection rod 216*b*2, and a mass member 216*b*3. The base 216*w*1 and the base 216*b*1 are plate-like members, and formed with through-holes Hw2 and Hb2, respectively, from the right side face to the left side face. A hammer support portion 218*w* and a hammer support portion 218*b* are formed to project downward from the lower surface of the top plate 212*a*. The hammer support portions 218*w* and 218*b* are formed to have two opposing plates, and respectively have projections 218*w*1 and 218*b*1 projecting inward. The projections 218*w*1 and 218*b*1 are respectively fitted to the through-holes Hw2 and Hb2. With this structure, the bases 216*w*1 and 216*b*1 are supported to be rotatable about the projections 218*w*1 and 218*b*1. Specifically, the hammer 216*w* and the hammer 216*b* are supported such that the front ends and the back ends can be rocked in the vertical direction. The positions of the hammer support portion 218*w* and the hammer support portion 218*b* in the longitudinal direction and in the vertical direction are the same for all hammer support portions 218*w* and 218*b*. Specifically, plural hammer support portions 218*w* and the plural hammer support portions 218*b* are arranged side by side in the lateral direction, and the positions of the pivot centers of all hammers 216*w* and hammers 216*b* in the longitudinal direction and in the vertical direction are the same for all hammers 216*w* and 216*b*. In other words, the pivot centers of the hammers 216*w* and the hammers 216*b* are located on the same straight line extending in the lateral direction.

The base 216*w*1 includes a pair of leg portion Fw21 and leg portion Fw22 on its front end. The upper leg portion Fw21 is formed to be shorter than the lower leg portion Fw22. Like the base 216*w*1, the base 216*b*1 includes a pair of leg portion Fb21 and leg portion Fb22 on its front end. An elongated slit-like opening 212*b*1 extending in the vertical direction is formed on the front plate 212*b* for each of the hammers 216*w* and 216*b*. The front end of each hammer 216*w* and the front end of each hammer 216*b* project forward of the front plate 212*b* through the opening 212*b*1. The wall of the lower end of the drive portion 211*w*1 enters between the leg portions Fw21 and Fw22, while the wall of the lower end of the drive portion 211*b*1 enters between the leg portions Fb21 and Fb22. Specifically, the leg portions Fw21 and Fb21 enter between the walls of the lower ends of the drive portions 211*w*1 and 211*b*1 and intermediate walls that form gaps with the walls of the lower ends in the drive portions 211*w*1 and 211*b*1. A shock absorbing member such as rubber, urethane, or felt is fitted and fixed on the wall of the lower end of each of the drive portions 211*w*1 and 211*b*1. The shock absorbing member attenuates shock caused by the collision between the lower end of the drive portion 211*w*1 and the upper surface of the leg portion Fw22, the collision between the lower end of the drive portion 211*b*1 and the upper surface of the leg portion Fb22, the collision between the lower end of the drive portion 211*w*1 and the lower surface of the leg portion Fw21, and the collision between the lower end of the drive portion 211*b*1 and the lower surface of the leg portion Fb21.

The front end of the connection rod 216*w*2 and the front end of the connection rod 216*b*2 are assembled to the back end of the base 216*w*1 and the back end of the base 216*b*1, respectively. The connection rods 216*w*2 and 216*b*2 extend rearward. The position of the back end of the connection rod 216*w*2 and the position of the back end of the connection rod 216*b*2 in the longitudinal direction are the same. The mass member 216*w*3 and the mass member 216*b*3, described later, are assembled to the back end of the connection rod 216*w*2 and the back end of the connection rod 216*b*2, respectively. The mass member 216*w*3 and the mass member 216*b*3 correspond to a contact portion of the present invention, and the lower surface of the mass member 216*w*3 and the lower surface of the mass member 216*b*3 correspond to a contact surface of the present invention.

The mass member 216*w*3 and the mass member 216*b*3 are formed to have a plate-like shape. The mass member 216*w*3 and the mass member 216*b*3 are long in the longitudinal direction. The mass member 216*w*3 and the mass member 216*b*3 are assembled to the connection rods 216*w*2 and 216*b*2 in such a manner that the thickness thereof is along the lateral direction. In the key release state, the lower surface of the mass member 216*w*3 tilts with respect to the top surface of the frame FR2, and the back side of the lower surface of the mass member 216*w*3 is located to be higher than the front side. In the key release state, the lower surface of the mass member 216*b*3 tilts with respect to the top surface of the frame FR2, and the back side of the lower surface of the mass member 216*b*3 is located to be lower than the front side. In the key depression state, the top surfaces of the mass member 216*w*3 and the mass member 216*b*3 are parallel to the lower surface of the top plate 212*a* of the key frame 212. The appearance of the mass member 216*w*3 is the same for all hammers 216*w*. The appearance of the mass member 216*b*3 is also the same for all hammers 216*b*.

As described above, the position of the pivot point of the key is different depending upon the assigned pitch. Therefore, the distance from the pivot center of the white key 211*w* to an engagement portion Pw21 where the leg portion Fw22 and the drive portion 211*w*1 are engaged with each other (brought into contact with each other) is different depending upon the assigned pitch. The distance from the pivot center of the black key 211*b* to an engagement portion Pb21 where the leg portion Fb22 and the drive portion 211*b*1 are engaged with each other (brought into contact with each other) is also different depending upon the assigned pitch. A key depression/release operation position W20 of the white key 211*w* that is the front end of the position of the white key 211*w* with the potentiality of being depressed or released is located anterior to the engagement portion Pw21, while a key depression/release operation position B20 of the black key 211*b* that is the front end of the position of the black key 211*b* with the potentiality of being depressed or released is located posterior to the engagement portion Pb21. Therefore, if the masses of the mass members for all hammers are equal, a key touch feeling is heavier on the middle-pitched part than on the low-pitched part, and the key touch feeling is heavier on the high-pitched part than on the middle-pitched part, on the key depression/release operation positions W20 and B20, because of the principle of leverage.

Figure 15:
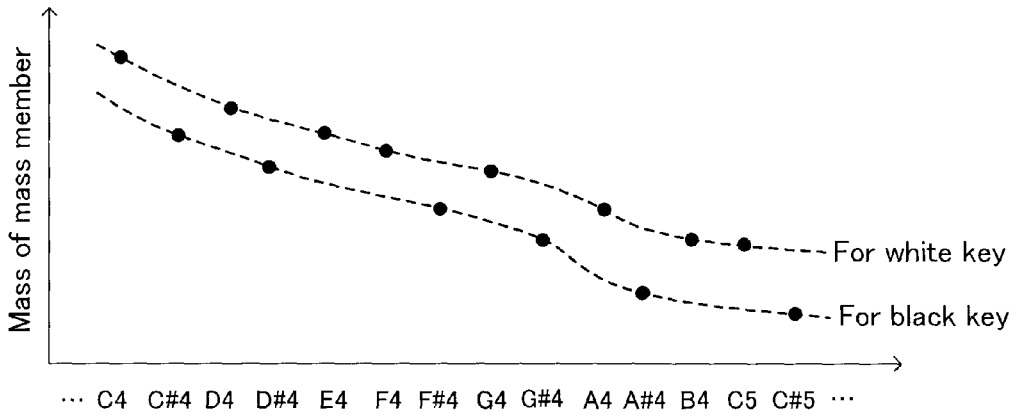
FIG. 15 is a graph of a characteristic curve illustrating a relationship between a pitch and a mass of a mass member.
Figure 16:
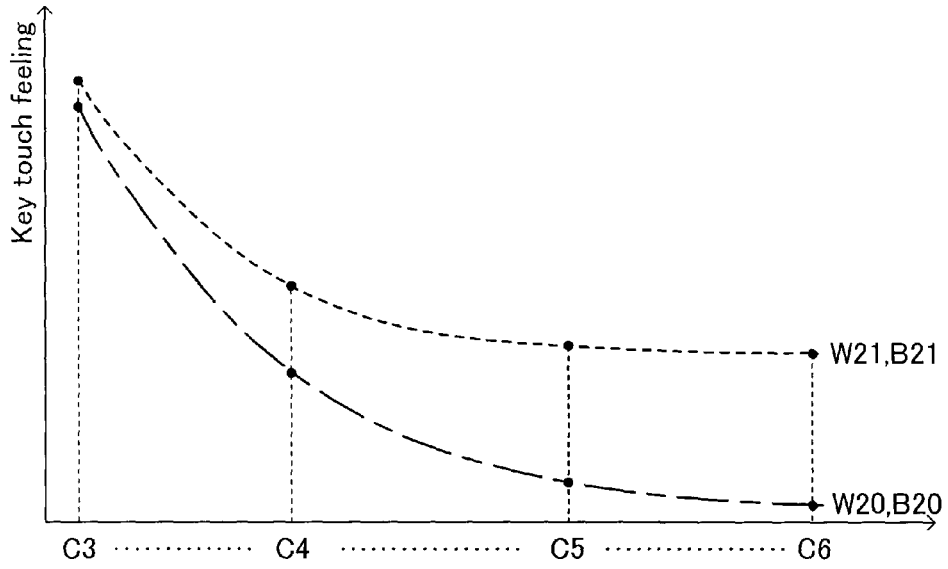
FIG. 16 is a graph of a characteristic curve illustrating a relationship between a pitch and a key touch.

In addition, in this case, the key touch feeling of the white keys 211*w* and the black keys 211*b* in each range is not equal. Specifically, the key touch feeling of the black key 211*b* is heavier than the key touch feeling of the adjacent two white keys 211*w*. In view of this, the mass of the mass member 216*w*3 and the mass of the mass member 216*b*3 are adjusted for each key as illustrated in FIG. 15. Specifically, as illustrated in a characteristic curve indicating the masses of the mass members 216*w*3 and 216*b*3 in the order of pitches, the masses of the mass members 216*w*3 and 216*b*3 are adjusted such that the characteristic curve of the mass member 216*w*3 and the characteristic curve of the mass member 216*b*3 are parallel downward-sloping curves, wherein the characteristic curve of the mass member 216*b*3 is located below the characteristic curve of the mass member 216*w*3. Thus, as illustrated by a chain line in FIG. 16, the key touch feeling on the key depression/release operation positions W20 and B20 becomes gradually lighter toward the high-pitched side from the low-pitched side. Therefore, as illustrated by a broken line in FIG. 16, the key touch feeling on key depression/release operation positions W21 and B21 located posterior to the key depression/release operation positions W20 and B20 by a distance d2 also becomes gradually lighter toward the high-pitched side from the low-pitched side. Since the length of the key to which a higher pitch is assigned is shorter, the difference between the key touch feeling on the key depression/release operation positions W20 and B20 and the key touch feeling on the key depression/release operation positions W21 and B21 becomes larger toward the high-pitched side from the low-pitched side. Specifically, the difference in the key touch feeling caused by the longitudinal difference of the key depression/release operation position is small on the low-pitched side, moderate in the middle-pitched side, and large on the high-pitched side.

When the white key 211*w* and the black key 211*b* are released, the front ends of the hammers 216*w* and 216*b* displace upward due to their own weight of the hammers 216*w* and 216*b*. In this case, the drive portion 211*w*1 and the drive portion 211*b*1 are biased upward by the leg portion Fw22 and the leg portion Fb22 respectively, whereby the front ends of the white key 211*w* and the black key 211*b* displace upward. On the other hand, when the white key 211*w* and the black key 211*b* are depressed, the lower surfaces of the drive portion 211*w*1 and the drive portion 211*b*1 press the upper surfaces of the leg portion Fw22 and the leg portion Fb22 respectively, whereby the front ends of the hammer 216*w* and the hammer 216*b* respectively displace downward.

A lower-limit stopper 220 is provided to the key frame 212. During the key depression, the lower-limit stopper 220 is brought into contact with the upper surfaces of the mass member 216*w*3 and the mass member 216*b*3 of the hammer 216*w* and the hammer 216*b* so as to restrict the upward displacement of the back ends of the hammer 216*w* and the hammer 216*b*, thereby restricting the downward displacement of the front ends of the white key 211*w* and the black key 211*b*. The lower-limit stopper 220 includes a stopper rail 220*a* and a buffer member 220*b*. The stopper rail 220*a* protrudes downward from the lower surface at the middle of the top plate 122*a*. In a planar view of the key frame 212, the stopper rail 220*a* tilts such that the portion on the high-pitched side is located slightly anterior to the portion on the low-pitched side (see FIG. 10). The stopper rail 220*a* may extend parallel to the arrangement direction of the keys. The projection amount of the stopper rail 220*a* from the lower surface of the top plate 212*a* on the contact portion between the stopper rail 220*a* and each hammer is constant in the lateral direction. The buffer member 220*b* is fixed to the lower end surface of the stopper rail 220*a*. The buffer member 220*b* is a long member made of a shock-absorbing member such as rubber or felt. The sectional shape of the buffer member 220*b* is uniform from one end to the other end.

An upper-limit stopper 221 is provided to the middle portion of the frame FR2. During the key release, the upper-limit stopper 221 is brought into contact with the lower surfaces of the mass member 216*w*1 and the mass member 216*b*1 of the hammer 216*w* and the hammer 216*b* so as to restrict the downward displacement of the back ends of the hammer 216*w* and the hammer 216*b*, thereby restricting the upward displacement of the front ends of the white key 211*w* and the black key 211*b*. Like the lower-limit stopper 220, the upper-limit stopper 221 includes a stopper rail 221*a* and a buffer member 221*b*. Specifically, in a planar view of the key frame 212, the stopper rail 220*a* tilts such that the portion on the high-pitched side is located slightly anterior to the portion on the low-pitched side (see FIG. 10). The projection amount thereof from the frame FR2 is constant in the lateral direction. The buffer member 221*b* is fixed on the upper surface of the stopper rail 221*a*. Like the buffer member 220*b*, the sectional shape of the buffer member 221*b* is uniform from one end to the other end. The stopper rail 220*a* and the stopper rail 221*a* may continuously extend in the lateral direction, or may discontinuously extend. The stopper rail 220*a* and the stopper rail 221*a* may be formed integral with the top plate 212*a* and the frame FR2 respectively, or may be formed as separate components and assembled to the top plate 212*a* and the frame FR2 respectively.

Figure 12:
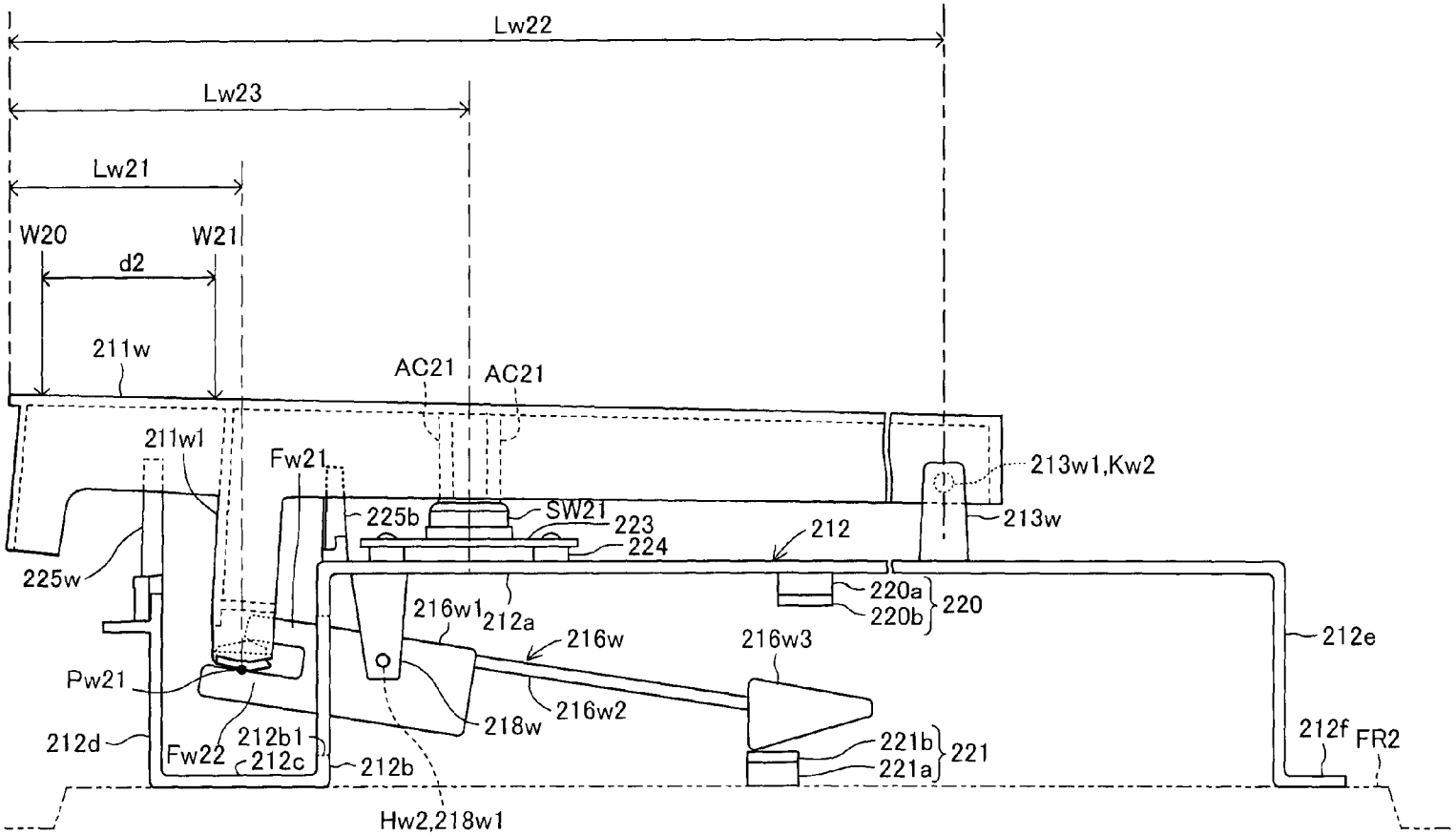
FIG. 12 is a right side view illustrating a configuration of a white key on a high-pitched side in the keyboard device illustrated in FIG. 10.
Figure 13:
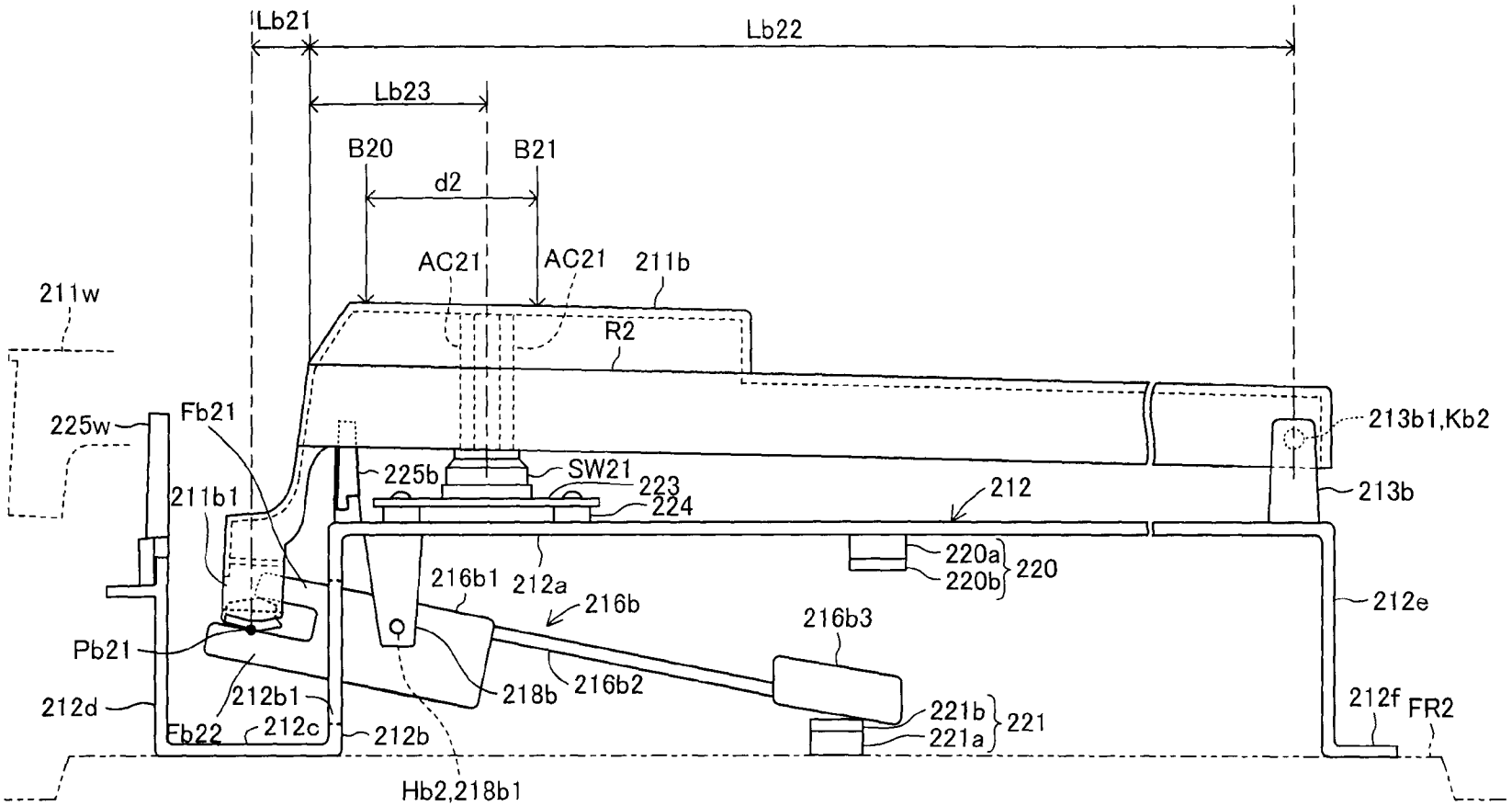
FIG. 13 is a right side view illustrating a configuration of a black key on a low-pitched side in the keyboard device illustrated in FIG. 10.

As described above, the stopper rail 221*a* tilts such that the portion on the low-pitched side is slightly anterior to the portion on the high-pitched side in the planar view of the key frame 212. Therefore, the contact point between the hammer 216*w* on the high-pitched side (FIG. 12) and the upper-limit stopper 221 is located anterior to the contact point between the hammer 216*w* (FIG. 11) located on the lower-pitched side from the hammer on the high-pitched side and the upper-limit stopper 221. In the key release state, the rear side of the lower surface of the mass member 216*w*3 is located to be higher than the front side. Therefore, the back end of the hammer 216*w* on the high-pitched side in FIG. 12 is located on a position higher than the back end of the hammer 216*w* on the low-pitched side in FIG. 11. As described above, the top surface of the mass member 216*w*3 is parallel to the lower surface of the top plate 212*a* in the key depression state. Specifically, the lower surface of the lower-limit stopper 220 and the top surface of the mass member 216*w*3 are parallel to each other in a state in which the mass member 216*w*3 is in contact with the lower surface of the lower-limit stopper 220. Accordingly, in the key depression state, the tilt angle (rocking angle) of the hammer 216*w* is the same for all hammers 216*w*. When the tilt angle of the hammer 216*w* in the key depression state is defined as a reference, the tilt angle of the hammer 216*w* on the high-pitched side is smaller than the tilt angle of the hammer 216*w* on the low-pitched side in the key release state. Accordingly, in the key release state, the engagement portion Pw21 between the hammer 216*w* on the high-pitched side and the drive portion 211*w*1 is located to be lower than the engagement portion Pw21 between the hammer 216*w* on the low-pitched side and the drive portion 211*w*1.

Figure 17:
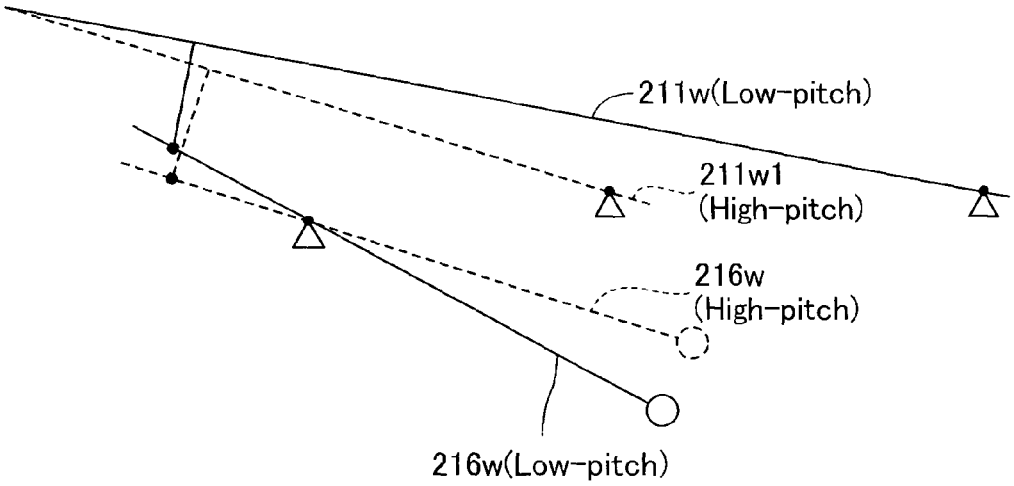
FIG. 17 is a schematic view illustrating a difference in the configuration between the white key on the low-pitched side and the white key on the high-pitched side in FIG. 10.

As described above, the white key 211*w* tilts such that the back end is lower than the front end during the key release. The length of the drive portion 211*w*1 in the vertical direction is the same for all white keys 211*w*. The height of the pivot center is the same for all white keys 211*w*. Accordingly, if the position of the engagement portion Pw21 in the vertical direction is the same during the key release, the front end of the white key 211*w* having the shorter length in the longitudinal direction might become high. In view of this, in the present embodiment, the position of the upper-limit stopper 221 in the longitudinal direction is set according to the length of the white key 211*w* in order to set the tilt angle of each hammer 216*w* in the key release state (see FIG. 17). With this structure, the engagement portion Pw21 of the white key 211*w* on the high-pitched side is located to be lower than the engagement portion Pw21 of the white key 211*w* on the low-pitched side, whereby the height of the front ends of all white keys 211*w* is adjusted to be the same.

Figure 14:
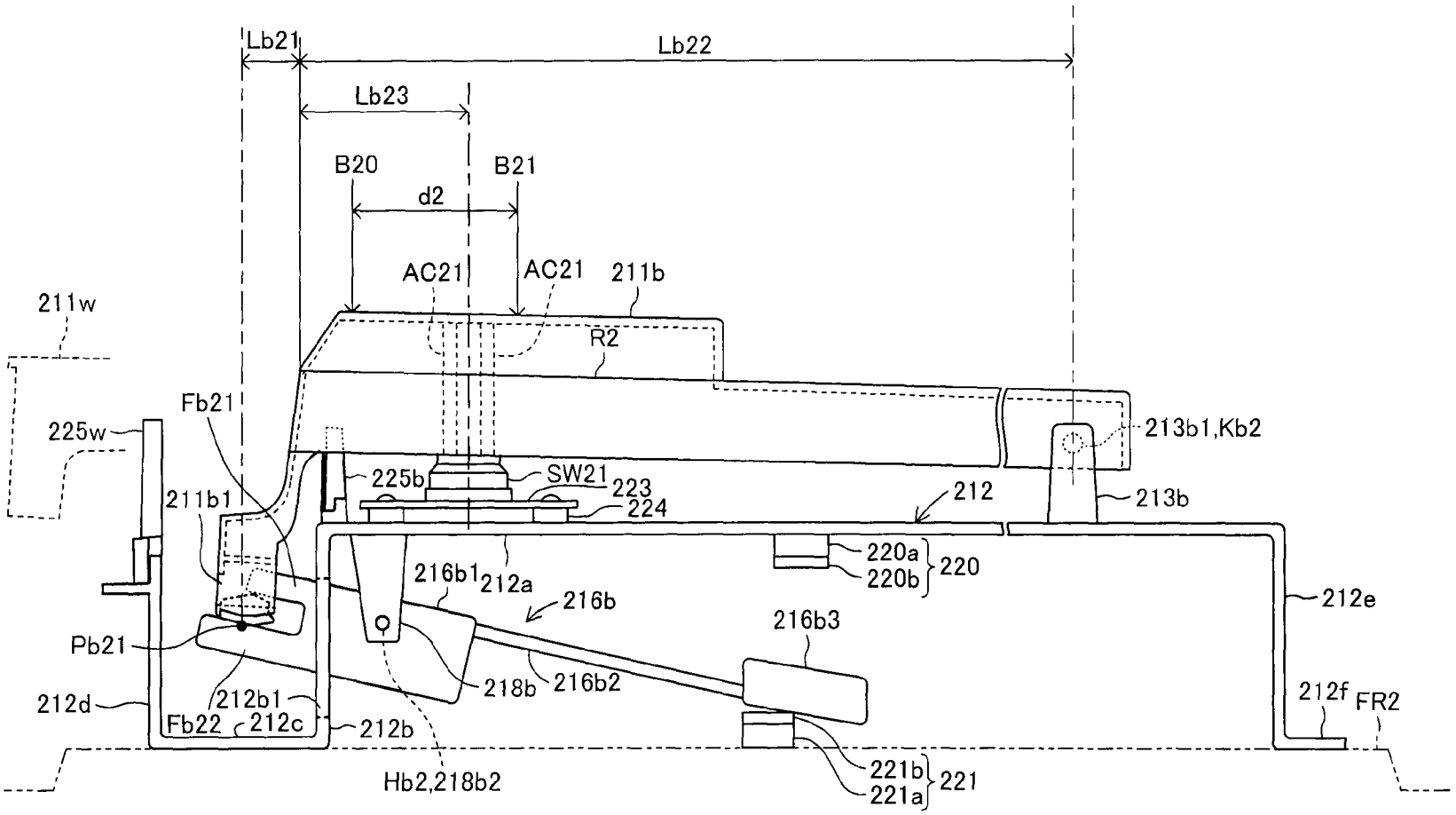
FIG. 14 is a right side view illustrating a configuration of a black key on a high-pitched side in the keyboard device illustrated in FIG. 10.

The contact point between the hammer 216*b* on the high-pitched side (FIG. 14) and the upper-limit stopper 221 is located forward than the contact point between the hammer 216*b* on the low-pitched side from the hammer on the high-pitched side (FIG. 13) and the upper-limit stopper 221. In the key release state, the rear side on the lower surface of the mass member 216*b*3 is located to be lower than the front side. Therefore, the rear end of the hammer 216*b* on the high-pitched side in FIG. 14 is located to be lower than the rear end of the hammer 216*b* on the low-pitched side in FIG. 13. As described above, the top surface of the mass member 216*b*3 is parallel to the lower surface of the top plate 212*a* in the key depression state. Specifically, in the state in which the mass member 216*b*3 is in contact with the lower surface of the lower-limit stopper 220, the lower surface of the lower-limit stopper 220 and the top surface of the mass member 216*b*3 are parallel to each other. Accordingly, in the key depression state, the tilt angle (rocking angle) of the hammer 216*b* is the same for all hammers 216*b*. When the tilt angle of the hammer 216*b* in the key depression state is defined as a reference, the tilt angle of the hammer 216*b* on the high-pitched side is larger than the tilt angle of the hammer 216*b* on the low-pitched side in the key release state. Consequently, in the key release state, the engagement portion Pb21 between the hammer 216*b* on the high-pitched side and the drive portion 211*b*1 is located to be higher than the engagement portion Pb21 between the hammer 216*b* on the high-pitched side and the drive portion 211*b*1.

Figure 18:
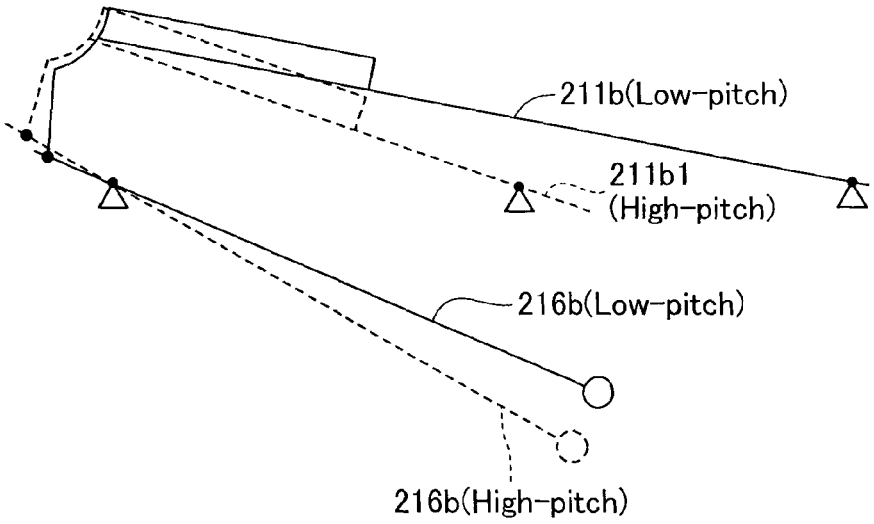
FIG. 18 is a schematic view illustrating a difference in the configuration between the black key on the low-pitched side and the black key on the high-pitched side in FIG. 10.
Figure 19:
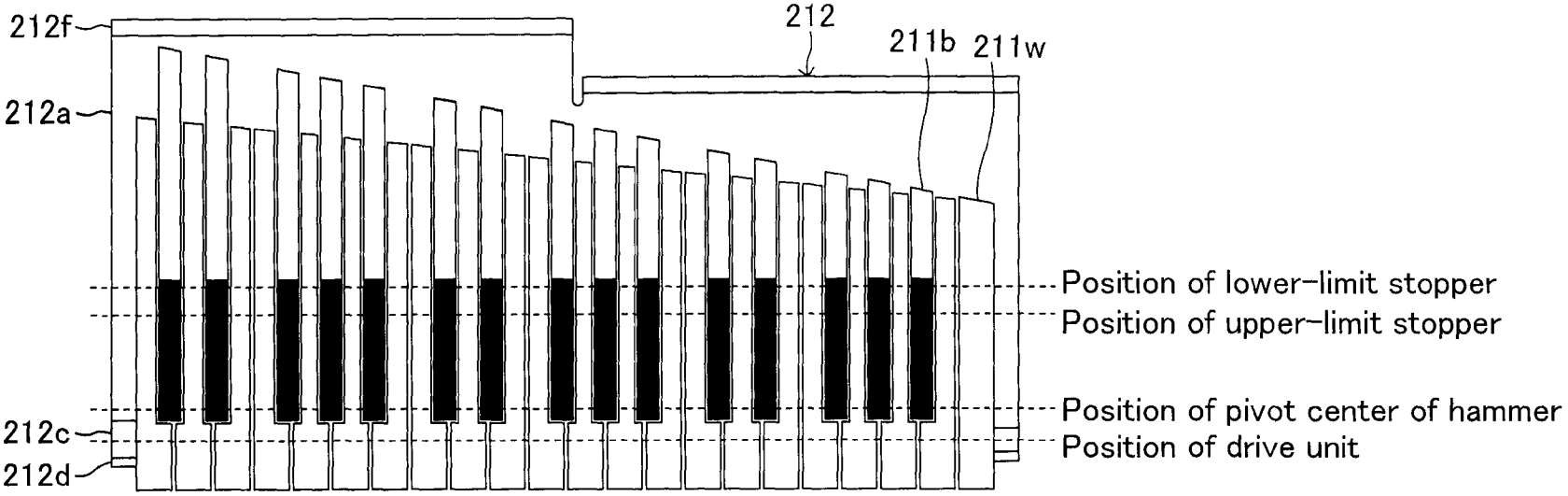
FIG. 19 is a plan view illustrating a keyboard device according to a modification of the present invention.
Figure 20:
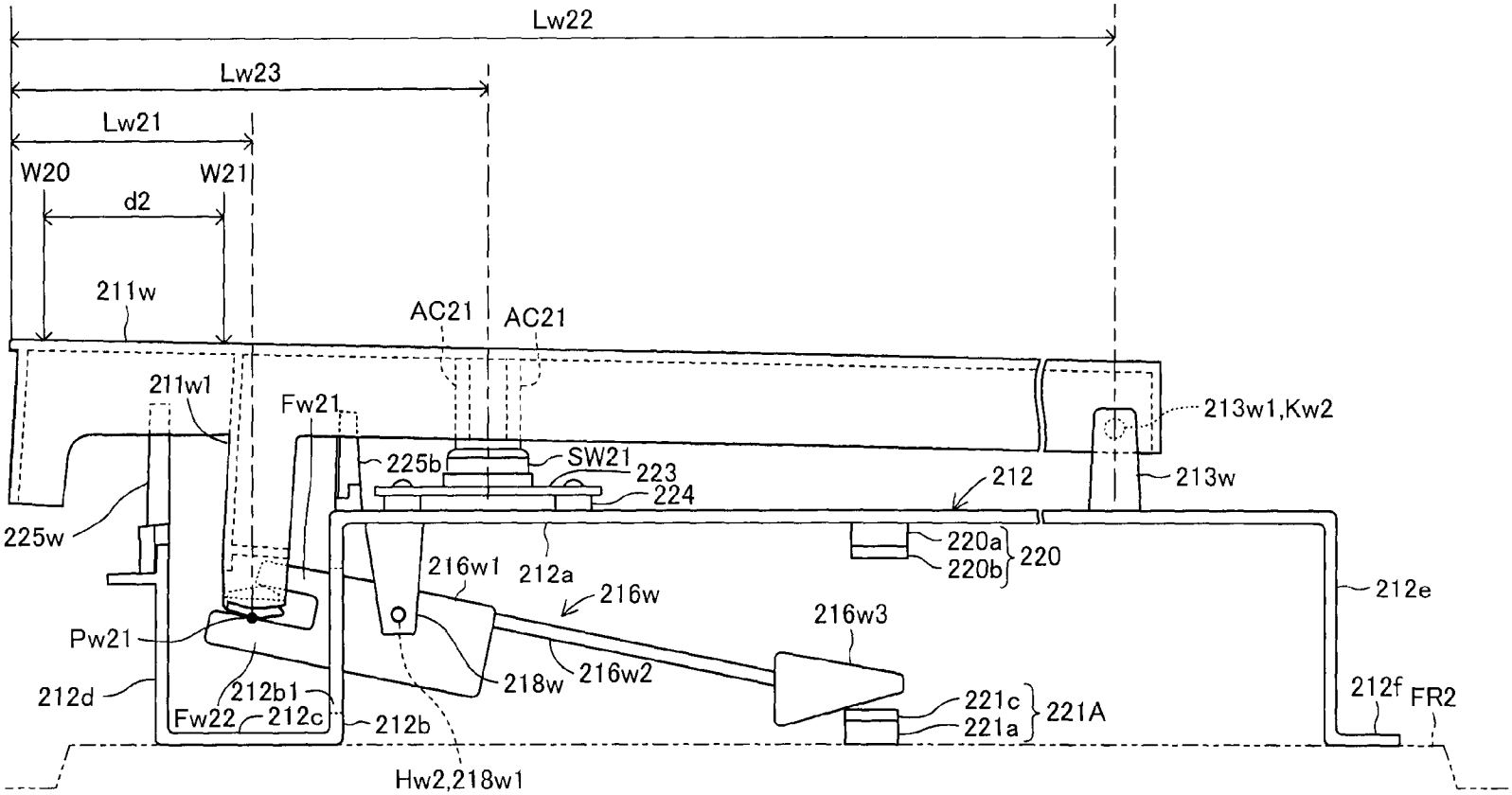
FIG. 20 is a right side view illustrating a configuration of a white key on a low-pitched side in the keyboard device illustrated in FIG. 19.
Figure 21:
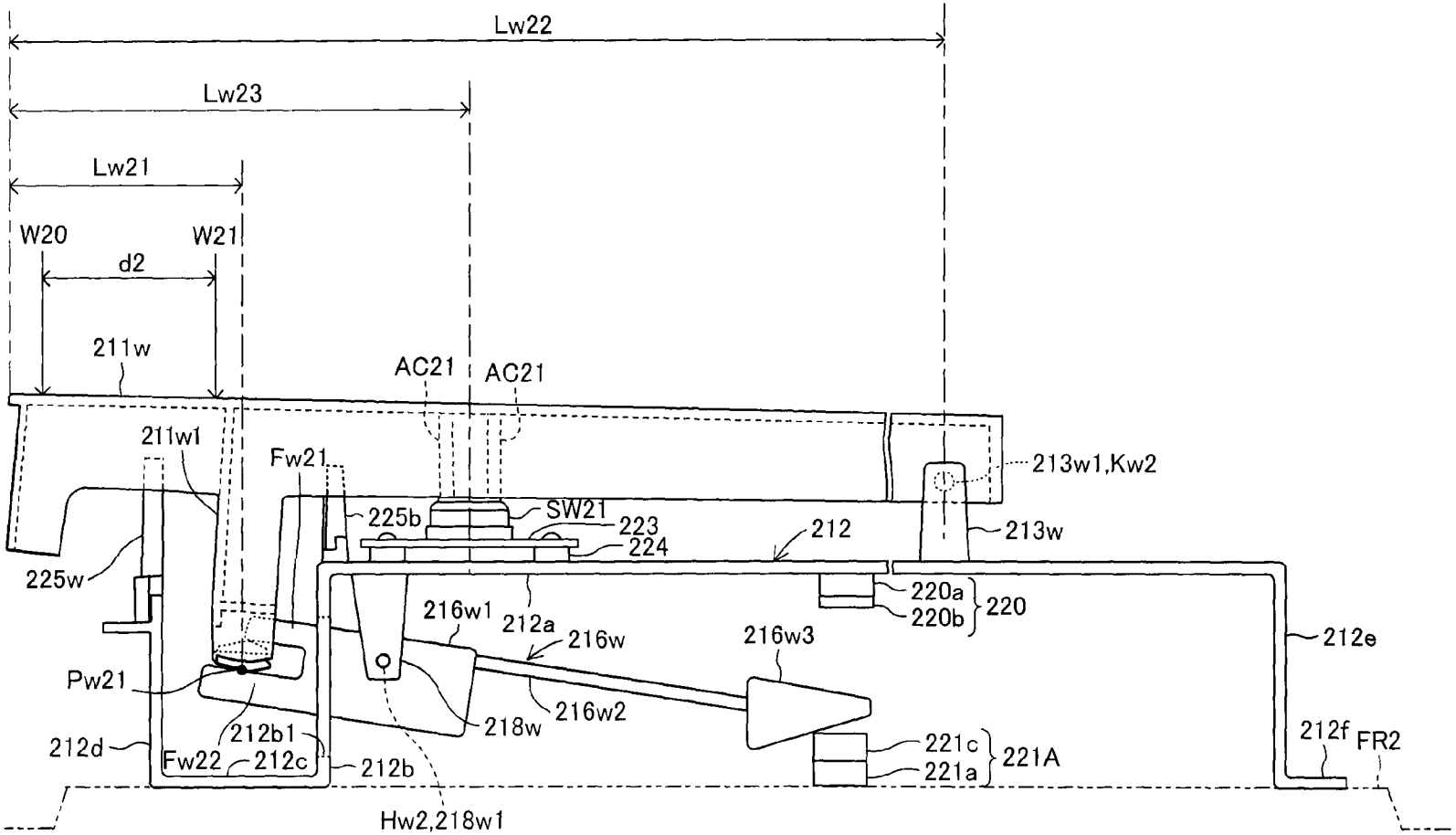
FIG. 21 is a right side view illustrating a configuration of a white key on a high-pitched side in the keyboard device illustrated in FIG. 19.
Figure 22:
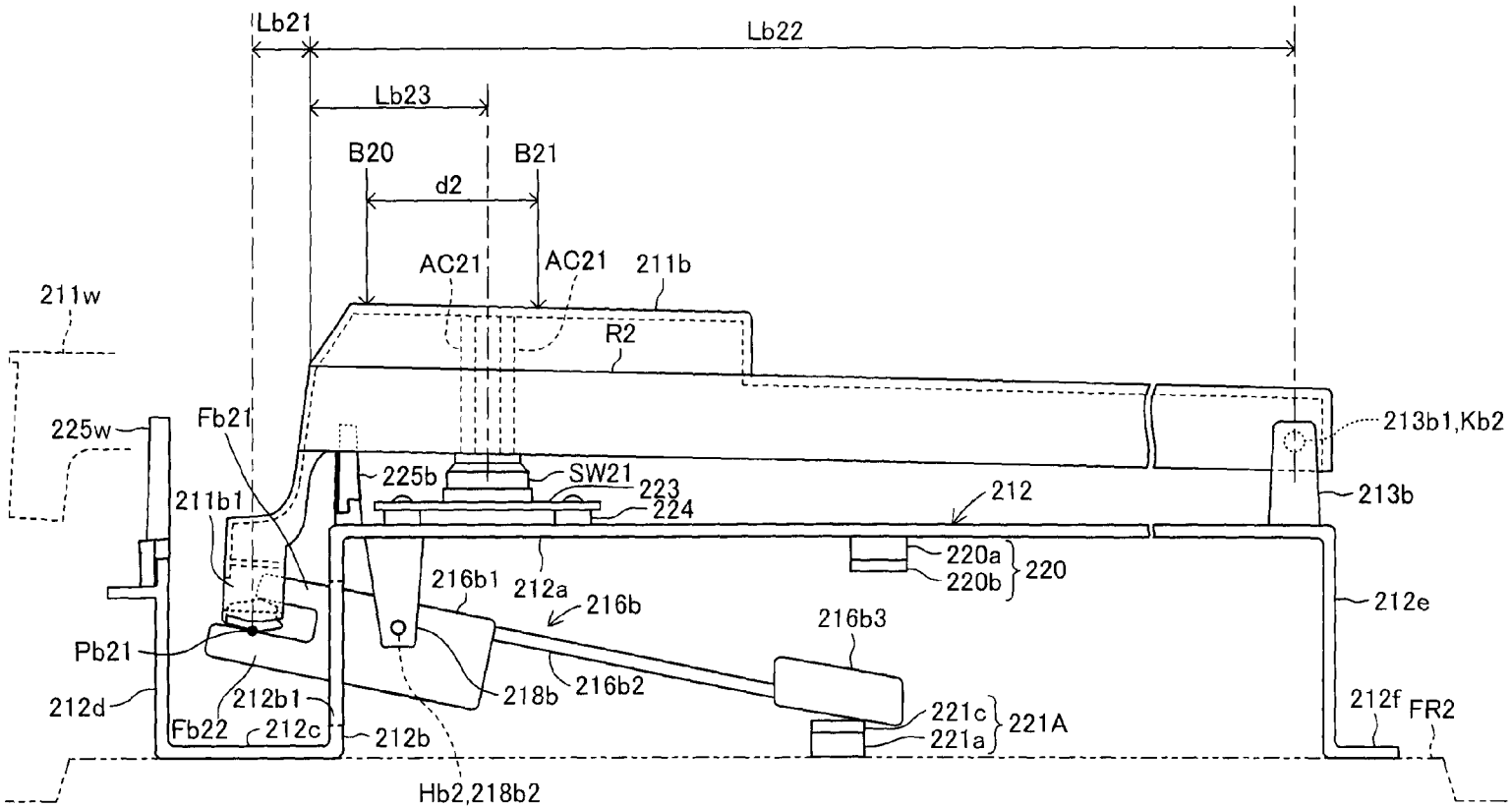
FIG. 22 is a right side view illustrating a configuration of a black key on a low-pitched side in the keyboard device illustrated in FIG. 19.
Figure 23:
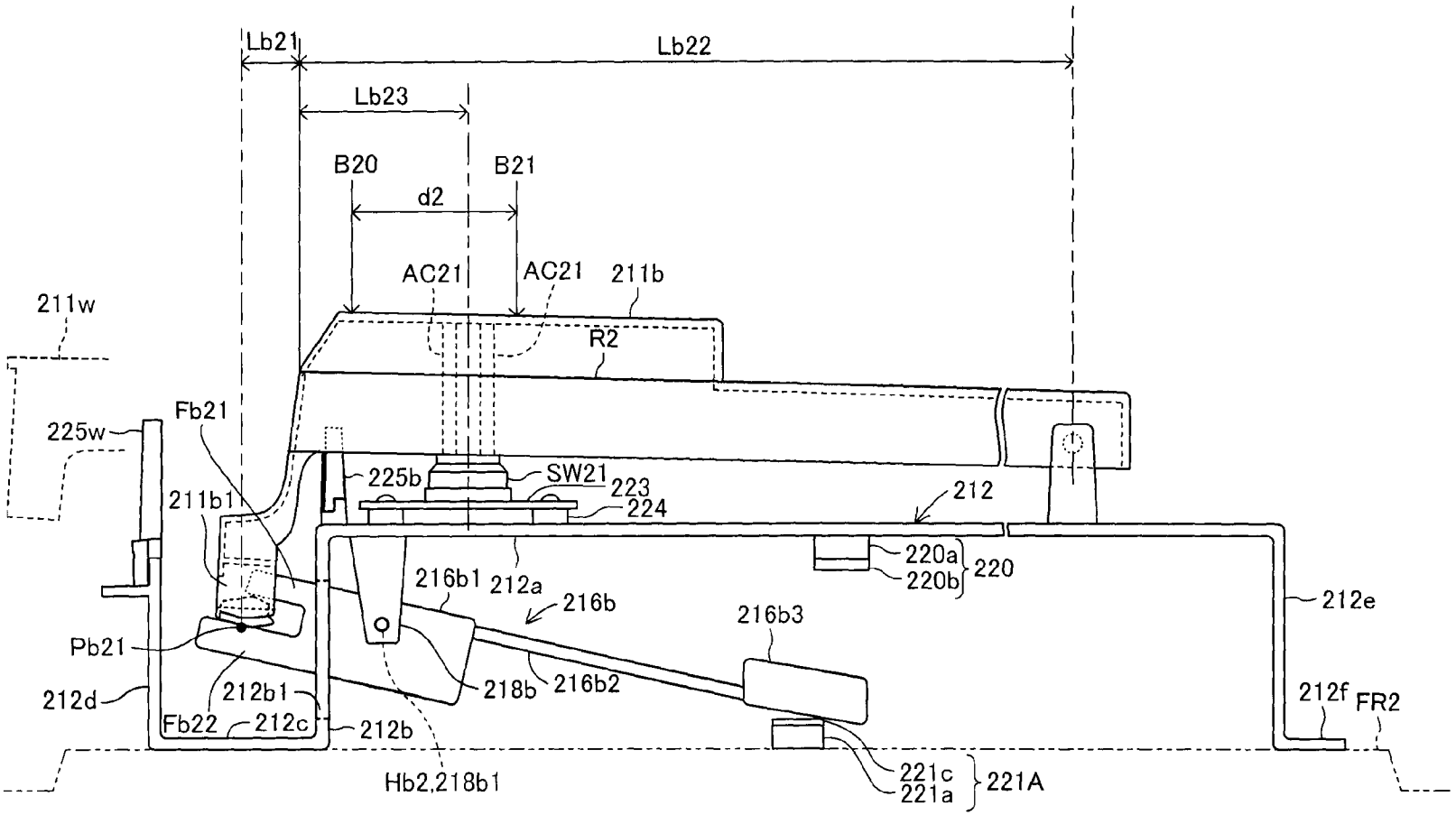
FIG. 23 is a right side view illustrating a configuration of a black key on a high-pitched side in the keyboard device illustrated in FIG. 19.

As described above, the black key 211*b* tilts such that the back end is lower than the front end during the key release. The length of the drive portion 211*b*1 in the vertical direction is the same for all black keys 211*b*. The height of the pivot center is the same for all black keys 211*b*. Accordingly, if the position of the engagement portion Pb21 in the vertical direction is the same during the key release, the front end of the black key 211*b* having the shorter length in the longitudinal direction might become low. In view of this, in the present embodiment, the position of the upper-limit stopper 221 in the longitudinal direction is set according to the length of the black key 211*b* in order to set the tilt angle of each hammer 216*b* in the key release state (see FIG. 18). With this structure, the engagement portion Pb21 of the black key 211*b* on the high-pitched side is located to be higher than the engagement portion Pb21 of the black key 211*b* on the low-pitched side, whereby the height of the front ends of all black keys 211*b* is adjusted to be the same.

In a state in which two adjacent white keys 211*w* and the black key 211*b* between the two adjacent white keys 211*w* are released, the rocking angle of each hammer is set such that the edge line R2 of the black key 211*b* is located below the top face of one on the low-pitched side of the two white keys 211*w*, and above the top face of one on the high-pitched side of the two white keys 211*w*.

The rocking angle of each hammer is set such that, in the state in which the white key 211*w* and the black key 211*b* adjacent to the white key 211*w* are depressed respectively by the same depression force, and their rocking movement is restricted, the edge line R2 of the black key 211*b* is located below the top face of the white key 211*w*. The buffer member 220*b* and the buffer member 221*b* have elasticity. Therefore, when the key is depressed more after the hammer is brought into contact with the buffer member during the key depression, the buffer member is elastically deformed, so that the front end of the key slightly displaces downward.

A switch drive portion AC21 is provided on the lower surface of each of the white key 211*w* and the black key 211*b* on the middle part. The switch drive portion AC21 is a plate-like member extending in the vertical direction in each of the white key 211*w* and the black key 211*b*, and the lower end surface of the switch drive portion AC21 is brought into contact with the upper surface of a switch SW21. The switch SW21 is provided for each key. The switch SW21 is pressed by the corresponding key to detect whether the corresponding key is depressed or released. Specifically, when the switch SW21 is depressed by the key, a rubber main body is deformed to make two contacts, which are formed on a circuit board 223, short-circuit, thereby being turned ON. The circuit board 223 extends in the lateral direction. Through-holes penetrating from the upper surface to the lower surface are formed on the circuit board 223. The through-holes correspond to a bosses 224 formed integral with the upper surface of the top plate 212*a*. When screws are threaded to the bosses 224 through the through-holes, the circuit board 223 is fixed to the key frame 212. The main bodies of the plural switches SW21, each corresponding to each key, are arranged on the upper surface of the circuit board 223 in the lateral direction. The position of the switch SW21 for the white key 211*w* and the position of the switch SW21 for the black key 211*b* in the longitudinal direction are the same. A distance Lw23 from the front end of the white key 211*w* to the switch SW21 in the longitudinal direction is within 30% of the distance Lw22 from the front end of the white key 211*w* with the highest pitch to the through-hole Kw2, and a distance Lb23 from the front end of the apparent portion of the black key 211*b* to the switch SW21 is within 30% of the distance Lb22 from the front end of the apparent portion of the black key 211*b* with the highest pitch to the through-hole Kb2. The switch SW21 for the white key 211*w* and the switch SW21 for the black key 211*b* may be arranged side by side in the lateral direction, and the positions of both switches in the longitudinal direction may be shifted.

A key guide 225*w* for guiding the rocking movement of the white key 211*w* is formed to project upward from the top end surface of the front plate 212*d*. The key guide 225*w* is inserted into the white key 211*w* from below, and during the key depression and key release, the side face of the key guide 125*w* and the inside face of the sidewall of the white key 211*w* are in sliding contact with each other. This structure can prevent a slight displacement of the white key 211*w* in the lateral direction during the key depression and key release.

A key guide 225*b* for guiding the rocking movement of the black key 211*b* is formed to project upward from the upper surface of the top plate 212*a* at the front end. The key guide 225*b* is inserted into the black key 211*b* from below, and during the key depression and key release, the side face of the key guide 225*b* and the inside face of the sidewall of the black key 211*b* are in sliding contact with each other. This structure can prevent a slight displacement of the black key 211*b* in the lateral direction during the key depression and key release.

In the keyboard device having the configuration described above, the height of the front ends of the keys during the key release is adjusted to be the same, whereby the appearance of the key board device can be made similar to the appearance of the keyboard device for an acoustic piano during the key release. In addition, the keyboard device according to the present embodiment has high productivity, compared to the keyboard device for an acoustic piano in which the height of the front ends of the keys is adjusted to be the same by adjusting the number or the thickness of the spacer, which is sandwiched between the key support portion and the frame.

The distance from the top face of the apparent portion of the white key 221*w* to the pivot center is the same for all white keys 221*w*, and the distance from the top face of the body of the black key 221*b* to the pivot center is the same for all black keys 221*b*. Accordingly, when the through-holes Kw2 and Kb2 are formed in a different process after a process of molding the outer shape of the white key 221*w* and the black key 221*b*, the different process can commonly be carried out for all keys to enhance productivity of the keys. The positions of the projections 213*w*1 and 213*b*1 of the key support portions 213*w* and 213*b* in the vertical direction are set to be the same for all key support portions 213*w* and 213*b*, resulting in that the frame 212 that supports the keys is easily designed. In addition, the frame 212 is easily processed, and the precision can be enhanced.

In the planar view, the upper-limit stopper 221 is arranged to tilt, and the tilting direction of the lower surface of the mass member 216*w*3 and the tilting direction of the lower surface of the mass member 216*b*3 are set to be reverse to each other. With this structure, as for the hammers 216*w* for the white keys 211*w*, the tilt angle in the key release state becomes gradually small from the hammer 216*w* on the low-pitched side toward the hammer 216*w* on the high-pitched side. As for the hammers 216*b* for the black keys 211*b*, the tilt angle in the key release state becomes gradually large from the hammer 216*b* on the low-pitched side toward the hammer 216*b* on the high-pitched side. Accordingly, there is no need to provide the upper-limit stopper 221 for each hammer, whereby the number of components can be reduced, and the cost for the keyboard device can be reduced. In addition, the productivity of the keyboard device can be enhanced.

Upon embodying the present invention, the present invention is not limited to the above-described embodiment, and various modifications are possible without departing from the scope of the present invention.

In the present embodiment, the upper-limit stopper 221 tilts such that the portion on the high-pitched side is located to be forward from the portion on the low-pitched side in the planar view of the key frame 212. However, instead of this structure, an upper-limit stopper 221A may extend parallel to the arrangement direction of the keys as illustrated in FIGS. 19 to 23. In this case, a buffer member 221*c* is used instead of the buffer member 221*b*. The thickness of the buffer member 221*c* in the vertical direction is different for each hammer. Specifically, the buffer member 221*c* of the hammer 216*w* for the white key 221*w* (FIG. 20) on the low-pitched side is thin, while the buffer member 221*c* of the hammer 216*w* for the white key 221*w* on the high pitched side is thicker than the low-pitched side. As described above, the tilt angle of each hammer in the key release state may be set by setting the thickness of the buffer member 221*c* according to the length of the white key 221*w*. Even with this structure, the height of the front ends of the white keys 211*w* in the key release state can be adjusted to be the same. The buffer member 221*c* for the black key 211*b* (FIG. 22) on the low-pitched side is thick, while the buffer member 221*c* for the black key 221*b* (FIG. 23) on the high-pitched side is thinner than the low-pitched side. As described above, the tilt angle of each hammer in the key release state may be set by setting the thickness of the buffer member 221*b* according to the length of the black key 221*b*. Even with this structure, the height of the front ends of the black keys 211*b* in the key release state can be adjusted to be the same.

Figure 24:
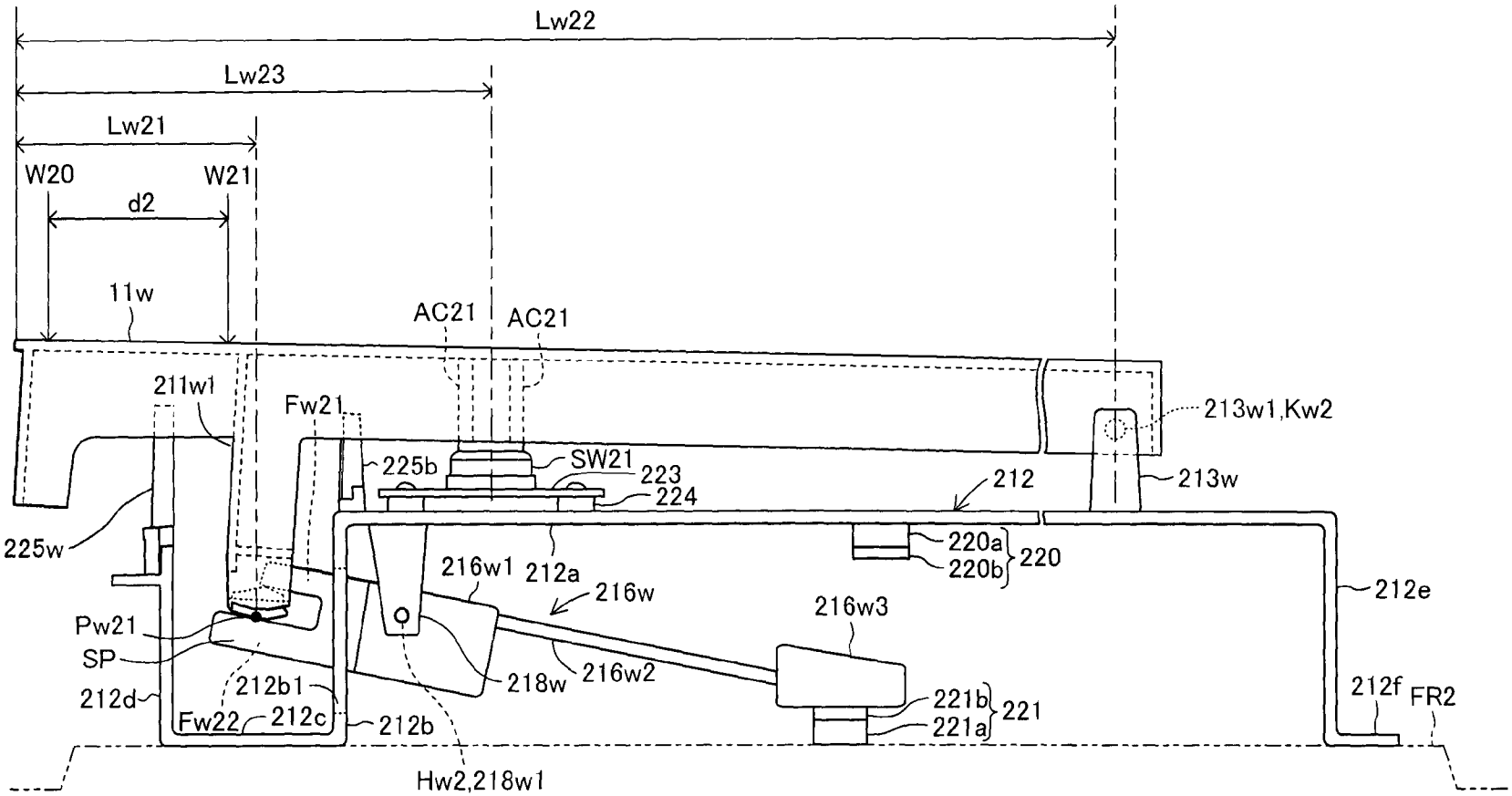
FIG. 24 is a right side view illustrating a configuration of a white key in a keyboard device according to another modification of the present invention.
Figure 25:
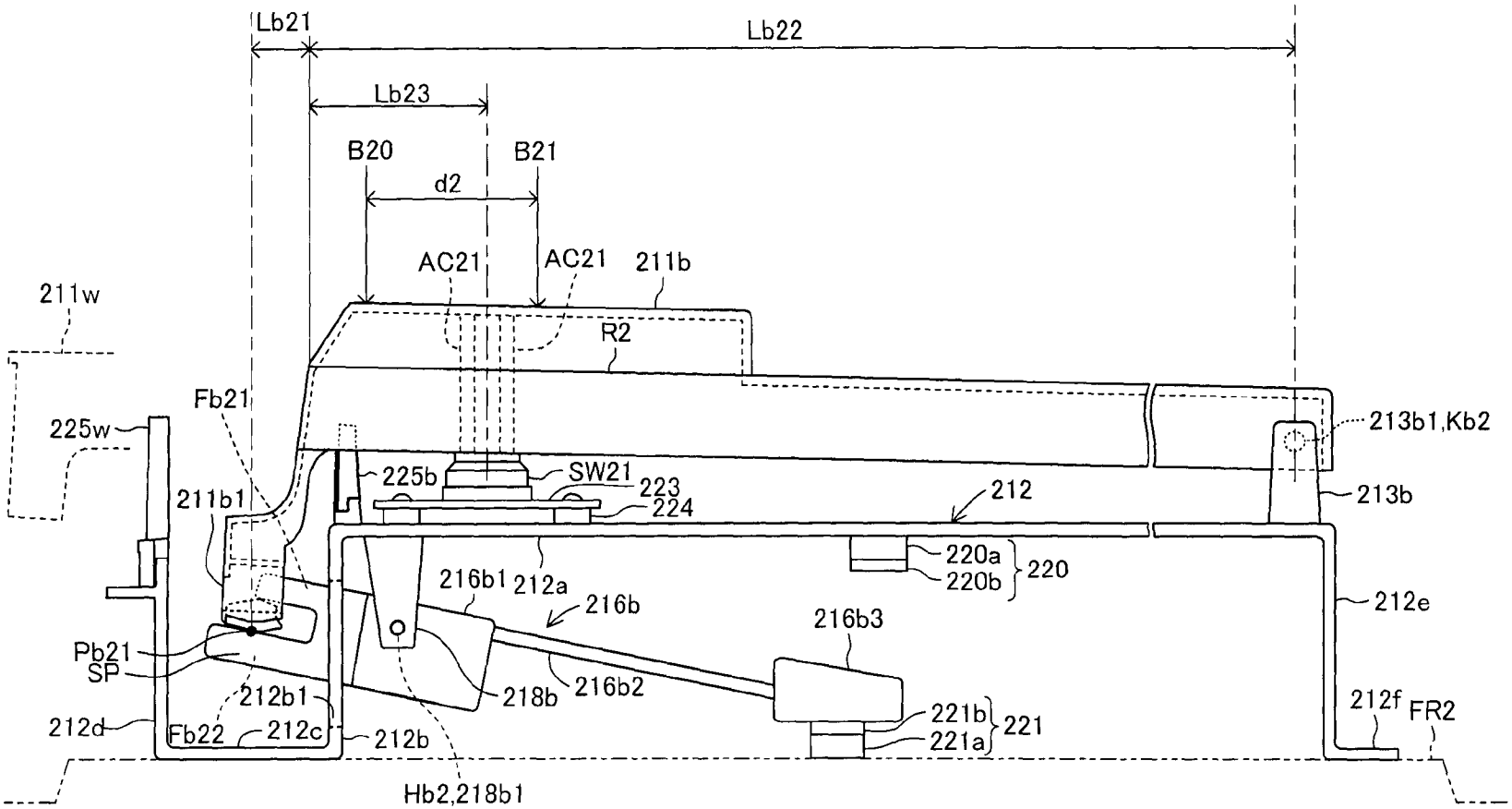
FIG. 25 is a right side view illustrating a configuration of a black key in the keyboard device according to another modification of the present invention.
Figure 26:
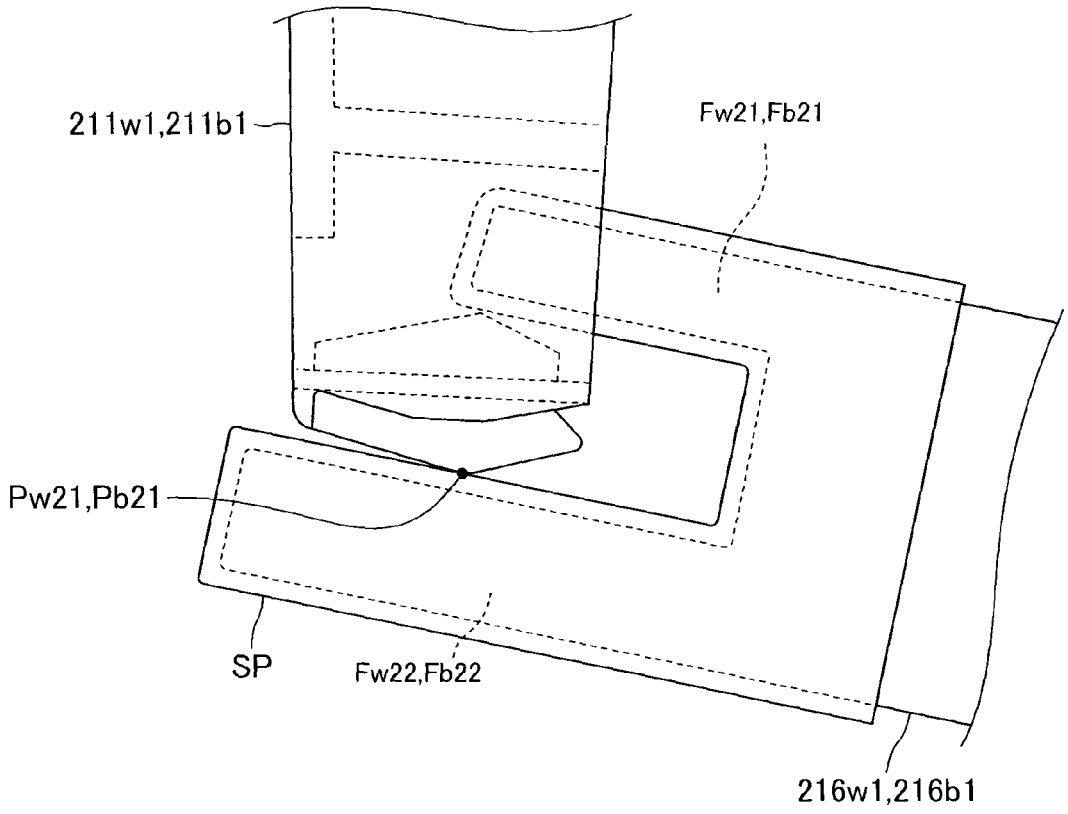
FIG. 26 is an enlarged view of the surrounding of the engagement portion according to another modification of the present invention.

As illustrated in FIGS. 24 and 25, the lower surface of the mass member 216*w*3 and the lower surface of the mass member 216*b*3 may be parallel to the top surface of the frame FR2 in the key release state. In this case, the thickness of the buffer member 221*b* is the same for all hammers. Therefore, the tilt angles of the hammer 216*w* and the hammer 216*b* in the key release state are the same, regardless of the assigned pitch. In view of this, as illustrated in FIG. 26, a spacer SP having a thickness according to the length of each key is provided on the leg portions Fw21 and Fw22 of the hammer 216*w* and the leg portions Fb21 and Fb22 of the hammer 216*b*. Specifically, the spacer SP for the hammer 216*w* on the high-pitched side is set to be thin, and the spacer SP for the hammer 216*w* on the low-pitched side is set to be thicker than the high-pitched side, whereby the engagement portion Pw21 of the white key 211*w* on the high-pitched side is located to be lower than the engagement portion Pw21 of the white key 211*w* on the low-pitched side. Thus, the height of the front end of the white key 211*w* can be adjusted to be the same. The spacer SP for the hammer 216*b* on the high-pitched side is set to be thick, and the spacer SP for the hammer 216*b* on the low-pitched side is set to be thinner than the high-pitched side, whereby the engagement portion Pb21 of the black key 211*b* on the high-pitched side is located to be higher than the engagement portion Pb21 of the black key 211*b* on the low-pitched side. Thus, the height of the front end of the black key 211*b* can be adjusted to be the same. The thickness of the shock absorbing member fitted to the lower end wall of the drive portion 211*w*1 and the drive portion 211*b*1 is adjusted according to the thickness of the spacer SP.

In the keyboard device illustrated in FIGS. 24 and 25, the height of the engagement portion Pw21 and the engagement portion Pb21 may be adjusted by bending the connection rod 216*w*2 of the hammer 216*w* and the connection rod 216*b*2 of the hammer 216*b* on the middle portion in the longitudinal direction, not by mounting the spacer illustrated in FIG. 26. For example, the connection rod may be bent such that the back end of the hammer 216*w* is lifted upward, and the back end of the hammer 216*b* is pushed downward. The bending amount (bending angle) of the connection rod may be set according to the length of the engaged key. In this case, the engagement portion Pw21 of the white key 211*w* on the high-pitched side is located to be lower than the engagement portion Pw21 of the white key 211*w* on the low-pitched side by the structure in which the bending amount of the connection rod 216*w*2 of the hammer 216*w* on the low-pitched side increases, and the bending amount of the connection rod 216*w*2 of the hammer 216*w* on the high-pitched side decreases. With this structure, the height of the front ends of the white keys 211*w* in the key release state can be adjusted to be the same. The engagement portion Pb21 of the black key 211*b* on the low-pitched side is located to be lower than the engagement portion Pb21 of the black key 211*b* on the high-pitched side by the structure in which the bending amount of the connection rod 216*b*2 of the hammer 216*b* on the low-pitched side increases, and the bending amount of the connection rod 216*b*2 of the hammer 216*b* on the high-pitched side decreases. With this structure, the height of the front ends of the black keys 211*b* in the key release state can be adjusted to be the same.

In the embodiment described above, the white key 211*w* and the black key 211*b* are supported by the key support portions 213*w* and 213*b* of the key frame 212 by fitting the projections 213*w*1 and 213*b*1 to the through-holes Kw and Kb respectively so that the front ends of the white key 211*w* and the black key 211*b* can rock in the vertical direction. However, the white key 211*w* and the black key 211*b* can be mounted on the key frame 212 by using various supporting mechanisms, if the white key 211*w* and the black key 211*b* are supported by the key frame 212 so that the front ends of the white key 211*w* and the black key 211*b* can rock in vertical direction. For example, the rear ends of plural keys (the white key 211*w* and/or the black key 211*b*) may be are supported by the key frame 212 through elastic deformation members so that the front ends of the plural keys can rock in vertical direction. Concretely, the rear ends of the plural keys are connected to a fixing member fixed to the key frame 212 through thin and elastic connection members, wherein the fixing member is extended in the lateral direction, the connection members are extended horizontally or vertically, and the plural keys, the connection members and the fixing member are formed integrally. In this case, for example, the connection members for the white keys 211*w* are extended horizontally, and the connection members for the black keys 111*b* are extended vertically.

Subsequently, a third embodiment of the present invention will be described below with reference to the drawings. In the description below, a side close to a performer is defined as a "front side", while a side far from the performer is defined as a "rear side". A high-pitched side is defined as a "right side", while a low-pitched side is defined as a "left side".

Figure 27:
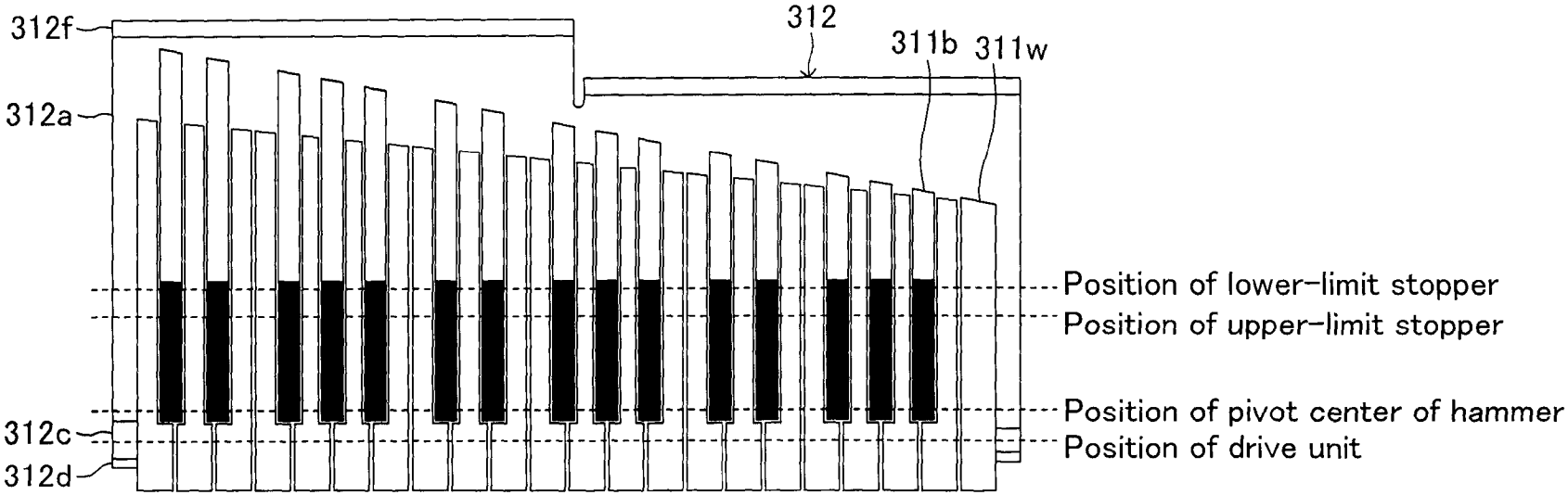
FIG. 27 is a plan view illustrating a keyboard device according to a third embodiment of the present invention.
Figure 28:
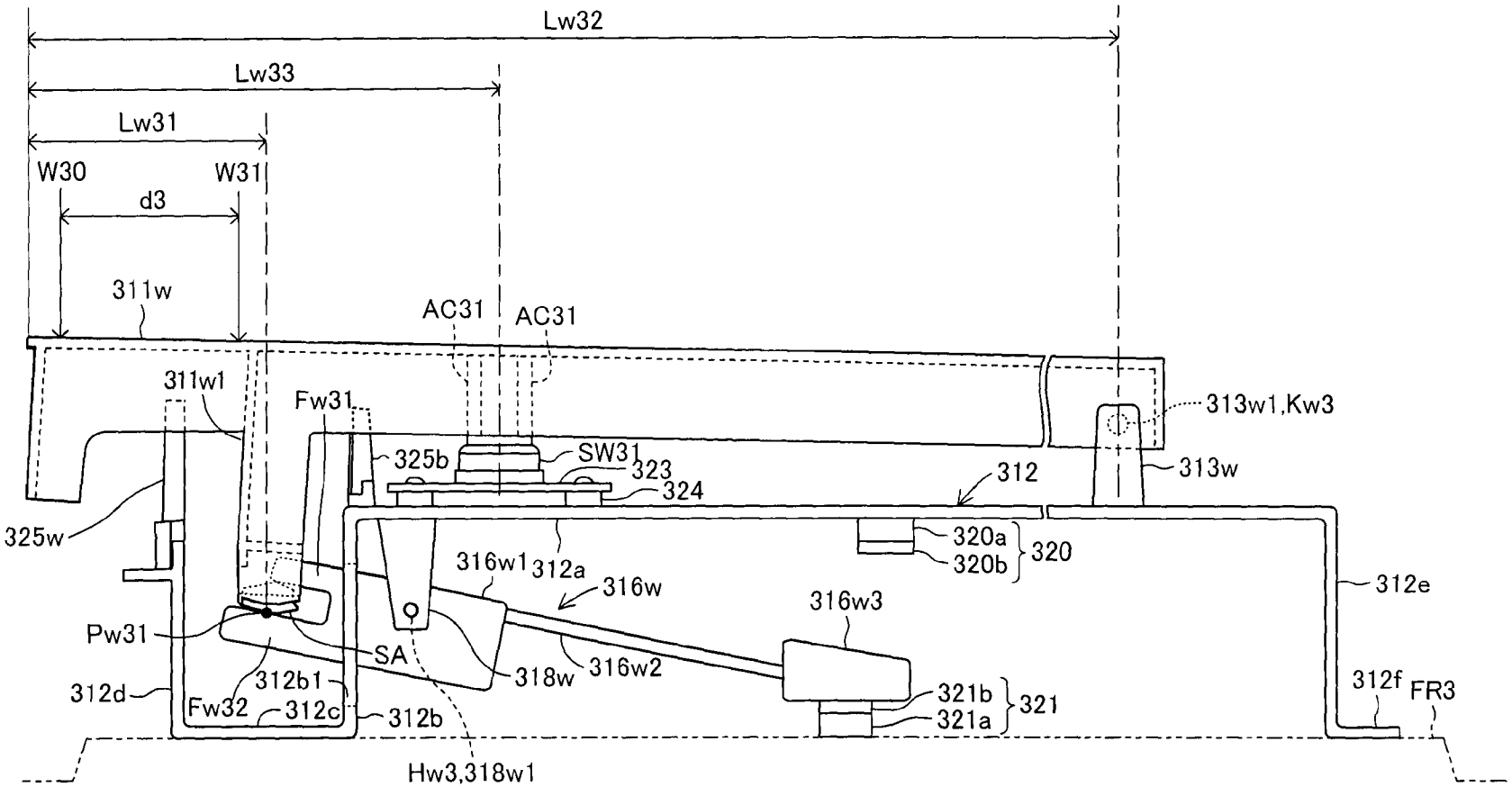
FIG. 28 is a right side view illustrating a configuration of a white key on a low-pitched side in the keyboard device illustrated in FIG. 27.
Figure 29:
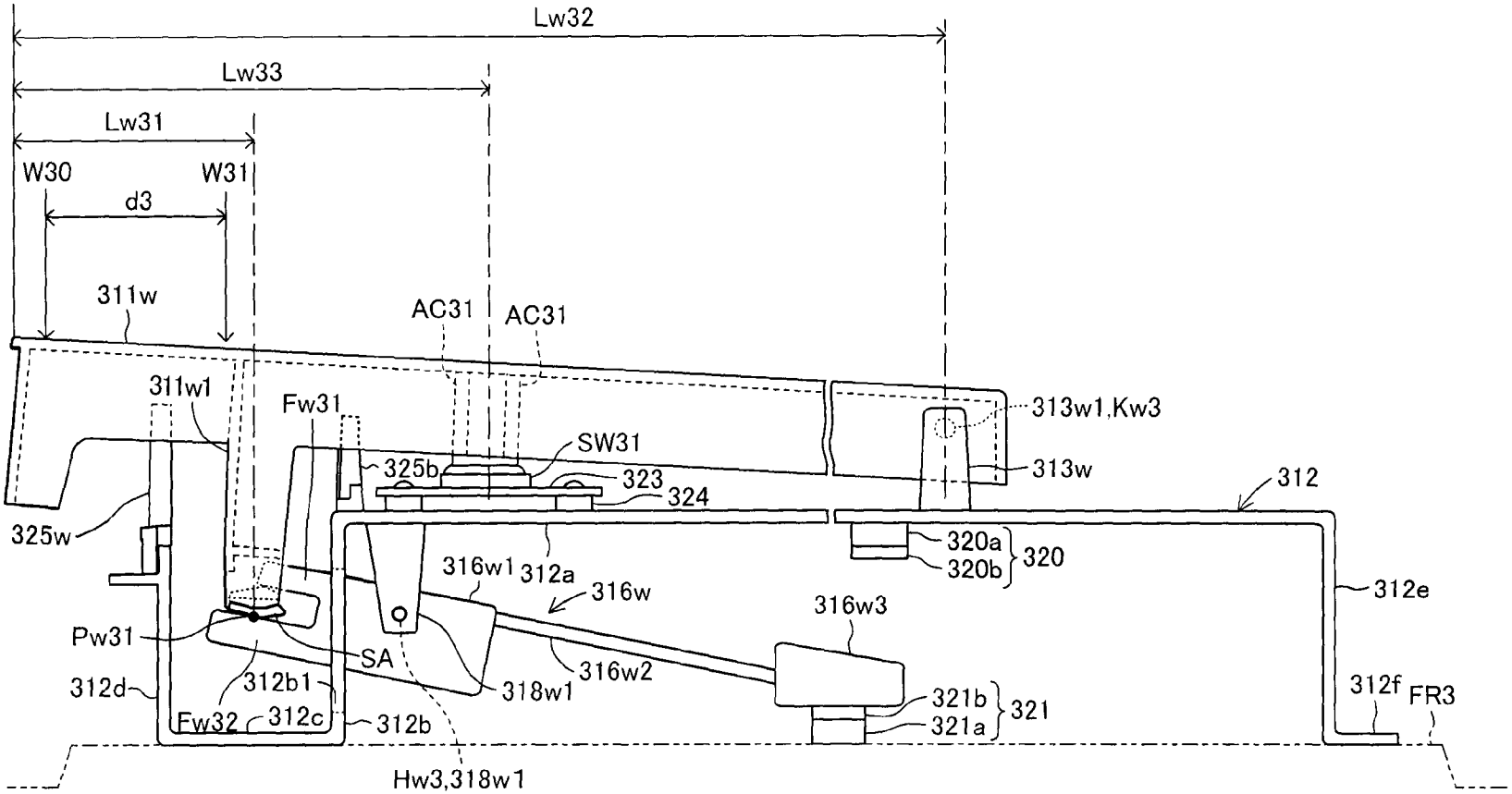
FIG. 29 is a right side view illustrating a configuration of a white key on a high-pitched side in the keyboard device illustrated in FIG. 27.
Figure 30:
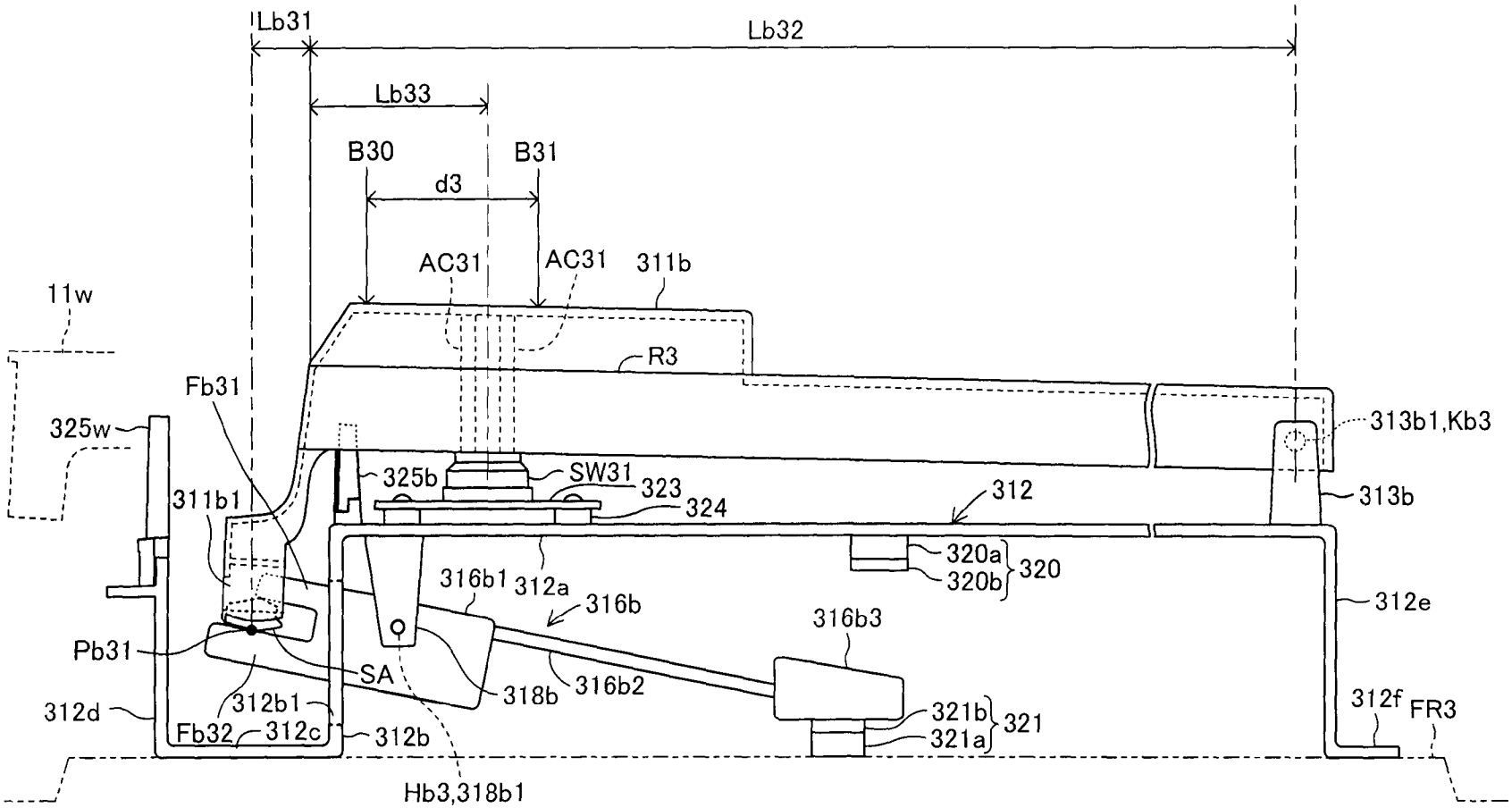
FIG. 30 is a right side view illustrating a configuration of a black key on a low-pitched side in the keyboard device illustrated in FIG. 27.
Figure 31:
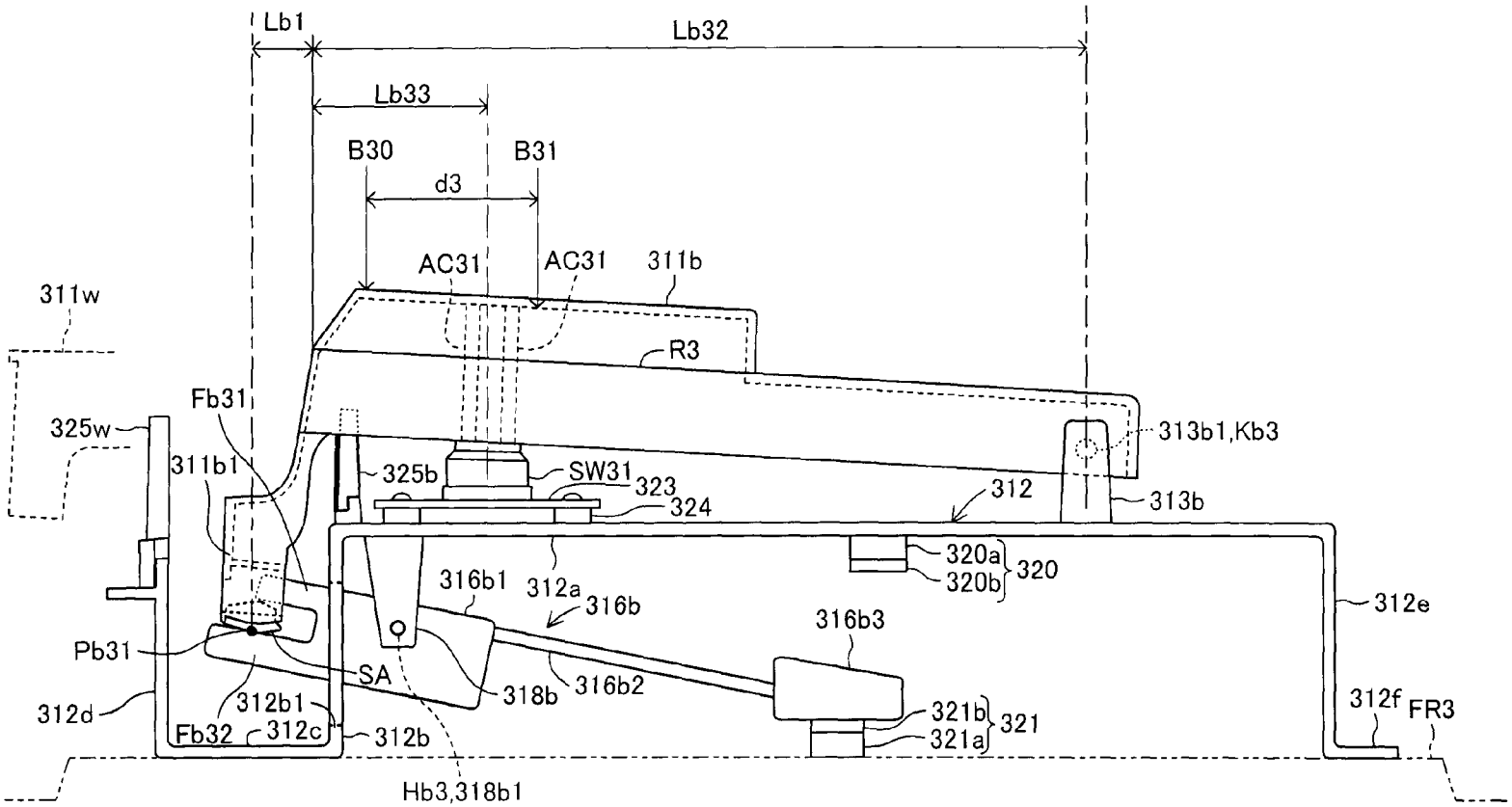
FIG. 31 is a right side view illustrating a configuration of a black key on a high-pitched side in the keyboard device illustrated in FIG. 27.

A keyboard device includes plural white keys 311*w* and plural black keys 311*b* as illustrated in FIG. 27. A different pitch is assigned to each of plural white keys 311*w* and each of plural black keys 311*b*. In the present embodiment, one of "C3", "D3", . . . "C6" is assigned to the white keys 311*w*, while one of "C#3", "D#3", "B#5" is assigned to the black keys 311*b*. The white keys 311*w* and black keys 311*b* are integrally formed to have a long shape by a synthetic resin. The white keys 311*w* are configured such that the length thereof is gradually shorter toward the white key 311*w* on the high-pitched side from the white key 311*w* on the low-pitched side. The black keys 311*b* are configured such that the length thereof is gradually shorter toward the black key 311*b* on the high-pitched side from the black key 311*b* on the low-pitched side. The back end of the black key 311*b* is located posterior to the back end of the adjacent white key 311*w*.

As illustrated in FIGS. 28 to 31, each of the white keys 311*w* has a width in the vertical direction smaller than that of the black key 311*b*, and has a width in the lateral direction larger than that of the black key 311*b*. The white key 311*w* and the black key 311*b* have a hollow shape including a thin top wall extending in the longitudinal direction, and thin sidewalls extending downward from left and right ends of the top wall respectively, with no bottom.

Through-holes Kw3 and Kb3 that are opposite to each other are formed on the rear part of the sidewall of the white key 311*w* and the black key 311*b*. The distance from the through-holes Kw3 and Kb3 to the back end of each key is the same for all keys. The white key 311*w* and the black key 311*b* are supported by a key support portion 313*w* and a key support portion 313*b* of a later-described key frame 312 with the through-holes Kw3 and Kb3. In the key release state, the white key 311*w* and the black key 311 tilt such that the back end becomes lower than the front end. The back end of the white key 311*w* goes into a casing of the electronic musical instrument, when the keyboard device is assembled to the electronic musical instrument. The portion of the white key anterior to the portion going into the casing is referred to as an apparent portion of the white key 311*w*. An edge line is formed on the portion where the side face and the top face of the white key 311*w* cross each other. The black key 311*b* has a portion projecting upward from the top face of the white key 311*w* in a state in which the black key 311*b* is not depressed, and the adjacent white keys 311*w* are not depressed. The projecting portion is referred to as an apparent portion of the black key 311*b*. The portion lower than the apparent portion of the black key 311*b* is referred to as a body. A performer depresses or releases the apparent portions of the white key 311*w* and the black key 311*b*. Specifically, the apparent portion corresponds to an operation portion in the present invention. The width of the apparent portion of the black key 311*b* in the lateral direction becomes narrower toward the top end, and the width of the body in the lateral direction is the same. Specifically, the side face of the apparent portion tilts inward with respect to the side face of the body. An edge line R3 is formed on the boundary between the apparent portion of the black key 311*b* and the body (see FIGS. 30 and 31).

The key frame 312 has a top plate 312*a* extending in the longitudinal direction and lateral direction. The position of the front end of the top plate 312*a* at the low-pitched side and the position of the front end at the high-pitched side are the same, but the back end at the low-pitched side is located posterior to the back end at the high-pitched side. The key frame 312 also has a front plate 312*b* vertically extending downward from the front end of the top plate 312*a*, a bottom plate 312*c* horizontally extending from the lower end of the front plate 312*b*, and a front plate 312*d* vertically extending upward from the front end of the bottom plate 312*c*. The key frame 312 also includes a rear plate 312*e* vertically extending downward from the back end of the top plate 312*a*, and a bottom plate 312*f* horizontally extending rearward from the lower end of the rear plate 312*e*. The height of the lower surface of the bottom plate 312*c* and the height of the lower surface of the bottom plate 312*f* are the same. The keyboard device is supported by a frame FR3 of an electronic musical instrument by the structure in which the lower surface of the bottom plate 312*c* and the lower surface of the bottom plate 312*f* are brought into contact with the frame FR3 of the electronic musical instrument and fixed thereto. The above-described key support portion 313*w* and the key support portion 313*b* are formed to project upward from the upper surface of the top plate 312*a*. The key support portion 313*b* is located posterior to the adjacent key support portion 313*w*. The key support portion 313*w* and the key support portion 313*b* respectively include two opposing plates, and a projection 313*w*1 and projection 313*b*1 that project inward. The projections 313*w*1 and 313*b*1 are fitted to the through-holes Kw3 and Kb3 respectively. Therefore, the white key 311*w* and the black key 311*b* are supported to be rotatable about the projections 313*w*1 and 313*b*1, and their front ends can rock in the vertical direction with the through-holes Kw3 and Kb3 and the center axes of the projections 313*w*1 and the projections 313*b*1 being defined as a pivot center. The position of the projection 313*w*1 and the position of the projection 313*b*1 in the vertical direction are the same for all key support portions. Specifically, the height of the pivot center is the same for all keys. The distance between the top face of the apparent portion of the white key 311*w* (i.e., the plane including the right and left edge lines of the white key 311*w*) and its pivot center in the vertical direction is the same for all white keys 311*w*. The distance between the top face of the operation portion of the black key 311*b* (i.e., the plane including the right and left edge lines R3 of the black key 311*b*) and its pivot center in the vertical direction is the same for all black keys 311*b*.

A drive portion 311*w*1 extends downward from the middle portion of the apparent portion of the white key 311*w*. The drive portion 311*w*1 has a hollow shape including a thin front wall extending in the vertical direction, and thin sidewalls extending rearward from left and right ends of the front wall, with no rear wall. The lower end of the drive portion 311*w*1 is closed by a lower end wall. The length of the drive portion 311*w*1 in the vertical direction is different according to the assigned pitch. The length of the drive portion 311*w*1 in the vertical direction will be described later. On the other hand, the black key 311*b* also has a drive portion 311*b*1 same as the drive portion 311*w*1 of the white key 311*w*. The drive portion 311*b*1 has a connection portion that extends downward from the front end of the apparent portion of the black key 311*b* and that is slightly curved to the front, and a vertical portion projecting downward from the leading end of the connection portion. The configuration of the vertical portion is the same for the drive portion 311*w*1. The length of the drive portion 311*b*1 in the vertical direction is different according to the assigned pitch. The length of the drive portion 311*b*1 in the vertical direction will be described later.

A distance Lw31 from the front end of the white key 311*w* to the drive portion 311*w*1 in the longitudinal direction is within 30% of a distance Lw32 from the front end of the white key 311*w* with the highest pitch (i.e., the shortest key of the plural white keys 311*w*) to the through-hole Kw3. The distance Lw31 is the same for all white keys 311*w*. A distance Lb31 from the front end of the apparent portion of the black key 311*b* to the drive portion 311*b*1 in the longitudinal direction is within 30% of a distance Lb32 from the front end of the apparent portion of the black key 311*b* with the highest pitch (e.g., the shortest key of the plural black keys 311*b*) to the through-hole Kb3. The distance Lb31 is the same for all black keys 311*b*. The position of the drive portion 311*w*1 and the position of the drive portion 311*b*1 in the longitudinal direction in the key-released state of the white key 311*w* and the black key 311*b* are the same. Specifically, the drive portions 311*w*1 and the drive portions 311*b*1 are located anterior to the front end of the apparent portion of the black keys 311*b*, and the drive portions 311*w*1 and the drive portions 311*b*1 are arranged in the lateral direction.

The lower ends of the drive portion 311*w*1 and the drive portion 311*b*1 are respectively engaged with front ends of hammers 316*w* and 316*b* in the opening formed between the front plate 312*b* and the front plate 312*d*. As described in detail later, the hammer 316*w* and the hammer 316*b* rock with the rocking movement of the corresponding white key 311*w* and the black key 311*b* with which the respective hammers 316*w* and 316*b* are engaged.

The hammer 316*w* includes a base 316*w*1 made of synthetic resin, a connection rod 316*w*2 made of metal, and a mass member 316*w*3. Like the hammer 316*w*, the hammer 316*b* includes a base 316*b*1, a connection rod 316*b*2, and a mass member 316*b*3. The base 316*w*1 and the base 316*b*1 are plate-like members, and formed with through-holes Hw3 and Hb3, respectively, from the right side face to the left side face. A hammer support portion 318*w* and a hammer support portion 318*b* are formed to project downward from the lower surface of the top plate 312*a*. The hammer support portions 318*w* and 318*b* are formed to have two opposing plates, and respectively have projections 318*w*1 and 318*b*1 projecting inward. The projections 318*w*1 and 318*b*1 are respectively fitted to the through-holes Hw3 and Hb3. With this structure, the bases 316*w*1 and 316*b*1 are supported to be rotatable about the projections 318*w*1 and 318*b*1. Specifically, the hammer 316*w* and the hammer 316*b* are supported such that the front ends and the back ends can be rocked in the vertical direction. The positions of the hammer support portion 318*w* and the hammer support portion 318*b* in the longitudinal direction and in the vertical direction are the same for all hammer support portions 318*w* and 318*b*. Specifically, plural hammer support portions 318*w* and the plural hammer support portions 318*b* are arranged side by side in the lateral direction, and the positions of the pivot centers of all hammers 316*w* and hammers 316*b* in the longitudinal direction and in the vertical direction are the same for all hammers 316*w* and 316*b*. In other words, the pivot centers of the hammers 316*w* and the hammers 316*b* are located on the same straight line extending in the lateral direction.

The base 316*w*1 includes a pair of leg portion Fw31 and leg portion Fw32 on its front end. The upper leg portion Fw31 is formed to be shorter than the lower leg portion Fw32. Like the base 316*w*1, the base 316*b*1 includes a pair of leg portion Fb31 and leg portion Fb32 on its front end. An elongated slit-like opening 312*b*1 extending in the vertical direction is formed on the front plate 312*b* for each of the hammers 316*w* and 316*b*. The front end of each hammer 316*w* and the front end of each hammer 316*b* project forward of the front plate 312*b* through the opening 312*b*1. The wall of the lower end of the drive portion 311*w*1 enters between the leg portions Fw31 and Fw32, while the wall of the lower end of the drive portion 311*b*1 enters between the leg portions Fb31 and Fb32. Specifically, the leg portions Fw31 and Fb31 enter between the walls of the lower ends of the drive portions 311*w*1 and 311*b*1 and intermediate walls that form gaps with the walls of the lower ends in the drive portions 311*w*1 and 311*b*1. A shock absorbing member SA such as rubber, urethane, or felt is fitted and fixed on the wall of the lower end of each of the drive portions 311*w*1 and 311*b*1. The shock absorbing member SA attenuates shock caused by the collision between the lower end of the drive portion 311*w*1 and the upper surface of the leg portion Fw32, the collision between the lower end of the drive portion 311*b*1 and the upper surface of the leg portion Fb32, the collision between the lower end of the drive portion 311*w*1 and the lower surface of the leg portion Fw31, and the collision between the lower end of the drive portion 311*b*1 and the lower surface of the leg portion Fb31.

The front end of the connection rod 316*w*2 and the front end of the connection rod 316*b*2 are assembled to the back end of the base 316*w*1 and the back end of the base 316*b*1, respectively. The connection rods 316*w*2 and 316*b*2 extend rearward. The position of the back end of the connection rod 316*w*2 and the position of the back end of the connection rod 316*b*2 in the longitudinal direction are the same. The mass member 316*w*3 and the mass member 316*b*3, described later, are assembled to the back end of the connection rod 316*w*2 and the back end of the connection rod 316*b*2, respectively.

The mass member 316*w*3 and the mass member 316*b*3 are formed to have a plate-like shape. The mass member 316*w*3 and the mass member 316*b*3 are long in the longitudinal direction. The mass member 316*w*3 and the mass member 316*b*3 are assembled to the connection rods 316*w*2 and 316*b*2 in such a manner that the thickness thereof is along the lateral direction.

As described above, the position of the pivot point of the key is different depending upon the assigned pitch. Therefore, the distance from the pivot center of the white key 311*w* to an engagement portion Pw31 where the leg portion Fw32 and the drive portion 311*w*1 are engaged with each other (brought into contact with each other) is different depending upon the assigned pitch. The distance from the pivot center of the black key 311*b* to an engagement portion Pb31 where the leg portion Fb32 and the drive portion 311*b*1 are engaged with each other (brought into contact with each other) is also different depending upon the assigned pitch. A key depression/release operation position W30 of the white key 311*w* that is the front end of the position of the white key 311*w* with the potentiality of being depressed or released is located anterior to the engagement portion Pw31, while a key depression/release operation position B30 of the black key 311*b* that is the front end of the position of the black key 311*b* with the potentiality of being depressed or released is located posterior to the engagement portion Pb31. Therefore, if the masses of the mass members for all hammers are equal, a key touch feeling is heavier on the middle-pitched part than on the low-pitched part, and the key touch feeling is heavier on the high-pitched part than on the middle-pitched part, on the key depression/release operation positions W30 and B30, because of the principle of leverage.

Figure 32:
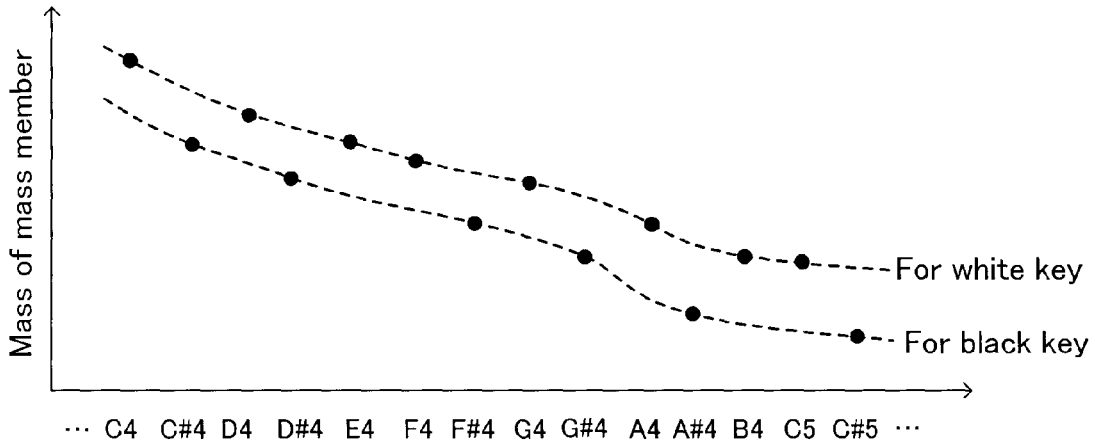
FIG. 32 is a graph of a characteristic curve illustrating a relationship between a pitch and a mass of a mass member.
Figure 33:
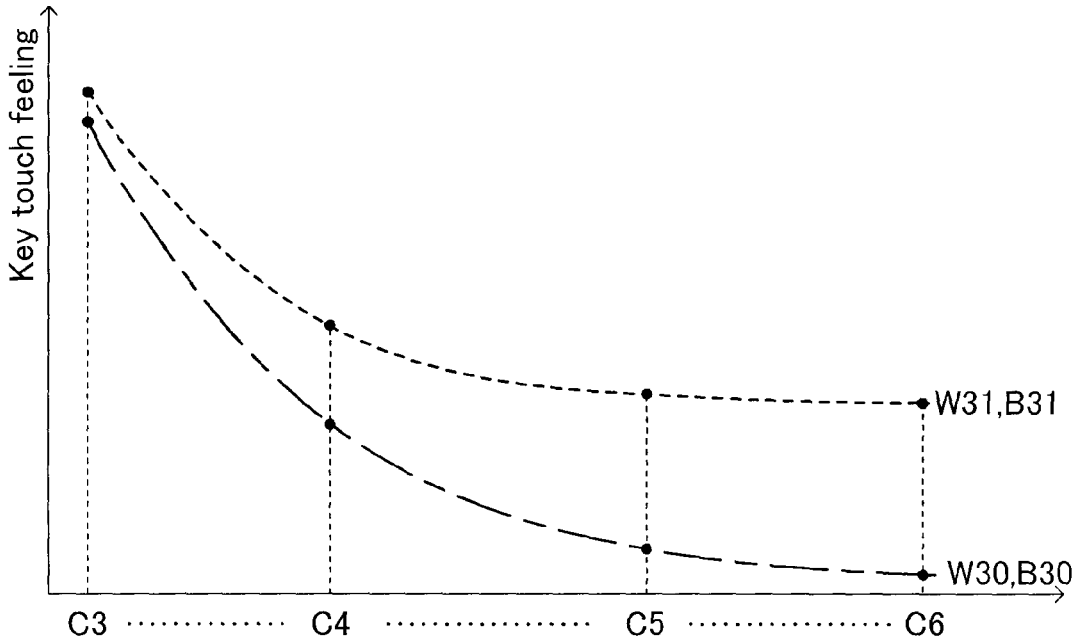
FIG. 33 is a graph of a characteristic curve illustrating a relationship between a pitch and a key touch.

In addition, in this case, the key touch feeling of the white keys 311*w* and the black keys 311*b* in each range is not equal. Specifically, the key touch feeling of the black key 311*b* is heavier than the key touch feeling of the adjacent two white keys 311*w*. In view of this, the mass of the mass member 316*w*3 and the mass of the mass member 316*b*3 are adjusted for each key as illustrated in FIG. 32. Specifically, as illustrated in a characteristic curve indicating the masses of the mass members 316*w*3 and 316*b*3 in the order of pitches, the masses of the mass members 316*w*3 and 316*b*3 are adjusted such that the characteristic curve of the mass member 316*w*3 and the characteristic curve of the mass member 316*b*3 are parallel downward-sloping curves, wherein the characteristic curve of the mass member 316*b*3 is located below the characteristic curve of the mass member 316*w*3. Thus, as illustrated by a chain line in FIG. 33, the key touch feeling on the key depression/release operation positions W30 and B30 becomes gradually lighter toward the high-pitched side from the low-pitched side. Therefore, as illustrated by a broken line in FIG. 33, the key touch feeling on key depression/release operation positions W31 and B31 located posterior to the key depression/release operation positions W30 and B30 by a distance d3 also becomes gradually lighter toward the high-pitched side from the low-pitched side. Since the length of the key to which a higher pitch is assigned is shorter, the difference between the key touch feeling on the key depression/release operation positions W30 and B30 and the key touch feeling on the key depression/release operation positions W31 and B31 becomes larger toward the high-pitched side from the low-pitched side. Specifically, the difference in the key touch feeling caused by the longitudinal difference of the key depression/release operation position is small on the low-pitched side, moderate in the middle-pitched side, and large on the high-pitched side.

When the white key 311*w* and the black key 311*b* are released, the front ends of the hammers 316*w* and 316*b* displace upward due to their own weight of the hammers 316*w* and 316*b*. In this case, the drive portion 311*w*1 and the drive portion 311*b*1 are biased upward by the leg portion Fw32 and the leg portion Fb32 respectively, whereby the front ends of the white key 311*w* and the black key 311*b* displace upward. On the other hand, when the white key 311*w* and the black key 311*b* are depressed, the lower surfaces of the drive portion 311*w*1 and the drive portion 311*b*1 press the upper surfaces of the leg portion Fw32 and the leg portion Fb32 respectively, whereby the front ends of the hammer 316*w* and the hammer 316*b* respectively displace downward.

A lower-limit stopper 320 is provided to the key frame 312. During the key depression, the lower-limit stopper 320 is brought into contact with the upper surfaces of the mass member 316*w*3 and the mass member 316*b*3 of the hammer 316*w* and the hammer 316*b* so as to restrict the upward displacement of the back ends of the hammer 316*w* and the hammer 316*b*, thereby restricting the downward displacement of the front ends of the white key 311*w* and the black key 311*b*. The lower-limit stopper 320 includes a stopper rail 320*a* and a buffer member 320*b*. The stopper rail 320*a* protrudes downward from the lower surface at the middle of the top plate 312*a*. The stopper rail 320*a* extends parallel to the lateral direction. The projection amount of the stopper rail 320*a* from the lower surface of the top plate 312*a* on the contact portion between the stopper rail 320*a* and each hammer is constant in the lateral direction. The buffer member 320*b* is fixed to the lower end surface of the stopper rail 320*a*. The buffer member 320*b* is a long member made of a shock-absorbing member such as rubber or felt. The sectional shape of the buffer member 320*b* is uniform from one end to the other end.

An upper-limit stopper 321 is provided to the middle portion of the frame FR3. During the key release, the upper-limit stopper 321 is brought into contact with the lower surfaces of the mass member 316*w*1 and the mass member 316*b*1 of the hammer 316*w* and the hammer 316*b* so as to restrict the downward displacement of the back ends of the hammer 316*w* and the hammer 316*b*, thereby restricting the upward displacement of the front ends of the white key 311*w* and the black key 311*b*. Like the lower-limit stopper 320, the upper-limit stopper 321 includes a stopper rail 321*a* and a buffer member 321*b*. Specifically, in a planar view of the key frame 312, the stopper rail 320*a* extends in parallel in the lateral direction. The projection amount from the frame FR3 is constant in the lateral direction. The buffer member 321*b* is fixed on the upper surface of the stopper rail 321*a*. Like the buffer member 320*b*, the sectional shape of the buffer member 321*b* is uniform from one end to the other end. The stopper rail 320*a* and the stopper rail 321*a* may continuously extend in the lateral direction, or may discontinuously extend. The stopper rail 320*a* and the stopper rail 321*a* may be formed integral with the top plate 312*a* and the frame FR3 respectively, or may be formed as separate components and assembled to the top plate 312*a* and the frame FR3 respectively.

Figure 34:
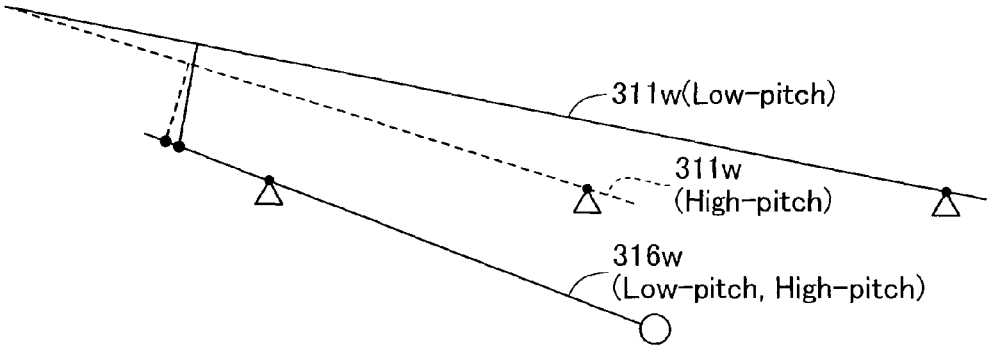
FIG. 34 is a schematic view illustrating a difference in the configuration between the white key on the low-pitched side and the white key on the high-pitched side in FIG. 27.

As described above, the white key 311*w* tilts such that the back end is lower than the front end during the key release. The height of the pivot center of the white key 311*w* is the same for all white keys 311*w*. The position of the engagement portions Pw31 of two different white keys 311*w* in the vertical direction are the same during the key release. Accordingly, if the length of the drive portion 311*w*1 of the white key 311*w* in the vertical direction is the same for all white keys 311*w*, the front end of the white key 311*w* having the shorter length in the longitudinal direction might become high. In view of this, in the present embodiment, the length of the drive portion 311*w*1 in the vertical direction is set according to the length of the white key 311*w* in order to set the height of the front end of each white key 311*w* in the key release state to be the same. Specifically, the length of the drive portion 311*w*1 in the vertical direction for the white key 311*w* having the shorter length in the longitudinal direction is set to be small (see FIG. 34). As described above, in the present embodiment, the size of the white key 311*w* in the vertical direction is set according to the longitudinal distance from the front end of the white key 311*w* to the key support portion 313*w* (the axis of the projection 313*w*1).

Figure 35:
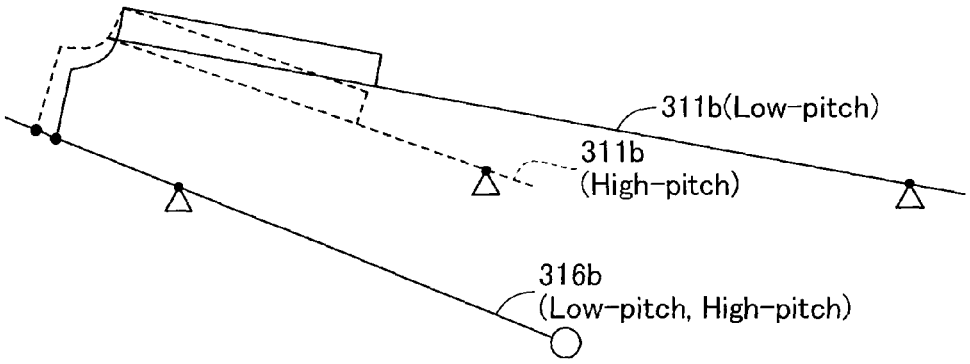
FIG. 35 is a schematic view illustrating a difference in the configuration between the black key on the low-pitched side and the black key on the high-pitched side in FIG. 27.

As described above, the black key 311*b* tilts such that the back end is lower than the front end during the key release. The height of the pivot center of the black key 311*b* is the same for all black keys 311*b*. The position of the engagement portions Pb31 of two different black keys 311*b* in the vertical direction are the same during the key release. Accordingly, if the length of the drive portion 311*b*1 of the black key 311*b* in the vertical direction is the same for all black keys 311*b*, the front end of the black key 311*b* having the shorter length in the longitudinal direction might become high. In view of this, in the present embodiment, the length of the drive portion 311*b*1 in the vertical direction is set according to the length of the black key 311*b* in order to set the height of the front end of each black key 311*b* in the key release state to be the same. Specifically, the length of the drive portion 311*b*1 in the vertical direction for the black key 311*b* having the shorter length in the longitudinal direction is set to be long (see FIG. 35). As described above, in the present embodiment, the size of the black key 311*b* in the vertical direction is set according to the longitudinal distance from the front end of the black key 311*b* to the key support portion 313*b* (the axis of the projection 313*b*1).

In a state in which two adjacent white keys 311*w* and the black key 311*b* between the two adjacent white keys 311*w* are released, the rocking angle of each hammer is set such that the edge line R3 of the black key 311*b* is located below the top face of one on the low-pitched side of the two white keys 311*w*, and above the top face of one on the high-pitched side of the two white keys 311*w*.

The tilt angle of each key is set such that, in the state in which the white key 311*w* and the black key 311*b* adjacent to the white key 311*w* are depressed respectively by the same depression force, and their rocking movement is restricted, the edge line R3 of the black key 311*b* is located below the top face of the white key 311*w*. The buffer member 320*b* and the buffer member 321*b* have elasticity. Therefore, when the key is depressed more after the hammer is brought into contact with the buffer member during the key depression, the buffer member is elastically deformed, so that the front end of the key slightly displaces downward.

A switch drive portion AC31 is provided on the lower surface of each of the white key 311*w* and the black key 311*b* on the middle part. The switch drive portion AC31 is a plate-like member extending in the vertical direction in each of the white key 311*w* and the black key 311*b*, and the lower end surface of the switch drive portion AC31 is brought into contact with the upper surface of a switch SW31. The switch SW31 is provided for each key. The switch SW31 is pressed by the corresponding key to detect whether the corresponding key is depressed or released. Specifically, when the switch SW31 is depressed by the key, a rubber main body is deformed to make two contacts, which are formed on a circuit board 323, short-circuit, thereby being turned ON. The circuit board 323 extends in the lateral direction. Through-holes penetrating from the upper surface to the lower surface are formed on the circuit board 323. The through-holes correspond to a bosses 324 formed integral with the upper surface of the top plate 312*a*. When screws are threaded to the bosses 324 through the through-hole, the circuit board 323 is fixed to the key frame 312. The main bodies of the plural switches SW31, each corresponding to each key, are arranged on the upper surface of the circuit board 323 in the lateral direction. The position of the switch SW31 for the white key 311*w* and the position of the switch SW31 for the black key 311*b* in the longitudinal direction are the same. A distance Lw33 from the front end of the white key 311*w* to the switch SW31 in the longitudinal direction is within 30% of the distance Lw32 from the front end of the white key 311*w* with the highest pitch to the through-hole Kw3, and a distance Lb33 from the front end of the apparent portion of the black key 311*b* to the switch SW31 is within 30% of the distance Lb32 from the front end of the apparent portion of the black key 311*b* with the highest pitch to the through-hole Kb3. The switch SW31 for the white key 311*w* and the switch SW31 for the black key 311*b* may be arranged side by side in the lateral direction, and the positions of both switches in the longitudinal direction may be shifted.

A key guide 325*w* for guiding the rocking movement of the white key 311*w* is formed to project upward from the top end surface of the front plate 312*d*. The key guide 325*w* is inserted into the white key 311*w* from below, and during the key depression and key release, the side face of the key guide 325*w* and the inside face of the sidewall of the white key 311*w* are in sliding contact with each other. This structure can prevent a slight displacement of the white key 311*w* in the lateral direction during the key depression and key release.

A key guide 325*b* for guiding the rocking movement of the black key 311*b* is formed to project upward from the upper surface of the top plate 312*a* at the front end. The key guide 325*b* is inserted into the black key 311*b* from below, and during the key depression and key release, the side face of the key guide 325*b* and the inside face of the sidewall of the black key 311*b* are in sliding contact with each other. This structure can prevent a slight displacement of the black key 311*b* in the lateral direction during the key depression and key release.

In the keyboard device having the configuration described above, the size of each white key 311*w* in the vertical direction is set according to the longitudinal distance from the front end of each white key 311*w* to the key support portion 313*w* (the axis of the projection 313*w*1) in order that the height of the front end of each white key 311*w* during the key release is adjusted to be the same. In addition, the size of each black key 311*b* in the vertical direction is set according to the longitudinal distance from the front end of each black key 311*b* to the key support portion 313*b* (the axis of the projection 313*b*1) in order that the height of the front end of each black key 311*b* during the key release is adjusted to be the same. Accordingly, the appearance of the keyboard device can be made similar to the appearance of the keyboard device for an acoustic piano during the key release. In addition, the keyboard device according to the present embodiment has high productivity, because there is no need to adjust the height of the front ends of the keys to be the same by adjusting the number or the thickness of the spacer, which is sandwiched between the key support portion and the frame, as in the keyboard device such as an acoustic piano.

The distance from the top face of the apparent portion of the white key 311*w* to the pivot center is the same for all white keys 311*w*, and the distance from the top face of the body of the black key 311*b* to the pivot center is the same for all black keys 311*b*. Accordingly, when the through-holes Kw3 and Kb3 are formed in a different process after a process of molding the outer shape of the white key 311*w* and the black key 311*b*, the different process can commonly be carried out for all keys to enhance productivity of the keys. The positions of the projections 313*w*1 and 313*b*1 of the key support portions 313*w* and 313*b* in the vertical direction are set to be the same for all key support portions 313*w* and 313*b*, resulting in that the frame 312 that supports the keys is easily designed. In addition, the frame 312 is easily processed, and the precision can be enhanced.

Upon embodying the present invention, the present invention is not limited to the above-described embodiment, and various modifications are possible without departing from the scope of the present invention.

Figure 36A:
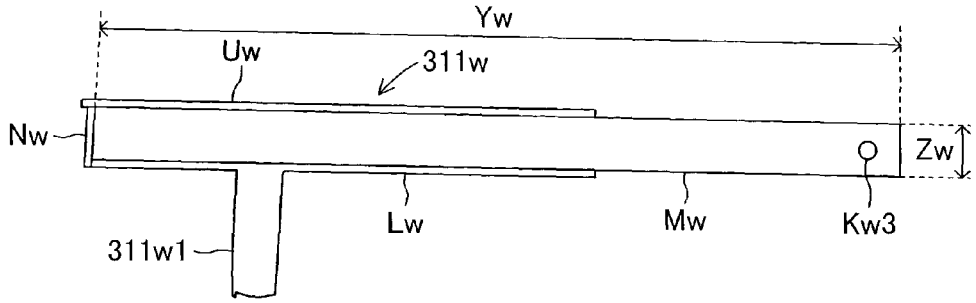
FIG. 36A is a side view illustrating a configuration of a white key according to a modification of the present invention.

According to the embodiment described above, the length of the drive portion 311*w*1 in the vertical direction for the white key 311*w* having the shorter length in the longitudinal direction is set to be short. Instead of this structure, the length of the drive portion 311*w*1 in the vertical direction may be set to be the same for all white keys 311*w*, and the length of the body of each white key 311*w*, in the vertical direction, excluding the drive portion 311*w*1 may be set such that the height of the front end of the white key 311*w* in the key release state becomes the same for all white keys 311*w*. Specifically, the body of the white key 311*w* in the vertical direction, excluding the drive portion 311*w*1, for the white key 311*w* having the shorter length in the longitudinal direction may be set to be short. As illustrated in FIG. 36A, the white key 311*w* may be formed in such a manner that an upper part Uw, a middle part Mw, and a lower part Lw are combined to be superimposed in the vertical direction, and a front part Nw is assembled to a front end of the middle part Mw. The upper part Uw is formed to have a thin plate-like shape. The middle part Mw is formed to have a prism shape. The lower part Lw is formed to have a thin plate-like shape. The drive portion 311*w*1 extends downward from the lower surface of the lower part Lw. In this case, the upper part Uw and the lower part Lw may be set to be the same for all white keys 311*w*, and the size Yw in the longitudinal direction and the size Zw in the vertical direction of the middle part Mw may be set according to the assigned pitch. Specifically, the vertical size Zw of the middle part Mw whose longitudinal size Yw is set to be short is set to be short. Even with this structure, the height of the front end of each white key 311*w* in the key release state can be adjusted to be the same. Since the upper part Uw and the lower part Lw are made common, cost can be reduced. In the example described above, the size Zw of the middle part Mw is set according to the size Yw. However, instead of this structure, or in addition to this structure, the size of the plate-like portion of the lower part Lw may be set according to the size Yw.

Figure 36B:
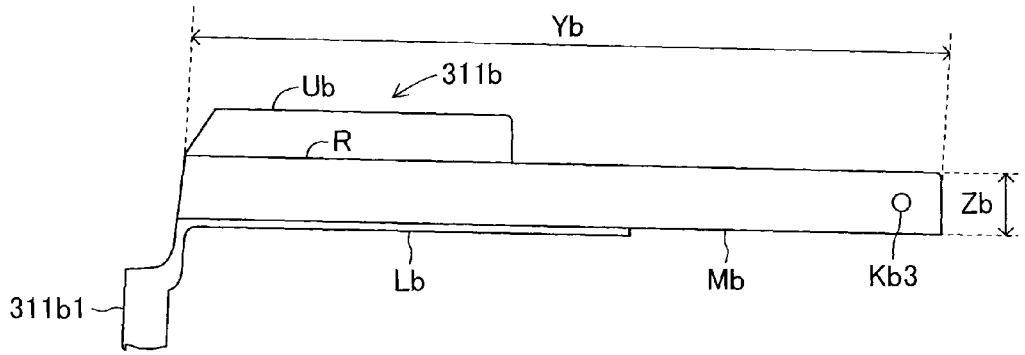
FIG. 36B is a side view illustrating a configuration of a black key according to a modification of the present invention.
Figure 37:
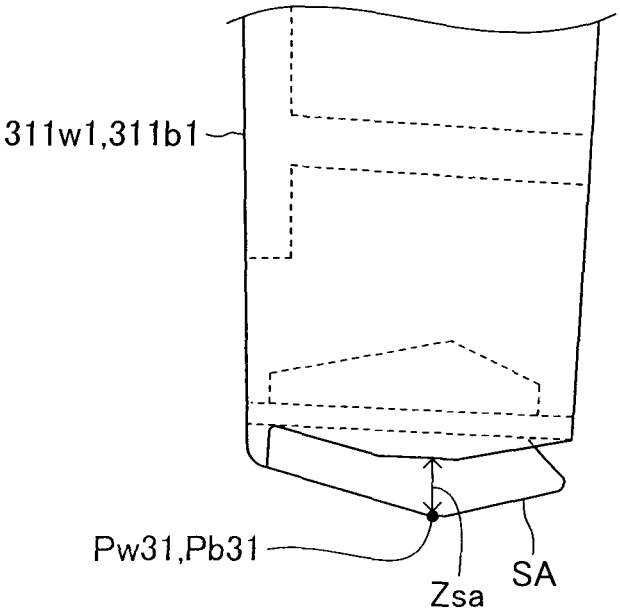
FIG. 37 is an enlarged view of an engagement portion where a key and a hammer are engaged with each other.

The black key 311*b* can be configured like the white key 311*w*. Specifically, the length of the drive portion 311*b*1 in the vertical direction may be set to be the same for all black keys 311*b*, and the length of the body of each black key 311*b*, in the vertical direction, excluding the drive portion 311*b*1 may be set such that the height of the front end of the black key 311*b* in the key release state becomes the same for all black keys 311*b*. Specifically, the body of the black key 311*b* in the vertical direction, excluding the drive portion 311*b*1, for the black key 311*b* having the shorter length in the longitudinal direction may be set to be long. As illustrated in FIG. 36B, the black key 311*b* may be formed in such a manner that an upper part Ub, a middle part Mb, and a lower part Lb are combined to be superimposed in the vertical direction. The upper part Ub is formed to have a prism shape in which a cross-section perpendicular to the longitudinal direction has a trapezoidal shape. The upper part Ub corresponds to the apparent portion of the black key 311*b*. The middle part Mb is formed to have a prism shape. The lower part Lb is formed to have a thin plate-like shape. The drive portion 311*b*1 extends downward from the lower surface of the lower part Lb. In this case, the upper part Ub and the lower part Lb may be set to be the same for all black keys 311*b*, and the size Yb in the longitudinal direction and the size Zb in the vertical direction of the middle part Mb may be set according to the assigned pitch. Specifically, the vertical size Zb of the middle part Mb whose longitudinal size Yb is set to be short is set to be long. Even with this structure, the height of the front end of each black key 311*b* in the key release state can be adjusted to be the same. Since the upper part Ub and the lower part Lb are made common, cost can be reduced. In the example described above, the size Zb of the middle part Mb is set according to the size Yb. However, instead of this structure, or in addition to this structure, the size of the plate-like portion of the lower part Lb may be set according to the size Yb.

The total size of the white key 311*w* in the vertical direction may be set to be the same for all white keys 311*w*. In this case, a size Zsa of a portion, located below the lower end wall of the drive portion 311*w*1 and the drive portion 311*b*1, of the shock absorbing member SA may be set in order that the height of the front end of each white key 311*w* in the key release state becomes the same for all white keys 311*w*. Specifically, the size Zsa for the white key 311*w* having the shorter length in the longitudinal direction may be set to be short. The total size of the black key 311*b* in the vertical direction may be set to be the same for all black keys 311*b*. In this case, the size Zsa may be set in order that the height of the front end of each black key 311*b* in the key release state becomes the same for all black keys 311*b*. Specifically, the size Zsa for the black key 311*b* having the shorter length in the longitudinal direction may be set to be long. Even with this structure, the effect same as the embodiment described above can be obtained.

In the embodiment described above, the white key 311*w* and the black key 311*b* are supported by the key support portions 313*w* and 313*b* of the key frame 312 by fitting the projections 313*w*1 and 313*b*1 to the through-holes Kw3 and Kb3 respectively so that the front ends of the white key 311*w* and the black key 311*b* can rock in the vertical direction. However, the white key 311*w* and the black key 311*b* can be mounted on the key frame 312 by using various supporting mechanisms, if the white key 311*w* and the black key 311*b* are supported by the key frame 312 so that the front ends of the white key 311*w* and the black key 311*b* can rock in vertical direction. For example, the rear ends of plural keys (the white key 311*w* and/or the black key 311*b*) may be are supported by the key frame 312 through elastic deformation members so that the front ends of the plural keys can rock in vertical direction. Concretely, the rear ends of the plural keys are connected to a fixing member fixed to the key frame 312 through thin and elastic connection members, wherein the fixing member is extended in the lateral direction, the connection members are extended horizontally or vertically, and the plural keys, the connection members and the fixing member are formed integrally. In this case, for example, the connection members for the white keys 311*w* are extended horizontally, and the connection members for the black keys 311*b* are extended vertically.

What is claimed is:

1. A keyboard device for an electronic musical instrument, the keyboard device comprising:

plural white keys and black keys that are supported by a key support portion in order that front ends thereof rock in a vertical direction by a key depression/release operation by a performer, each white key having an edge line extending in a longitudinal direction on a crossing portion of a side face and a top face, and each black key having an edge line extending in the longitudinal direction on a crossing portion of a lower side face and an upper side face tilting inward with respect to the lower side face, wherein each of plural white keys and each of black keys include an operation portion that is depressed and released by the performer, and a drive portion extending downward, and a length from the front end of the operation portion to the key support portion is different among the plural white keys and black keys;

plural hammers, each of which is engaged with the drive portion of each of the plural white keys and the drive portion of each of the plural black keys, and each of which is supported by a hammer support portion in order to rock with the rocking movement of each of the plural white keys and black keys; and a restricting member that restricts the rocking movement of the plural hammers in order to restrict the rocking range of the plural white keys and the plural black keys, wherein, a vertical length of the drive portion of a first key and a vertical length of the drive portion of a second key are set to be the same, the first key and the second key being both the white keys or both the black keys out of the plural white keys and the plural black keys, and the vertical position of the hammer support portion of the first hammer engaged with the first key and the vertical position of the hammer support portion of the second hammer engaged with the second key are respectively set to a position according to the distance from the front end of the operation portion of the first key to the key support portion and the distance from the front end of the operation portion of the second key to the key support portion, in order that the vertical positions of the front ends of the operation portions of the first key and the second key become the same in a state in which the first key and the second key are released.

2. The keyboard device according to claim 1, wherein the drive portion of the first key and the drive portion of the second key are respectively provided posterior to the front end of the operation portion of the first key and the front end of the operation of the second key, the distance from the front end of the operation portion of the first key to the key support portion is longer than the distance from the front end of the operation portion of the second key to the key support portion, and the hammer support portion of the first hammer is located to be higher than the hammer support portion of the second hammer.

3. The keyboard device according to claim 1, wherein the drive portion of the first key and the drive portion of the second key are respectively provided anterior to the front end of the operation portion of the first key and the front end of the operation of the second key, the distance from the front end of the operation portion of the first key to the key support portion is longer than the distance from the front end of the operation portion of the second key to the key support portion, and the hammer support portion of the first hammer is located to be lower than the hammer support portion of the second hammer.

4. The keyboard device according to claim 1, wherein the length from the front end of the operation portion to the back end of the plural white keys becomes shorter toward the high-pitched side from the low-pitched side, and the length from the front end of the operation portion to the back end of the plural black keys becomes shorter toward the high-pitched side from the low-pitched side.

5. The keyboard device according to claim 1, wherein the distance between a plane including the edge line of the first key and the key support portion of the first key is set to be the same as the distance between a plane including the edge line of the second key and the key support portion of the second key.

6. The keyboard device according to claim 1, wherein the vertical positions of the key support portions of the first key and the second key are set to be the same.

7. The keyboard device according to claim 1, wherein the first key and the second key are adjacent white keys, and the edge line of the black key between the first key and the second key is located between the top face of the first key and the top face of the second key, in a state in which the first key, the second key, and the black key are released.

8. The keyboard device according to claim 1, wherein the first key and the second key are adjacent white keys, and the edge line of the black key between the first key and the second key is located below the top face of the first key and the top face of the second key, in a state in which the first key, the second key, and the black key are depressed, and the rocking movements of the first key, the second key, and the black key are restricted.

9. A keyboard device for an electronic musical instrument, the keyboard device comprising:

plural white keys and black keys that are supported by a key support portion in order that front ends thereof rock in a vertical direction by a key depression/release operation by a performer, each white key having an edge line extending in a longitudinal direction on a crossing portion of a side face and a top face, and each black key having an edge line extending in the longitudinal direction on a crossing portion of a lower side face and an upper side face tilting inward with respect to the lower side face, wherein each of plural white keys and each of black keys include an operation portion that is depressed and released by the performer, and a drive portion extending downward, and a length from the front end of the operation portion to the key support portion is different among the plural white keys and black keys;

plural hammers, each of which includes an engagement portion engaged with the drive portion of each of the plural white keys and the drive portion of each of the plural black keys, and each of which is supported by a hammer support portion in order to rock with the rocking movement of each of the plural white keys and black keys; and a restricting member that restricts the rocking movement of the plural hammers in order to restrict the rocking range of the plural white keys and the plural black keys, wherein, a vertical length of the drive portion of a first key and a vertical length of the drive portion of a second key are set to be the same, the first key and the second key being both the white keys or being both the black keys out of the plural white keys and the plural black keys, the longitudinal position and the vertical position of the hammer support portion of the first hammer engaged with the first key and the longitudinal position and the vertical position of the hammer support portion of the second hammer engaged with the second key are set to be the same, and a vertical position of an engagement point of the first key and the first hammer and a vertical position of an engagement point of the second key and the second hammer are respectively set to a position according to the distance from the front end of the operation portion of the first key to the key support portion and the distance from the front end of the operation portion of the second key to the key support portion, in order that the vertical positions of the front ends of the operation portions of the first key and the second key become the same in a state in which the first key and the second key are released.

10. The keyboard device according to claim 9, wherein the restricting member includes an upper-limit stopper restricting an upward rocking movement of the front ends of the first key and the second key, and a position of a contact point between the first hammer and the upper-limit stopper and a position of a contact point between the second hammer and the upper-limit stopper are respectively set to a position according to the distance from the front end of the operation portion of the first key to the key support portion and the distance from the front end of the operation portion of the second key to the key support portion, in order that a rocking angle of the first hammer and a rocking angle of the second hammer in the key release state of the first key and the second key are respectively set to an angle according to the distance from the front end of the operation portion of the first key to the key support portion and the distance from the front end of the operation portion of the second key to the key support portion.

11. The keyboard device according to claim 10, wherein the first hammer and the second hammer respectively include a contact portion to the upper-limit stopper, the contact portion has a contact surface extending in the longitudinal direction, the contact surface tilts with respect to the mounting surface of the upper-limit stopper in the key release state of the first key and the second key, and the longitudinal position of the upper-limit stopper with respect to the contact portion of the first hammer and the longitudinal position of the upper-limit stopper with respect to the contact portion of the second hammer are respectively set to a position according to the distance from the front end of the operation portion of the first key to the key support portion and the distance from the front end of the operation portion of the second key to the key support portion, in order that the vertical position of the contact point between the first hammer and the upper-limit stopper and the vertical position of the contact point between the second hammer and the upper-limit stopper are set to be the same, and that the longitudinal position of the contact point between the first hammer and the upper-limit stopper and the longitudinal position of the contact point between the second hammer and the upper-limit stopper are respectively set to a position according to the distance from the front end of the operation portion of the first key to the key support portion and the distance from the front end of the operation portion of the second key to the key support portion.

12. The keyboard device according to claim 11, wherein the drive portion of each of the plural white keys is provided posterior to the front end of the operation portion of each of the plural white keys, the drive portion of each of the plural black keys is provided anterior to the front end of the operation portion of each of the plural black keys, and a tilting direction of the contact surface of the hammer engaged with the white key and a tilting direction of the contact surface of the hammer engaged with the black key are reverse to each other.

13. The keyboard device according to claim 10, wherein the thickness of the upper-limit stopper that is in contact with the first hammer and the second hammer is set to be a thickness according to the distance from the front end of the operation portion of the first key to the key support portion and the distance from the front end of the operation portion of the second key to the key support portion, in order that the vertical position of the contact point between the first hammer and the upper-limit stopper and the vertical position of the contact point between the second hammer and the upper-limit stopper are respectively set to a position according to the distance from the front end of the operation portion of the first key to the key support portion and the distance from the front end of the operation portion of the second key to the key support portion.

14. The keyboard device according to claim 9, wherein the engagement portion of the first hammer and the engagement portion of the second hammer respectively have a base member and a spacer mounted to the base member, and the thickness of the spacer is set according to the distance from the front end of the operation portion of the first key to the key support portion and the distance from the front end of the operation portion of the second key to the key support portion.

15. The keyboard device according to claim 9, wherein the first hammer and the second hammer are bent in the vertical direction on the middle part in the longitudinal direction by a bending process, and a bending amount of the first hammer and the second hammer by the bending process is set according to the distance from the front end of the operation portion of the first key to the key support portion and the distance from the front end of the operation portion of the second key to the key support portion.

16. The keyboard device according to claim 9, wherein the length from the front end of the operation portion to the back end of the plural white keys becomes shorter toward the high-pitched side from the low-pitched side, and the length from the front end of the operation portion to the back end of the plural black keys becomes shorter toward the high-pitched side from the low-pitched side.

17. The keyboard device according to claim 9, wherein the distance between a plane including the edge line of the first key and the key support portion of the first key is set to be the same as the distance between a plane including the edge line of the second key and the key support portion of the second key.

18. The keyboard device according to claim 9, wherein the positions of the key support portions of the first key and the second key are set to be the same.

19. The keyboard device according to claim 9, wherein the first key and the second key are adjacent white keys, and the edge line of the black key between the first key and the second key is located between the top face of the first key and the top face of the second key, in a state in which the first key, the second key, and the black key are released.

20. The keyboard device according to claim 9, wherein the first key and the second key are adjacent white keys, and the edge line of the black key between the first key and the second key is located below the top face of the first key and the top face of the second key, in a state in which the first key, the second key, and the black key are depressed, and the rocking movements of the first key, the second key, and the black key are restricted.

21. A keyboard device for an electronic musical instrument, the keyboard device comprising:

plural white keys and black keys that are supported by a key support portion in order that front ends thereof rock in a vertical direction by a key depression/release operation by a performer, each white key having an edge line extending in a longitudinal direction on a crossing portion of a side face and a top face, and each black key having an edge line extending in the longitudinal direction on a crossing portion of a lower side face and an upper side face tilting inward with respect to the lower side face, wherein each of plural white keys and each of black keys include an operation portion that is depressed and released by the performer, and a drive portion extending downward, and a length from the front end of the operation portion to the key support portion is different among the plural white keys and black keys;

plural hammers, each of which is engaged with the drive portion of each of the plural white keys and the drive portion of each of the plural black keys, and each of which is supported by a hammer support portion in order to rock with the rocking movement of each of the plural white keys and black keys; and a restricting member that restricts the rocking movement of the plural hammers in order to restrict the rocking range of the plural white keys and the plural black keys, wherein, vertical positions of engagement portions between the plural white keys as well as the plural black keys and the plural hammers are set to be the same in a state in which the plural white keys and the plural black keys are released, and in a state in which a first key and a second key out of the plural white keys and the plural black keys are released, the first key and the second key being both the white keys or being both the black keys, the vertical size of the first key and the vertical size of the second key are respectively set according to the distance from the front end of the operation portion of the first key to the key support portion and the distance from the front end of the operation portion of the second key to the key support portion in order that the vertical positions of the front ends of the operation portions of the first key and the second key become the same.

22. The keyboard device according to claim 21, wherein the first key and the second key are configured by combining plural components in the vertical direction, and the vertical size of one or more components out of the plural components forming the first key and the second key is set according to the distance from the front end of the operation portion of the first key to the key support portion and the distance from the front end of the operation portion of the second key to the key support portion.

23. The keyboard device according to claim 22, wherein the plural components forming the first key and the second key include a shock absorbing member mounted on a lower end of the drive portion, and the thickness of the shock absorbing member is set according to the distance from the front end of the operation portion of the first key to the key support portion and the distance from the front end of the operation portion of the second key to the key support portion.

24. The keyboard device according to claim 21, wherein the length from the front end of the operation portion to the back end of the plural white keys becomes shorter toward the high-pitched side from the low-pitched side, and the length from the front end of the operation portion to the back end of the plural black keys becomes shorter toward the high-pitched side from the low-pitched side.

25. The keyboard device according to claim 21, wherein the distance between a plane including the edge line of the first key and the key support portion of the first key is set to be the same as the distance between a plane including the edge line of the second key and the key support portion of the second key.

26. The keyboard device according to claim 21, wherein the positions of the key support portions of the first key and the second key are set to be the same.

27. The keyboard device according to claim 21, wherein the first key and the second key are adjacent white keys, and the edge line of the black key between the first key and the second key is located between the top face of the first key and the top face of the second key, in a state in which the first key, the second key, and the black key are released.

28. The keyboard device according to claim 21, wherein the first key and the second key are adjacent white keys, and the edge line of the black key between the first key and the second key is located below the top face of the first key and the top face of the second key, in a state in which the first key, the second key, and the black key are depressed, and the rocking movements of the first key, the second key, and the black key are restricted.

* * * * *